US008037678B2

(12) United States Patent
McBride et al.

(10) Patent No.: US 8,037,678 B2
(45) Date of Patent: Oct. 18, 2011

(54) ENERGY STORAGE AND GENERATION SYSTEMS AND METHODS USING COUPLED CYLINDER ASSEMBLIES

(75) Inventors: Troy O. McBride, Norwich, VT (US); Robert Cook, West Lebanon, NH (US); Benjamin R. Bollinger, Windsor, VT (US); Lee Doyle, Lebanon, NH (US); Andrew Shang, Lebanon, NH (US); Timothy Wilson, Litchfield, NH (US); Michael Neil Scott, West Lebanon, NH (US); Patrick Magari, Plainfield, NH (US); Benjamin Cameron, Hanover, NH (US); Dimitri Deserranno, Enfield, NH (US)

(73) Assignee: SustainX, Inc., West Lebanon, NH (US)

( * ) Notice: Subject to any disclaimer, the term of this patent is extended or adjusted under 35 U.S.C. 154(b) by 0 days.

(21) Appl. No.: 12/879,595

(22) Filed: Sep. 10, 2010

(65) Prior Publication Data

US 2011/0056368 A1 Mar. 10, 2011

Related U.S. Application Data

(60) Provisional application No. 61/241,568, filed on Sep. 11, 2009, provisional application No. 61/251,965, filed on Oct. 15, 2009, provisional application No. 61/318,060, filed on Mar. 26, 2010, provisional application No. 61/326,453, filed on Apr. 21, 2010.

(51) Int. Cl.
*F28D 20/02* (2006.01)
*F03B 17/00* (2006.01)

(52) U.S. Cl. ..... 60/413; 91/508; 60/412

(58) Field of Classification Search ..... 91/165, 91/166, 508; 60/398, 412, 413
See application file for complete search history.

(56) References Cited

U.S. PATENT DOCUMENTS

| | | | |
|---|---|---|---|
| 114,297 | A | 5/1871 | Ivens et al. |
| 224,081 | A | 2/1880 | Eckart |
| 233,432 | A | 10/1880 | Pitchford |
| 1,635,524 | A | 7/1927 | Aikman |
| 1,681,280 | A | 8/1928 | Bruckner |
| 2,025,142 | A | 12/1935 | Zahm et al. |
| 2,042,991 | A | 6/1936 | Harris, Jr. |
| 2,141,703 | A | 12/1938 | Bays |
| 2,280,100 | A | 4/1942 | Singleton |
| 2,280,845 | A | 4/1942 | Parker |
| 2,404,660 | A | 7/1946 | Rouleau |
| 2,420,098 | A | 5/1947 | Rouleau |
| 2,539,862 | A | 1/1951 | Rushing |

(Continued)

FOREIGN PATENT DOCUMENTS

| | | |
|---|---|---|
| BE | 898225 | 3/1984 |

(Continued)

OTHER PUBLICATIONS

International Search Report and Written Opinion for International Application No. PCT/US2010/055279 mailed Jan. 24, 2011, 14 pages.

(Continued)

*Primary Examiner* — Thomas E Lazo
(74) *Attorney, Agent, or Firm* — Bingham McCutchen, LLP

(57) ABSTRACT

In various embodiments, pneumatic cylinder assemblies are coupled in series pneumatically, thereby reducing a range of force produced by or acting on the pneumatic cylinder assemblies during expansion or compression of a gas.

20 Claims, 33 Drawing Sheets

U.S. PATENT DOCUMENTS

| | | | | |
|---|---|---|---|---|
| 2,628,564 | A | | 2/1953 | Jacobs |
| 2,712,728 | A | | 7/1955 | Lewis et al. |
| 2,813,398 | A | | 11/1957 | Wilcox |
| 2,829,501 | A | | 4/1958 | Walls |
| 2,880,759 | A | | 4/1959 | Wisman |
| 3,041,842 | A | | 7/1962 | Heinecke |
| 3,236,512 | A | | 2/1966 | Caslav et al. |
| 3,269,121 | A | | 8/1966 | Ludwig |
| 3,538,340 | A | | 11/1970 | Lang |
| 3,608,311 | A | | 9/1971 | Roesel, Jr. |
| 3,648,458 | A | | 3/1972 | McAlister |
| 3,650,636 | A | | 3/1972 | Eskeli |
| 3,672,160 | A | | 6/1972 | Kim |
| 3,677,008 | A | | 7/1972 | Koutz |
| 3,704,079 | A | | 11/1972 | Berlyn |
| 3,757,517 | A | | 9/1973 | Rigollot |
| 3,793,848 | A | | 2/1974 | Eskeli |
| 3,801,793 | A | | 4/1974 | Goebel |
| 3,803,847 | A | | 4/1974 | McAlister |
| 3,839,863 | A | | 10/1974 | Frazier |
| 3,847,182 | A | | 11/1974 | Greer |
| 3,895,493 | A | | 7/1975 | Riqollot |
| 3,903,696 | A | | 9/1975 | Carman |
| 3,935,469 | A | | 1/1976 | Haydock |
| 3,939,356 | A | | 2/1976 | Loane |
| 3,942,323 | A | * | 3/1976 | Maillet ..... 60/413 |
| 3,945,207 | A | | 3/1976 | Hyatt |
| 3,948,049 | A | | 4/1976 | Ohms et al. |
| 3,952,516 | A | | 4/1976 | Lapp |
| 3,952,723 | A | | 4/1976 | Browning |
| 3,958,899 | A | | 5/1976 | Coleman, Jr. et al. |
| 3,986,354 | A | | 10/1976 | Erb |
| 3,988,592 | A | | 10/1976 | Porter |
| 3,988,897 | A | | 11/1976 | Strub |
| 3,990,246 | A | | 11/1976 | Wilmers |
| 3,991,574 | A | | 11/1976 | Frazier |
| 3,996,741 | A | | 12/1976 | Herberg |
| 3,998,049 | A | | 12/1976 | McKinley et al. |
| 4,008,006 | A | | 2/1977 | Bea |
| 4,027,993 | A | | 6/1977 | Wolff |
| 4,030,303 | A | | 6/1977 | Kraus et al. |
| 4,031,702 | A | | 6/1977 | Burnett et al. |
| 4,031,704 | A | | 6/1977 | Moore et al. |
| 4,041,708 | A | | 8/1977 | Wolff |
| 4,050,246 | A | | 9/1977 | Bourquardez |
| 4,055,950 | A | | 11/1977 | Grossman |
| 4,058,979 | A | | 11/1977 | Germain |
| 4,089,744 | A | | 5/1978 | Cahn |
| 4,095,118 | A | | 6/1978 | Rathbun |
| 4,100,745 | A | | 7/1978 | Gyarmathy et al. |
| 4,108,077 | A | | 8/1978 | Laing |
| 4,109,465 | A | | 8/1978 | Plen |
| 4,110,987 | A | | 9/1978 | Cahn et al. |
| 4,112,311 | A | | 9/1978 | Theyse |
| 4,117,342 | A | | 9/1978 | Melley, Jr. |
| 4,117,696 | A | | 10/1978 | Fawcett et al. |
| 4,118,637 | A | | 10/1978 | Tackett |
| 4,124,182 | A | | 11/1978 | Loeb |
| 4,126,000 | A | | 11/1978 | Funk |
| 4,136,432 | A | | 1/1979 | Melley, Jr. |
| 4,142,368 | A | | 3/1979 | Mantegani |
| 4,147,204 | A | | 4/1979 | Pfenninger |
| 4,149,092 | A | | 4/1979 | Cros |
| 4,150,547 | A | | 4/1979 | Hobson |
| 4,154,292 | A | | 5/1979 | Herrick |
| 4,167,372 | A | | 9/1979 | Tackett |
| 4,170,878 | A | | 10/1979 | Jahniq |
| 4,173,431 | A | | 11/1979 | Smith |
| 4,189,925 | A | | 2/1980 | Long |
| 4,197,700 | A | | 4/1980 | Jahniq |
| 4,197,715 | A | | 4/1980 | Fawcett et al. |
| 4,201,514 | A | | 5/1980 | Huetter |
| 4,204,126 | A | | 5/1980 | Diggs |
| 4,206,608 | A | | 6/1980 | Bell |
| 4,209,982 | A | | 7/1980 | Pitts |
| 4,220,006 | A | | 9/1980 | Kindt |
| 4,229,143 | A | | 10/1980 | Pucher |
| 4,229,661 | A | | 10/1980 | Mead et al. |
| 4,232,253 | A | | 11/1980 | Mortelmans |
| 4,237,692 | A | | 12/1980 | Ahrens et al. |
| 4,242,878 | A | | 1/1981 | Brinkerhoff |
| 4,246,978 | A | | 1/1981 | Schulz et al. |
| 4,262,735 | A | | 4/1981 | Courrege |
| 4,273,514 | A | | 6/1981 | Shore et al. |
| 4,274,010 | A | | 6/1981 | Lawson-Tancred |
| 4,275,310 | A | | 6/1981 | Summers et al. |
| 4,281,256 | A | | 7/1981 | Ahrens |
| 4,293,323 | A | | 10/1981 | Cohen |
| 4,299,198 | A | | 11/1981 | Woodhull |
| 4,302,684 | A | | 11/1981 | Gogins |
| 4,304,103 | A | | 12/1981 | Hamrick |
| 4,311,011 | A | | 1/1982 | Lewis |
| 4,316,096 | A | | 2/1982 | Syverson |
| 4,317,439 | A | | 3/1982 | Emmerling |
| 4,335,867 | A | | 6/1982 | Bihlmaier |
| 4,340,822 | A | | 7/1982 | Gregg |
| 4,341,072 | A | | 7/1982 | Clyne |
| 4,348,863 | A | | 9/1982 | Taylor et al. |
| 4,353,214 | A | | 10/1982 | Gardner |
| 4,354,420 | A | | 10/1982 | Bianchetta |
| 4,355,956 | A | | 10/1982 | Ringrose et al. |
| 4,358,250 | A | | 11/1982 | Payne |
| 4,367,786 | A | | 1/1983 | Hafner et al. |
| 4,368,692 | A | | 1/1983 | Kita |
| 4,368,775 | A | | 1/1983 | Ward |
| 4,370,559 | A | | 1/1983 | Langley, Jr. |
| 4,372,114 | A | | 2/1983 | Burnham |
| 4,375,387 | A | | 3/1983 | deFilippi et al. |
| 4,380,419 | A | | 4/1983 | Morton |
| 4,393,752 | A | | 7/1983 | Meier |
| 4,411,136 | A | | 10/1983 | Funk |
| 4,421,661 | A | | 12/1983 | Claar et al. |
| 4,428,711 | A | | 1/1984 | Archer |
| 4,435,131 | A | | 3/1984 | Ruben |
| 4,444,011 | A | | 4/1984 | Kolin |
| 4,446,698 | A | | 5/1984 | Benson |
| 4,447,738 | A | | 5/1984 | Allison |
| 4,449,372 | A | | 5/1984 | Rilett |
| 4,452,046 | A | | 6/1984 | Valentin |
| 4,454,429 | A | | 6/1984 | Buonome |
| 4,454,720 | A | | 6/1984 | Leibowitz |
| 4,455,834 | A | | 6/1984 | Earle |
| 4,462,213 | A | | 7/1984 | Lewis |
| 4,474,002 | A | | 10/1984 | Perry |
| 4,476,851 | A | | 10/1984 | Brugger et al. |
| 4,478,553 | A | | 10/1984 | Leibowitz et al. |
| 4,489,554 | A | | 12/1984 | Otters |
| 4,491,739 | A | | 1/1985 | Watson |
| 4,492,539 | A | | 1/1985 | Specht |
| 4,493,189 | A | | 1/1985 | Slater |
| 4,496,847 | A | | 1/1985 | Parkins |
| 4,498,848 | A | | 2/1985 | Petrovsky |
| 4,502,284 | A | | 3/1985 | Chrisoghilos |
| 4,503,673 | A | | 3/1985 | Schachle |
| 4,515,516 | A | | 5/1985 | Perrine et al. |
| 4,520,840 | A | | 6/1985 | Michel |
| 4,525,631 | A | | 6/1985 | Allison |
| 4,530,208 | A | | 7/1985 | Sato |
| 4,547,209 | A | | 10/1985 | Netzer |
| 4,585,039 | A | | 4/1986 | Hamilton |
| 4,589,475 | A | | 5/1986 | Jones |
| 4,593,202 | A | | 6/1986 | Dickinson |
| 4,619,225 | A | | 10/1986 | Lowther |
| 4,624,623 | A | | 11/1986 | Wagner |
| 4,648,801 | A | | 3/1987 | Wilson |
| 4,651,525 | A | | 3/1987 | Cestero |
| 4,653,986 | A | | 3/1987 | Ashton |
| 4,671,742 | A | | 6/1987 | Gyimesi |
| 4,676,068 | A | | 6/1987 | Funk |
| 4,679,396 | A | | 7/1987 | Heggie |
| 4,691,524 | A | | 9/1987 | Holscher |
| 4,693,080 | A | | 9/1987 | Van Hooff |
| 4,706,456 | A | | 11/1987 | Backe |
| 4,707,988 | A | | 11/1987 | Palmers |
| 4,710,100 | A | | 12/1987 | Laing et al. |
| 4,735,552 | A | | 4/1988 | Watson |
| 4,739,620 | A | | 4/1988 | Pierce |

4,760,697 A 8/1988 Heggie
4,761,118 A 8/1988 Zanarini et al.
4,765,142 A 8/1988 Nakhamkin
4,765,143 A 8/1988 Crawford et al.
4,767,938 A 8/1988 Bervig
4,792,700 A 12/1988 Ammons
4,849,648 A 7/1989 Longardner
4,870,816 A 10/1989 Nakhamkin
4,872,307 A 10/1989 Nakhamkin
4,873,828 A 10/1989 Laing et al.
4,873,831 A 10/1989 Dehne
4,876,992 A 10/1989 Sobotowski
4,877,530 A 10/1989 Moses
4,885,912 A 12/1989 Nakhamkin
4,886,534 A 12/1989 Castan
4,907,495 A 3/1990 Sugahara
4,936,109 A 6/1990 Longardner
4,942,736 A 7/1990 Bronicki
4,947,977 A 8/1990 Raymond
4,955,195 A 9/1990 Jones et al.
4,984,432 A 1/1991 Corey
5,056,601 A 10/1991 Grimmer
5,058,385 A 10/1991 Everett, Jr.
5,062,498 A 11/1991 Tobias
5,107,681 A 4/1992 Wolfbauer, III
5,133,190 A 7/1992 Abdelmalek
5,138,838 A 8/1992 Crosser
5,140,170 A 8/1992 Henderson
5,152,260 A 10/1992 Erickson et al.
5,161,449 A 11/1992 Everett, Jr.
5,169,295 A 12/1992 Stogner et al.
5,182,086 A 1/1993 Henderson et al.
5,203,168 A 4/1993 Oshina
5,209,063 A 5/1993 Shirai et al.
5,213,470 A 5/1993 Lundquist
5,239,833 A 8/1993 Fineblum
5,259,345 A 11/1993 Richeson
5,271,225 A 12/1993 Adamides
5,279,206 A 1/1994 Krantz
5,296,799 A 3/1994 Davis
5,309,713 A 5/1994 Vassallo
5,321,946 A 6/1994 Abdelmalek
5,327,987 A 7/1994 Abdelmalek
5,339,633 A 8/1994 Fujii et al.
5,341,644 A 8/1994 Nelson
5,344,627 A 9/1994 Fujii et al.
5,364,611 A 11/1994 Iijima et al.
5,365,980 A 11/1994 Deberardinis
5,375,417 A 12/1994 Barth
5,379,589 A 1/1995 Cohn et al.
5,384,489 A 1/1995 Bellac
5,387,089 A 2/1995 Stogner et al.
5,394,693 A 3/1995 Plyter
5,427,194 A 6/1995 Miller
5,436,508 A 7/1995 Sorensen
5,448,889 A 9/1995 Bronicki
5,454,408 A 10/1995 Dibella et al.
5,454,426 A 10/1995 Moseley
5,467,722 A 11/1995 Meratla
5,477,677 A 12/1995 Krnavek
5,491,969 A 2/1996 Cohn et al.
5,491,977 A 2/1996 Cho
5,524,821 A 6/1996 Yie et al.
5,537,822 A 7/1996 Shnaid et al.
5,544,698 A 8/1996 Paulman
5,561,978 A 10/1996 Buschur
5,562,010 A 10/1996 McGuire
5,579,640 A 12/1996 Gray, Jr. et al.
5,584,664 A 12/1996 Elliott et al.
5,592,028 A 1/1997 Pritchard
5,598,736 A 2/1997 Erskine
5,599,172 A 2/1997 Mccabe
5,600,953 A 2/1997 Oshita et al.
5,616,007 A 4/1997 Cohen
5,634,340 A 6/1997 Grennan
5,641,273 A 6/1997 Moseley
5,674,053 A 10/1997 Paul et al.
5,685,155 A 11/1997 Brown
5,768,893 A 6/1998 Hoshino et al.
5,769,610 A 6/1998 Paul et al.
5,771,693 A 6/1998 Coney
5,775,107 A 7/1998 Sparkman
5,778,675 A 7/1998 Nakhamkin
5,794,442 A 8/1998 Lisniansky
5,797,980 A 8/1998 Fillet
5,819,533 A 10/1998 Moonen
5,819,635 A 10/1998 Moonen
5,831,757 A 11/1998 DiFrancesco
5,832,728 A 11/1998 Buck
5,832,906 A 11/1998 Douville et al.
5,839,270 A 11/1998 Jirnov et al.
5,845,479 A 12/1998 Nakhamkin
5,873,250 A 2/1999 Lewis
5,901,809 A 5/1999 Berkun
5,924,283 A 7/1999 Burke, Jr.
5,934,063 A 8/1999 Nakhamkin
5,934,076 A 8/1999 Coney
5,937,652 A 8/1999 Abdelmalek
5,971,027 A 10/1999 Beachley et al.
6,012,279 A 1/2000 Hines
6,023,105 A 2/2000 Youssef
6,026,349 A 2/2000 Heneman
6,029,445 A 2/2000 Lech
6,073,445 A 6/2000 Johnson
6,073,448 A 6/2000 Lozada
6,085,520 A 7/2000 Kohno
6,090,186 A 7/2000 Spencer
6,119,802 A 9/2000 Puett, Jr.
6,132,181 A 10/2000 Mccabe
6,145,311 A 11/2000 Cyphelly
6,148,602 A 11/2000 Demetri
6,153,943 A 11/2000 Mistr, Jr.
6,158,499 A 12/2000 Rhodes
6,170,443 B1 1/2001 Hofbauer
6,178,735 B1 1/2001 Frutschi
6,179,446 B1 1/2001 Sarmadi
6,188,182 B1 2/2001 Nickols et al.
6,202,707 B1 3/2001 Woodall et al.
6,206,660 B1 3/2001 Coney et al.
6,210,131 B1 4/2001 Whitehead
6,216,462 B1 4/2001 Gray, Jr.
6,225,706 B1 5/2001 Keller
6,276,123 B1 8/2001 Chen et al.
6,327,858 B1 12/2001 Negre et al.
6,327,994 B1 12/2001 Labrador
6,349,543 B1 2/2002 Lisniansky
RE37,603 E 3/2002 Coney
6,352,576 B1 3/2002 Spencer et al.
6,360,535 B1 3/2002 Fisher
6,367,570 B1 4/2002 Long, III
6,372,023 B1 4/2002 Kiyono et al.
6,389,814 B2 5/2002 Viteri et al.
6,397,578 B2 6/2002 Tsukamoto
6,401,458 B2 6/2002 Jacobson
6,407,465 B1 6/2002 Peltz et al.
6,419,462 B1 7/2002 Horie et al.
6,422,016 B2 7/2002 Alkhamis
6,478,289 B1 11/2002 Trewin
6,512,966 B2 1/2003 Lof
6,513,326 B1 2/2003 Maceda et al.
6,516,615 B1 2/2003 Stockhausen et al.
6,516,616 B2 2/2003 Carver
6,598,392 B2 7/2003 Majeres
6,598,402 B2 7/2003 Kataoka et al.
6,606,860 B2 8/2003 McFarland
6,612,348 B1 9/2003 Wiley
6,619,930 B2 9/2003 Jansen et al.
6,626,212 B2 9/2003 Morioka et al.
6,629,413 B1 10/2003 Wendt et al.
6,637,185 B2 10/2003 Hatamiya et al.
6,652,241 B1 11/2003 Alder
6,652,243 B2 11/2003 Krasnov
6,666,024 B1 12/2003 Moskal
6,670,402 B1 12/2003 Lee et al.
6,672,056 B2 1/2004 Roth et al.
6,675,765 B2 1/2004 Endoh
6,688,108 B1 2/2004 Van Liere
6,698,472 B2 3/2004 Camacho et al.

6,711,984 B2 3/2004 Tagge et al.
6,712,166 B2 3/2004 Rush et al.
6,715,514 B2 4/2004 Parker, III
6,718,761 B2 4/2004 Merswolke et al.
6,739,131 B1 5/2004 Kershaw
6,739,419 B2 * 5/2004 Jain et al. ..... 180/68.1
6,745,569 B2 6/2004 Gerdes
6,745,801 B1 6/2004 Cohen et al.
6,748,737 B2 6/2004 Lafferty
6,762,926 B1 7/2004 Shiue et al.
6,786,245 B1 9/2004 Eichelberger
6,789,387 B2 9/2004 Brinkman
6,789,576 B2 9/2004 Umetsu et al.
6,797,039 B2 9/2004 Spencer
6,815,840 B1 11/2004 Aldendeshe
6,817,185 B2 11/2004 Coney et al.
6,834,737 B2 12/2004 Bloxham
6,848,259 B2 2/2005 Kelller-Sornig
6,857,450 B2 2/2005 Rupp
6,886,326 B2 5/2005 Holtzapple et al.
6,892,802 B2 5/2005 Kelly et al.
6,900,556 B2 5/2005 Provanzana
6,922,991 B2 8/2005 Polcuch
6,925,821 B2 8/2005 Sienel
6,927,503 B2 8/2005 Enish et al.
6,931,848 B2 8/2005 Maceda et al.
6,935,096 B2 8/2005 Haiun
6,938,415 B2 9/2005 Last
6,938,654 B2 9/2005 Gershtein et al.
6,946,017 B2 9/2005 Leppin et al.
6,948,328 B2 9/2005 Kidwell
6,952,058 B2 10/2005 Mccoin
6,959,546 B2 11/2005 Corcoran
6,963,802 B2 11/2005 Enis
6,964,165 B2 11/2005 Uhl et al.
6,964,176 B2 11/2005 Kidwell
6,974,307 B2 12/2005 Antoune et al.
7,000,389 B2 2/2006 Lewellin
7,007,474 B1 3/2006 Ochs et al.
7,017,690 B2 3/2006 Burke
7,028,934 B2 4/2006 Burynski, Jr.
7,040,083 B2 5/2006 Horii et al.
7,040,108 B1 5/2006 Flammang
7,040,859 B2 5/2006 Kane
7,043,920 B2 5/2006 Viteri et al.
7,047,744 B1 5/2006 Robertson et al.
7,055,325 B2 6/2006 Wolken
7,067,937 B2 6/2006 Enish et al.
7,075,189 B2 7/2006 Heronemus
RE39,249 E 8/2006 Link, Jr.
7,084,520 B2 8/2006 Zambrano
7,086,231 B2 8/2006 Pinkerton
7,093,450 B2 8/2006 Haertel et al.
7,093,626 B2 8/2006 Li et al.
7,098,552 B2 8/2006 Mccoin
7,107,766 B2 9/2006 Zacche' et al.
7,107,767 B2 9/2006 Frazer et al.
7,116,006 B2 10/2006 Mccoin
7,124,576 B2 10/2006 Cherney et al.
7,124,586 B2 10/2006 Negre et al.
7,127,895 B2 10/2006 Pinkerton et al.
7,128,777 B2 10/2006 Spencer
7,134,279 B2 11/2006 White
7,147,331 B2 12/2006 Yamazaki et al.
7,155,912 B2 1/2007 Enis et al.
7,168,928 B1 1/2007 West
7,168,929 B2 1/2007 Siegel et al.
7,169,489 B2 1/2007 Redmond
7,177,751 B2 2/2007 Froloff
7,178,337 B2 2/2007 Pflanz
7,191,603 B2 3/2007 Taube
7,197,871 B2 4/2007 Yoshino
7,201,095 B2 4/2007 Hughey
7,218,009 B2 5/2007 Hendrickson et al.
7,219,779 B2 5/2007 Bauer et al.
7,225,762 B2 6/2007 Mahlanen
7,228,690 B2 6/2007 Barker
7,230,348 B2 6/2007 Poole
7,231,998 B1 6/2007 Schechter
7,240,812 B2 7/2007 Kamikozuru
7,249,617 B2 7/2007 Musselman et al.
7,254,944 B1 8/2007 Goetzinger et al.
7,273,122 B2 9/2007 Rose
7,281,371 B1 10/2007 Heidenreich
7,308,361 B2 12/2007 Enis et al.
7,317,261 B2 1/2008 Rolt
7,322,377 B2 1/2008 Baltes
7,325,401 B1 2/2008 Kesseli et al.
7,328,575 B2 2/2008 Hedman
7,329,099 B2 2/2008 Hartman
7,347,049 B2 3/2008 Rajendran et al.
7,353,786 B2 4/2008 Scuderi et al.
7,353,845 B2 4/2008 Underwood et al.
7,354,252 B2 4/2008 Baatrup et al.
7,364,410 B2 4/2008 Link, Jr.
7,392,871 B2 7/2008 Severinsky et al.
7,406,828 B1 8/2008 Nakhamkin
7,407,501 B2 8/2008 Zvuloni
7,415,835 B2 8/2008 Cowans et al.
7,415,995 B2 8/2008 Plummer et al.
7,418,820 B2 9/2008 Harvey et al.
7,436,086 B2 10/2008 McClintic
7,441,399 B2 10/2008 Utamura
7,448,213 B2 11/2008 Mitani
7,453,164 B2 11/2008 Borden et al.
7,469,527 B2 12/2008 Negre et al.
7,471,010 B1 12/2008 Fingersh
7,481,337 B2 1/2009 Luharuka et al.
7,488,159 B2 2/2009 Bhatt et al.
7,527,483 B1 5/2009 Glauber
7,579,700 B1 8/2009 Meller
7,603,970 B2 10/2009 Scuderi et al.
7,607,503 B1 10/2009 Schechter
7,693,402 B2 4/2010 Hudson et al.
7,802,426 B2 9/2010 Bollinger
7,827,787 B2 11/2010 Cherney et al.
7,832,207 B2 11/2010 McBride et al.
7,843,076 B2 11/2010 Gogoana et al.
7,874,155 B2 1/2011 McBride et al.
7,900,444 B1 3/2011 McBride et al.
2001/0045093 A1 11/2001 Jacobson
2003/0131599 A1 7/2003 Gerdes
2003/0145589 A1 8/2003 Tillyer
2003/0177767 A1 9/2003 Keller-Sornig et al.
2003/0180155 A1 9/2003 Coney et al.
2004/0050042 A1 3/2004 Frazer
2004/0050049 A1 3/2004 Wendt et al.
2004/0146406 A1 7/2004 Last
2004/0146408 A1 7/2004 Anderson
2004/0148934 A1 8/2004 Pinkerton et al.
2004/0211182 A1 10/2004 Gould
2004/0244580 A1 12/2004 Coney et al.
2004/0261415 A1 12/2004 Negre et al.
2005/0016165 A1 1/2005 Enis et al.
2005/0028529 A1 2/2005 Bartlett et al.
2005/0047930 A1 3/2005 Schmid
2005/0072154 A1 4/2005 Frutschi
2005/0115234 A1 6/2005 Asano et al.
2005/0155347 A1 7/2005 Lewellin
2005/0166592 A1 8/2005 Larson et al.
2005/0274334 A1 12/2005 Warren
2005/0275225 A1 12/2005 Bertolotti
2005/0279086 A1 12/2005 Hoos
2005/0279292 A1 12/2005 Hudson et al.
2006/0055175 A1 3/2006 Grinblat
2006/0059936 A1 3/2006 Radke et al.
2006/0059937 A1 3/2006 Perkins et al.
2006/0075749 A1 4/2006 Cherney et al.
2006/0090467 A1 5/2006 Crow
2006/0090477 A1 5/2006 Rolff
2006/0107664 A1 5/2006 Hudson et al.
2006/0162543 A1 7/2006 Abe et al.
2006/0162910 A1 7/2006 Kelly et al.
2006/0175337 A1 8/2006 Defosset
2006/0201148 A1 9/2006 Zabtcioglu
2006/0248886 A1 11/2006 Ma
2006/0248892 A1 11/2006 Ingersoll
2006/0254281 A1 11/2006 Badeer et al.

2006/0260311 A1 11/2006 Ingersoll
2006/0260312 A1 11/2006 Ingersoll
2006/0262465 A1 11/2006 Wiederhold
2006/0266034 A1 11/2006 Ingersoll
2006/0266035 A1 11/2006 Ingersoll et al.
2006/0266036 A1 11/2006 Ingersoll
2006/0266037 A1 11/2006 Ingersoll
2006/0280993 A1 12/2006 Keefer et al.
2006/0283967 A1 12/2006 Cho et al.
2007/0006586 A1 1/2007 Hoffman et al.
2007/0022754 A1 2/2007 Perkins et al.
2007/0022755 A1 2/2007 Pinkerton et al.
2007/0062194 A1 3/2007 Ingersoll
2007/0074533 A1 4/2007 Hugenroth et al.
2007/0095069 A1 5/2007 Joshi et al.
2007/0113803 A1 5/2007 Froloff et al.
2007/0116572 A1 5/2007 Barbu et al.
2007/0137595 A1 6/2007 Greenwell
2007/0151528 A1 7/2007 Hedman
2007/0158946 A1 7/2007 Annen et al.
2007/0181199 A1 8/2007 Weber
2007/0182160 A1 8/2007 Enis et al.
2007/0205298 A1 9/2007 Harrison et al.
2007/0234749 A1 10/2007 Enis et al.
2007/0243066 A1 10/2007 Baron
2007/0245735 A1 10/2007 Ashikian
2007/0258834 A1 11/2007 Froloff et al.
2008/0000436 A1 1/2008 Goldman
2008/0016868 A1 1/2008 Ochs et al.
2008/0047272 A1 2/2008 Schoell
2008/0050234 A1 2/2008 Ingersoll et al.
2008/0072870 A1 3/2008 Chomyszak et al.
2008/0087165 A1 4/2008 Wright et al.
2008/0104939 A1 5/2008 Hoffmann et al.
2008/0112807 A1 5/2008 Uphues et al.
2008/0127632 A1 6/2008 Finkenrath et al.
2008/0138265 A1 6/2008 Lackner et al.
2008/0155975 A1 7/2008 Brinkman
2008/0155976 A1 7/2008 Smith et al.
2008/0157528 A1 7/2008 Wang et al.
2008/0157537 A1 7/2008 Richard
2008/0164449 A1 7/2008 Gray et al.
2008/0185194 A1 8/2008 Leone
2008/0202120 A1 8/2008 Karyambas
2008/0211230 A1 9/2008 Gurin
2008/0228323 A1 9/2008 Laumer et al.
2008/0233029 A1 9/2008 Fan et al.
2008/0238105 A1 10/2008 Ortiz et al.
2008/0238187 A1 10/2008 Garnett et al.
2008/0250788 A1 10/2008 Nuel et al.
2008/0251302 A1 10/2008 Lynn et al.
2008/0272597 A1 11/2008 Althaus
2008/0272598 A1 11/2008 Nakhamkin
2008/0272605 A1 11/2008 Borden et al.
2008/0308168 A1 12/2008 O'Brien, II et al.
2008/0308270 A1 12/2008 Wilson
2008/0315589 A1 12/2008 Malmrup
2009/0000290 A1 1/2009 Brinkman
2009/0007558 A1 1/2009 Hall et al.
2009/0008173 A1 1/2009 Hall et al.
2009/0010772 A1 1/2009 Siemroth
2009/0020275 A1 1/2009 Neher et al.
2009/0021012 A1 1/2009 Stull et al.
2009/0056331 A1 3/2009 Zhao et al.
2009/0071153 A1 3/2009 Boyapati et al.
2009/0107784 A1 4/2009 Gabriel et al.
2009/0145130 A1 6/2009 Kaufman
2009/0158740 A1 6/2009 Littau et al.
2009/0178409 A1 7/2009 Shinnar
2009/0200805 A1 8/2009 Kim et al.
2009/0220364 A1* 9/2009 Rigal et al. ..... 417/521
2009/0229902 A1 9/2009 Stansbury, III
2009/0249826 A1 10/2009 Hugelman
2009/0282822 A1 11/2009 McBride et al.
2009/0282840 A1 11/2009 Chen et al.
2009/0294096 A1 12/2009 Mills et al.
2009/0301089 A1 12/2009 Bollinger
2009/0317267 A1 12/2009 Gill et al.
2009/0322090 A1 12/2009 Wolf
2010/0018196 A1 1/2010 Li et al.
2010/0077765 A1 4/2010 Japikse
2010/0089063 A1 4/2010 McBride et al.
2010/0133903 A1 6/2010 Rufer et al.
2010/0139277 A1 6/2010 McBride et al.
2010/0193270 A1 8/2010 Deshaies et al.
2010/0199652 A1 8/2010 Lemofouet et al.
2010/0205960 A1 8/2010 McBride et al.
2010/0229544 A1 9/2010 Bollinger et al.
2010/0307156 A1 12/2010 Bollinger et al.
2010/0326062 A1 12/2010 Fong et al.
2010/0326064 A1 12/2010 Fong et al.
2010/0326066 A1 12/2010 Fong et al.
2010/0326068 A1 12/2010 Fong et al.
2010/0326069 A1 12/2010 Fong et al.
2010/0326075 A1 12/2010 Fong et al.
2010/0329891 A1 12/2010 Fong et al.
2010/0329903 A1 12/2010 Fong et al.
2010/0329909 A1 12/2010 Fong et al.
2011/0023488 A1 2/2011 Fong et al.
2011/0023977 A1 2/2011 Fong et al.
2011/0030359 A1 2/2011 Fong et al.
2011/0030552 A1 2/2011 Fong et al.
2011/0056193 A1 3/2011 McBride et al.
2011/0056368 A1 3/2011 McBride et al.
2011/0061741 A1 3/2011 Ingersoll et al.
2011/0061836 A1 3/2011 Ingersoll et al.
2011/0062166 A1 3/2011 Ingersoll et al.
2011/0079010 A1 4/2011 McBride et al.
2011/0083438 A1 4/2011 McBride et al.
2011/0107755 A1 5/2011 McBride et al.
2011/0115223 A1 5/2011 Stahlkopf et al.
2011/0131966 A1 6/2011 McBride et al.
2011/0138797 A1 6/2011 Bollinger et al.
2011/0167813 A1 7/2011 McBride et al.

FOREIGN PATENT DOCUMENTS

BE 1008885 8/1996
CN 1061262 5/1992
CN 1171490 1/1998
CN 1276308 12/2000
CN 1277323 12/2000
CN 1412443 4/2003
CN 1743665 3/2006
CN 2821162 9/2006
CN 2828319 10/2006
CN 2828368 10/2006
CN 1884822 12/2006
CN 1888328 1/2007
CN 1967091 5/2007
CN 101033731 9/2007
CN 101042115 9/2007
CN 101070822 11/2007
CN 101149002 3/2008
CN 101162073 4/2008
CN 201103518 8/2008
CN 201106527 8/2008
CN 101289963 10/2008
CN 201125855 10/2008
CN 101377190 4/2009
CN 101408213 4/2009
CN 101435451 5/2009
DE 25 38 870 6/1977
DE 19530253 11/1996
DE 19903907 8/2000
DE 19911534 9/2000
DE 10042020 5/2001
DE 20118183 3/2003
DE 20120330 4/2003
DE 10147940 5/2003
DE 10205733 8/2003
DE 10212480 10/2003
DE 20312293 12/2003
DE 10220499 4/2004
DE 10334637 2/2005
DE 10 2005 047622 4/2007
EP 0204748 3/1981
EP 0091801 10/1983

| | | |
|---|---|---|
| EP | 0097002 | 12/1983 |
| EP | 0196690 | 10/1986 |
| EP | 0212692 | 3/1987 |
| EP | 0364106 | 4/1990 |
| EP | 0507395 | 10/1992 |
| EP | 0821162 | 1/1998 |
| EP | 0 857 877 | 8/1998 |
| EP | 1 388 442 | 2/2004 |
| EP | 1405662 | 4/2004 |
| EP | 1657452 | 5/2006 |
| EP | 1726350 | 11/2006 |
| EP | 1741899 | 1/2007 |
| EP | 1 780 058 | 5/2007 |
| EP | 1988294 | 11/2008 |
| EP | 2014896 | 1/2009 |
| EP | 2078857 | 7/2009 |
| FR | 2449805 | 9/1980 |
| FR | 2816993 | 5/2002 |
| FR | 2829805 | 3/2003 |
| GB | 722524 | 11/1951 |
| GB | 772703 | 4/1957 |
| GB | 1449076 | 9/1976 |
| GB | 1479940 | 7/1977 |
| GB | 2106992 | 4/1983 |
| GB | 2223810 | 4/1990 |
| GB | 2 300 673 | 11/1996 |
| GB | 2373546 | 9/2002 |
| GB | 2403356 | 12/2004 |
| JP | 57010778 | 1/1982 |
| JP | 57070970 | 5/1982 |
| JP | 57120058 | 7/1982 |
| JP | 58183880 | 10/1982 |
| JP | 58150079 | 9/1983 |
| JP | 58192976 | 11/1983 |
| JP | 60206985 | 10/1985 |
| JP | 62101900 | 5/1987 |
| JP | 63227973 | 9/1988 |
| JP | 2075674 | 3/1990 |
| JP | 2247469 | 10/1990 |
| JP | 3009090 | 1/1991 |
| JP | 3281984 | 12/1991 |
| JP | 4121424 | 4/1992 |
| JP | 6185450 | 7/1994 |
| JP | 8145488 | 6/1996 |
| JP | 9166079 | 6/1997 |
| JP | 10313547 | 11/1998 |
| JP | 2000-346093 | 6/1999 |
| JP | 11351125 | 12/1999 |
| JP | 2000166128 | 6/2000 |
| JP | 200346093 | 12/2000 |
| JP | 2002127902 | 5/2002 |
| JP | 2003083230 | 3/2003 |
| JP | 2005023918 | 1/2005 |
| JP | 2005036769 | 2/2005 |
| JP | 2005068963 | 3/2005 |
| JP | 2006220252 | 8/2006 |
| JP | 2007001872 | 1/2007 |
| JP | 2007145251 | 6/2007 |
| JP | 2007211730 | 8/2007 |
| JP | 2008038658 | 2/2008 |
| KR | 840000180 | 2/1984 |
| KR | 2004004637 | 1/2004 |
| RU | 2101562 | 1/1998 |
| RU | 2169857 | 6/2001 |
| RU | 2213255 | 9/2003 |
| SU | 800438 | 1/1981 |
| UA | 69030 | 8/2004 |
| WO | WO-82/00319 | 2/1982 |
| WO | WO-88002818 | 4/1988 |
| WO | WO-99/41498 | 8/1990 |
| WO | WO-92/22741 | 12/1992 |
| WO | WO-93/06367 | 4/1993 |
| WO | WO-93/11363 | 6/1993 |
| WO | WO-93/24754 | 12/1993 |
| WO | WO 9412785 | 6/1994 |
| WO | WO-95/25381 | 9/1995 |
| WO | WO-96/01942 | 1/1996 |
| WO | WO-96/22456 | 7/1996 |
| WO | WO-96/34213 | 10/1996 |
| WO | WO-97/01029 | 1/1997 |
| WO | WO-97/17546 | 5/1997 |
| WO | WO-98/02818 | 1/1998 |
| WO | WO-98/17492 | 4/1998 |
| WO | WO-00/01945 | 1/2000 |
| WO | WO-00/37800 | 6/2000 |
| WO | WO-00/65212 | 11/2000 |
| WO | WO-00/68578 | 11/2000 |
| WO | WO 0175290 | 10/2001 |
| WO | WO-02/25083 | 3/2002 |
| WO | WO-02/46621 | 6/2002 |
| WO | WO-02/103200 | 12/2002 |
| WO | WO-03/021702 | 3/2003 |
| WO | WO-03/078812 | 9/2003 |
| WO | WO-03/081011 | 10/2003 |
| WO | WO-2004/034391 | 5/2004 |
| WO | WO-2004/059155 | 7/2004 |
| WO | WO-2004/072452 | 8/2004 |
| WO | WO-2004/074679 | 9/2004 |
| WO | WO-2004/109172 | 12/2004 |
| WO | WO-2005/044424 | 5/2005 |
| WO | WO-2005/062969 | 7/2005 |
| WO | WO-2005/067373 | 7/2005 |
| WO | WO-2005/079461 | 9/2005 |
| WO | WO-2005/088131 | 9/2005 |
| WO | WO-2005/095155 | 10/2005 |
| WO | WO-2006/029633 | 3/2006 |
| WO | WO-2006/058085 | 6/2006 |
| WO | WO-2006/124006 | 11/2006 |
| WO | WO-2007/002094 | 1/2007 |
| WO | WO-2007/003954 | 1/2007 |
| WO | WO-2007/012143 | 2/2007 |
| WO | WO-2007/035997 | 4/2007 |
| WO | WO-2007/051034 | 5/2007 |
| WO | WO-2007/066117 | 6/2007 |
| WO | WO-2007/086792 | 8/2007 |
| WO | WO-2007/089872 | 8/2007 |
| WO | WO-2007/096656 | 8/2007 |
| WO | WO 2007096127 A1 * | 8/2007 |
| WO | WO-2007/111839 | 10/2007 |
| WO | WO-2007/136765 | 11/2007 |
| WO | WO-2007/140914 | 12/2007 |
| WO | WO-2008/003950 | 1/2008 |
| WO | WO-2008/014769 | 2/2008 |
| WO | WO-2008023901 | 2/2008 |
| WO | WO-2008/027259 | 3/2008 |
| WO | WO-2008/028881 | 3/2008 |
| WO | WO-2008/039725 | 4/2008 |
| WO | WO-2008/045468 | 4/2008 |
| WO | WO-2009045468 | 4/2008 |
| WO | WO-2008/051427 | 5/2008 |
| WO | WO-2008/074075 | 6/2008 |
| WO | WO-2008/084507 | 7/2008 |
| WO | WO-2008/091373 | 7/2008 |
| WO | WO 2008102292 | 8/2008 |
| WO | WO-2008/106967 | 9/2008 |
| WO | WO-2008/108870 | 9/2008 |
| WO | WO-2008/109006 | 9/2008 |
| WO | WO-2008/110018 | 9/2008 |
| WO | WO-2008/115479 | 9/2008 |
| WO | WO-2008/121378 | 10/2008 |
| WO | WO-2008139267 | 11/2008 |
| WO | WO-2008/152432 | 12/2008 |
| WO | WO-2008/153591 | 12/2008 |
| WO | WO-2008/157327 | 12/2008 |
| WO | WO-2009/034421 | 3/2009 |
| WO | WO-2009/034548 | 3/2009 |
| WO | WO-2009/038973 | 3/2009 |
| WO | WO-2009/044139 | 4/2009 |
| WO | WO-2009/045110 | 4/2009 |
| WO | WO-2009/114205 | 9/2009 |
| WO | WO-2009/126784 | 10/2009 |
| WO | WO-2010/006319 | 1/2010 |
| WO | WO-2010/009053 | 1/2010 |
| WO | WO-2010/105155 | 9/2010 |
| WO | WO-2010/135658 | 11/2010 |
| WO | WO-2011/008321 | 1/2011 |
| WO | WO-2011/008325 | 1/2011 |
| WO | WO-2011/008500 | 1/2011 |

OTHER PUBLICATIONS

"Hydraulic Transformer Supplies Continuous High Pressure," Machine Design, Penton Media, vol. 64, No. 17, (Aug. 1992), 1 page.
Lemofouet, "Investigation and Optimisation of Hybrid Electricity Storage Systems Based on Compressed Air and Supercapacitors," (Oct. 20, 2006), 250 pages.
Cyphelly et al., "Usage of Compressed Air Storage Systems," BFE-Program "Electricity," Final Report, May 2004, 14 pages.
Lemofouet et al., "A Hybrid Energy Storage System Based on Compressed Air and Supercapacitors with Maximum Efficiency Point Tracking (MEPT)," IEEE Transactions on Industrial Electron, vol. 53, No. 4, (Aug. 2006) pp. 1105-1115.
International Search Report and Written Opinion issued Sep. 15, 2009 for International Application No. PCT/US2009/040027, 8 pages.
International Search Report and Written Opinion issued Aug. 30, 2010 for International Application No. PCT/US2010/029795, 9 pages.
International Search Report and Written Opinion issued Dec. 3, 2009 for International Application No. PCT/US2009/046725, 9 pages.
International Search Report and Written Opinion mailed May 25, 2011 for International Application No. PCT/US2010/027138 (12 pages).
Rufer et al., "Energetic Performance of a Hybrid Energy Storage System Based on Compressed Air and Super Capacitors," Power Electronics, Electrical Drives, Automation and Motion, pp. 469-474 (May 1, 2006).
Lemofouet et al. "Hybrid Energy Storage Systems based on Compressed Air and Supercapacitors with Maximum Efficiency Point Tracking," Industrial Electronics Laboratory (LEI), (2005), pp. 1-10.
Lemofouet et al. "Hybrid Energy Storage Systems based on Compressed Air and Supercapacitors with Maximum Efficiency Point Tracking," The International Power Electronics Conference, (2005), pp. 461-468.

* cited by examiner

ENERGY STORAGE AND GENERATION SYSTEMS AND METHODS USING COUPLED CYLINDER ASSEMBLIES

RELATED APPLICATIONS

This application claims the benefit of and priority to U.S. Provisional Patent Application No. 61/241,568, filed Sep. 11, 2009; U.S. Provisional Patent Application No. 61/251,965, filed Oct. 15, 2009; U.S. Provisional Patent Application No. 61/318,060, filed Mar. 26, 2010; and U.S. Provisional Patent Application No. 61/326,453, filed Apr. 21, 2010; the entire disclosure of each of which is hereby incorporated herein by reference.

STATEMENT REGARDING FEDERALLY SPONSORED RESEARCH

This invention was made with government support under IIP-0810590 and IIP-0923633 awarded by the NSF. The government has certain rights in the invention.

FIELD OF THE INVENTION

In various embodiments, the present invention relates to hydraulics, pneumatics, power generation, and energy storage, and more particularly, to compressed-gas energy-storage systems using pneumatic and/or hydraulic cylinders.

BACKGROUND

Storing energy in the form of compressed gas has a long history and components tend to be well tested, reliable, and have long lifetimes. The general principle of compressed-gas energy storage (CAES) is that generated energy (e.g., electric energy) is used to compress gas (e.g., air), thus converting the original energy to pressure potential energy; this potential energy is later recovered in a useful form (e.g., converted back to electricity) via gas expansion coupled to an appropriate mechanism. Advantages of compressed-gas energy storage include low specific-energy costs, long lifetime, low maintenance, reasonable energy density, and good reliability.

If expansion occurs slowly relative to the rate of heat exchange between the gas and its environment, then the gas remains at approximately constant temperature as it expands. This process is termed "isothermal" expansion. Isothermal expansion of a quantity of gas stored at a given temperature recovers approximately three times more work than would "adiabatic expansion," that is, one in which no heat is exchanged between the gas and its environment, because the expansion happens rapidly or in an insulated chamber. Gas may also be compressed isothermally or adiabatically.

An ideally isothermal energy-storage cycle of compression, storage, and expansion would have 100% thermodynamic efficiency. An ideally adiabatic energy-storage cycle would also have 100% thermodynamic efficiency, but there are many practical disadvantages to the adiabatic approach. These include the production of higher temperature and pressure extremes within the system, heat loss during the storage period, and inability to exploit environmental (e.g., cogenerative) heat sources and sinks during compression and expansion, respectively. In an isothermal system, the cost of adding a heat-exchange system is traded against resolving the difficulties of the adiabatic approach. In either case, mechanical energy from expanding gas must usually be converted to electrical energy before use.

An efficient and novel design for storing energy in the form of compressed gas utilizing near isothermal gas compression and expansion has been shown and described in U.S. patent application Ser. Nos. 12/421,057 (the '057 application) and 12/639,703 (the '703 application), the disclosures of which are hereby incorporated herein by reference in their entireties. The '057 and '703 applications disclose systems and methods for expanding gas isothermally in staged hydraulic/pneumatic cylinders and intensifiers over a large pressure range in order to generate electrical energy when required. Mechanical energy from the expanding gas is used to drive a hydraulic pump/motor subsystem that produces electricity.

Additionally, in various systems disclosed in the '057 and '703 applications, reciprocal motion is produced during recovery of energy from storage by expansion of gas in the cylinders. This reciprocal motion may be converted to electricity by a variety of means, for example as disclosed in U.S. Provisional Patent Application Nos. 61/257,583 (the '583 application), 61/287,938 (the '938 application), and 61/310,070 (the '070 application), the disclosures of which are hereby incorporated herein by reference in their entireties.

The ability of such systems to either store energy (i.e., use energy to compress gas into a storage reservoir) or produce energy (i.e., expand gas from a storage reservoir to release energy) will be apparent to any person reasonably familiar with the principles of electrical and pneumatic machines.

Various embodiments described in the '057 application involve several energy conversion stages: during compression, electrical energy is converted to rotary motion in an electric motor, then converted to hydraulic fluid flow in a hydraulic pump, then converted to linear motion of a piston in a hydraulic-pneumatic cylinder assembly, then converted to mechanical potential energy in the form of compressed gas.

Conversely, during retrieval of energy from storage by gas expansion, the potential energy of pressurized gas is converted to linear motion of a piston in a hydraulic-pneumatic cylinder assembly, then converted to hydraulic fluid flow through a hydraulic motor to produce rotary mechanical motion, then converted to electricity using a rotary electric generator.

Both these processes—storage and retrieval of energy—present opportunities for improvement of efficiency, reliability, and cost-effectiveness. One such opportunity is created by the fact that the pressure in any pressurized gas-storage reservoir tends to decrease as gas is released from it. Moreover, when discrete quantities or installments of gas are released into the pneumatic side of a pneumatic-hydraulic intensifier for the purpose of driving its piston, as described in the '057 application, the force acting on the piston declines as the installment of gas expands. The result, in a system where the hydraulic fluid pressurized by the intensifier is use to drive a hydraulic motor/pump, is variable hydraulic pressure driving the motor/pump. For a fixed-displacement hydraulic motor/pump whose shaft is affixed to that of an electric motor/generator, this will result in variable electrical power output from the system. This is disadvantageous because (a) it is desirable that the power output of an energy storage system be approximately constant (b) a hydraulic motor/pump or electric motor/generator runs most efficiently over a limited power range. Widely varying hydraulic pressure is therefore intrinsically undesirable. A variable-displacement hydraulic motor may be used to achieve constant power output despite varying hydraulic pressure over a certain range of pressures, yet the pressure range must still be limited to maximize efficiency.

Another opportunity is presented by the fact that pneumatic-hydraulic intensifier cylinders that may be utilized in systems described in the '057 and '703 applications may be custom-designed and built, and may therefore be difficult to service and maintain. Energy-storage systems utilizing more standard components that enable more efficient maintenance through, e.g., straightforward access to seals, would increase up-time and decrease total cost-of-ownership.

SUMMARY

Embodiments of the present invention enable the delivery of hydraulic flow to a motor/generator combination over a narrower pressure range in systems utilizing inexpensive, conventional components that are more easily maintained. Such embodiments may be incorporated in the above-referenced systems and methods described in the patent applications incorporated herein by reference above. For example, various embodiments of the invention relate to the incorporation into an energy storage system (such as those described in the '057 application) of distinct pneumatic and hydraulic free-piston cylinders, mechanically coupled to each other by some appropriate armature, rather than a single pneumatic-hydraulic intensifier.

At least three advantages accrue to such arrangements. First, components that transfer heat to and from the gas being expanded (or compressed) are naturally separated from the hydraulic circuit. Second, by mechanically coupling multiple pneumatic cylinders and/or multiple hydraulic cylinders so as to add (or share) forces produced by (or acting on) the cylinders, the hydraulic pressure range may be narrowed, allowing more efficient operation of the hydraulic motor/pump and the other benefits noted above. Third, maintenance on gland seals is easier on separated hydraulic and pneumatic cylinders than in a coaxial mated double-acting intensifier wherein the gland seal is located between two cylinders and is not easily accessible.

In compressed-gas energy storage systems in accordance with various embodiments of the invention, gas is stored at high pressure (e.g., approximately 3000 pounds per square inch (psi)). In one embodiment, this gas is expanded into a cylindrical chamber containing a piston or other mechanism that separates the gas on one side of the chamber from the other, preventing gas movement from one chamber to the other while allowing the transfer of force/pressure from one chamber to the next. A shaft attached to the piston is attached to a beam or other appropriate armature by which it communicates force to the shaft of a hydraulic cylinder, also divided into two chambers by a piston. The active area of the piston of the hydraulic cylinder is smaller than the area of the pneumatic piston, resulting in an intensification of pressure (i.e., ratio of pressure in the chamber undergoing compression in the hydraulic cylinder to the pressure in the chamber undergoing expansion in the pneumatic cylinder) proportional to the difference in piston areas.

The hydraulic fluid pressurized by the hydraulic cylinder may be used to turn a hydraulic motor/pump, either fixed-displacement or variable-displacement, whose shaft may be affixed to that of a rotary electric motor/generator in order to produce electricity.

In other embodiments, the expansion of the gas occurs in multiple stages, using low- and high-pressure pneumatic cylinders. For example, in the case of two pneumatic cylinders, high-pressure gas is expanded in a high pressure pneumatic cylinder from a maximum pressure (e.g., approximately 3000 pounds per square inch gauge) to some mid-pressure (e.g., approximately 300 psig); then this mid-pressure gas is further expanded (e.g., approximately 300 psig to approximately 30 psig) in a separate low-pressure cylinder. These two stages may be tied to a common shaft or armature that communicates force to the shaft of a hydraulic cylinder as for the single-pneumatic-cylinder instance described above.

When each of the two pneumatic pistons reaches the limit of its range of motion, valves or other mechanisms may be adjusted to direct higher-pressure gas to and vent lower-pressure gas from the cylinder's two chambers so as to produce piston motion in the opposite direction. In double-acting devices of this type, there is no withdrawal stroke or unpowered stroke: the stroke is powered in both directions.

The chambers of the hydraulic cylinder being driven by the pneumatic cylinders may be similarly adjusted by valves or other mechanisms to produce pressurized hydraulic fluid during the return stroke. Moreover, check valves or other mechanisms may be arranged so that regardless of which chamber of the hydraulic cylinder is producing pressurized fluid, a hydraulic motor/pump is driven in the same sense of rotation by that fluid. The rotating hydraulic motor/pump and electrical motor/generator in such a system do not reverse their direction of spin when piston motion reverses, so that with the addition of an short-term-energy-storage device such as a flywheel, the resulting system can be made generate electricity continuously (i.e., without interruption during piston reversal).

A decreased range of hydraulic pressures, with consequently increased motor/pump and motor/generator efficiencies, may be obtained by using multiple hydraulic cylinders. In various embodiments, two hydraulic cylinders are used. These two cylinders are connected to the aforementioned armature communicating force with the pneumatic cylinder(s). The chambers of the two hydraulic cylinders are attached to valves, lines, and other mechanisms in such a manner that either cylinder may, with appropriate adjustments, be set to present no resistance as its shaft is moved (i.e., compress no fluid).

Consider an exemplary system of the type described above, driven by a single pneumatic cylinder. Assume that a quantity of high-pressure gas has been introduced into one chamber of that cylinder. As the gas begins to expand, moving the piston, force is communicated by the piston shaft and the armature to the piston shafts of the two hydraulic cylinders. At any point in the expansion, the hydraulic pressure will be equal to the force divided by the acting hydraulic piston area. At the beginning of a stroke, the gas in the pneumatic cylinder has only begun to expand, it is producing maximum force; this force (ignoring frictional losses) acts on the combined total piston area of the hydraulic cylinders, producing a certain hydraulic output pressure, $HP_{max}$.

As the gas in the pneumatic cylinder continues to expand, it exerts decreasing force. Consequently, the pressure developed in the compression chamber of the active cylinders decreases. At a certain point in the process, the valves and other mechanisms attached to one of the hydraulic cylinders is adjusted so that fluid can flow freely between its two chambers and thus offers no resistance to the motion of the piston (ignoring frictional losses). The effective piston area driven by the force developed by the pneumatic cylinder thus decreases from the piston area of both hydraulic cylinders to the piston area of one of the hydraulic cylinders. With this decrease of area comes an increase in output hydraulic pressure for a given force. If this switching point is chosen carefully the hydraulic output pressure immediately after the switch returns to $HP_{max}$, (For the example of two identical hydraulic cylinders the switching pressure would be at the half pressure point.)

As the gas in the pneumatic cylinder continues to expand, the pressure developed by the hydraulic cylinder decreases.

As the pneumatic cylinder reaches the end of its stroke, the force developed is at a minimum and so is the hydraulic output pressure, $HP_{min}$.

For an appropriately chosen ratio of hydraulic cylinder piston areas, the hydraulic pressure range $HR=HP_{max}/HP_{min}$ achieved using two hydraulic cylinders will be the square root of the range HR achieved with a single pneumatic cylinder. The proof of this assertion is as follows.

Let a given output hydraulic pressure range $HR_1$ from high pressure $HP_{max}$ to low pressure $HP_{min}$, namely $HR_1=HP_{max}/HP_{min}$, be subdivided into two pressure ranges of equal magnitude $HR_2$. The first range is from $HP_{max}$ down to some intermediate pressure $HP_I$ and the second is from $HP_I$ down to $HP_{min}$. Thus, $HR_2=HP_{max}/HP_I=HP_I/HP_{min}$. From this identity of ratios, $HP_I=(HP_{max}/HP_{min})^{1/2}$. Substituting for $HP_I$ in $HR_2=HP_{max}/HP_I$, we obtain $HR_2=HP_{max}/(HP_{max}/HP_{min})^{1/2}=(HP_{max}/HP_{min})^{1/2}=HP_1^{1/2}$.

Since $HP_{max}$ is determined (for a given maximum force developed by the pneumatic cylinder) by the combined piston areas of the two hydraulic cylinders ($HA_1+HA_2$), whereas $HP_I$ is determined jointly by the choice of when (i.e., at what force level, as force declines) to deactivate the second cylinder and by the area of the single acting cylinder $HA_1$, it is clearly possible to choose the switching force point and $HA_1$ so as to produce the desired intermediate output pressure. It may be similarly shown that with appropriate cylinder sizing and choice of switching points, the addition of a third cylinder/stage will reduce the operating pressure range as the cube root, and so forth. In general, N appropriately sized cylinders can reduce an original operating pressure range $HR_1$ to $HR_1^{1/N}$.

By similar reasoning, dividing the air expansion into multiple stages facilitates further reduction in the hydraulic pressure range. For M appropriately sized pneumatic cylinders (i.e., pneumatic air stages) for a given expansion, the original pneumatic operating pressure range $PR_1$ of a single stroke can be reduced to $PR_1^{1/M}$. Since for a given hydraulic cylinder arrangement the output hydraulic pressure range is directly proportional to the pneumatic operating pressure range for each stroke, simultaneously combining M pneumatic cylinders with N hydraulic cylinders can realize a pressure range reduction to the 1/(N×M) power.

To achieve maximum efficiency it is desired that gas expansion be as near isothermal as possible. Gas undergoing expansion tends to cool, while gas undergoing compression tends to heat. Several modifications to the systems already described so as to approximate isothermal expansion can be employed. In one approach, also described in the '703 application, droplets of a liquid (e.g., water) are sprayed into the side of the double-acting pneumatic cylinder (or cylinders) presently undergoing compression to expedite heat transfer to/from the gas. Droplets may be used to either warm gas undergoing expansion or to cool gas undergoing compression. If the rate of heat exchange is sufficient, an isothermal process is approximated.

Additional heat transfer subsystems are described in the U.S. patent application Ser. No. 12/481,235 (the '235 application), the disclosure of which is hereby incorporated by reference herein in its entirety. The '235 application discloses that gas undergoing either compression or expansion may be directed, continuously or in installments, through a heat-exchange subsystem. The heat-exchange subsystem either rejects heat to the environment (to cool gas undergoing compression) or absorbs heat from the environment (to warm gas undergoing expansion). Again, if the rate of heat exchange is sufficient, an isothermal process is approximated.

Any implementation of this invention employing multiple pneumatic cylinders or multiple hydraulic cylinders such as that described in the above paragraphs may be co-implemented with either of the optional heat-transfer mechanisms described above.

Force Balancing

Various other embodiments of the present invention counteract, in a manner that minimizes friction and wear, forces that arise when two or more hydraulic and pneumatic cylinders in a compressed-gas energy storage and conversion system are attached to a common frame and the distal ends of their piston shafts are attached to a common beam, as described above.

When two or more free-piston cylinders, each oriented with their piston movement in the same direction, are attached to a common rigid, stationary frame and the distal ends of their pistons are attached to a common rigid, mobile beam, the forces acting along the piston shafts of the several cylinders will not, in general, be equal in magnitude. Additionally, the forces may result in deformation of the frame, beam, and other components. The resulting imbalance of forces and deformations during operation may apply side loads and/or rotational torques to parts of the system that may be damaged or degraded as a result. For example, piston rods may snap if subjected to excessive torque, and seals may be damaged or wear rapidly if subjected to uneven side displacement and loads. Moreover, side loads and torques may increase friction, diminishing system efficiency. It is, therefore, desirable to manage unbalanced forces and deformations in such a system so as to minimize friction and other losses and to reduce undesirable forces acting on vulnerable components (e.g., seals, piston rods).

For any given set of hydraulic and pneumatic cylinders, oriented and mounted as described above, with known operating pressures and linear speeds, one or more optimal arrangements may be determined that will minimize important peak or average operating values such as torques, deflections, and/or frictional losses. In general, close clustering of the cylinders tends to minimize deflections for a given beam thickness. As well, for identical cylinders operating over identical pressures and speeds, location of cylinders mirrored around the center axis typically will eliminate net torques and thus reduce frictions. In other instances, if the cylinders are mounted so that their central axes of motion all lie in a plane (e.g., cylinders are aligned in a single row), then unwanted forces tend to act almost exclusively in that single plane, restricting the dimensionality of the unwanted forces to two.

Further, when the moving beam reaches the end of its range of linear motion during either direction of motion of the cylinder pistons, an abrupt collision with the frame or some component communicating with the frame may occur before the piston reverses its direction of motion. The collision tends to dissipate kinetic energy, reducing system efficiency, and its suddenness, transmitted through the system as a shock, may accelerate wear to certain components (e.g., seals) or create excessive acoustic noise. Embodiments of the invention provide for managing these unwanted forces of collision as well as the unwanted torques and side loads already described.

Generally, embodiments that address these detrimental or unwanted forces include up to four different techniques or features. First, cylinders may be arranged to minimize important peak or average operating values such as torques, deflections, and/or frictional losses. Second, rollers (e.g., track rollers, linear guides, cam followers) may be mounted on the rigid, moving beam and roll vertically along grooves, tracks, or channels formed in the body of the frame. The rollers allow the beam to move with low friction and are positioned so that any torques applied to the beam by unbalanced piston forces are transmitted to the frame by the rollers, while keeping rotation and/or deformation of the beam within acceptable limits. This, in turn, reduces off-axis forces at the points where the pistons attach to the beam. Third, deflection of the rods and cylinders may be minimized by using a beam design (e.g., an I-beam section for a linear arrangement) that adequately resists deformation in the cylinder plane and reducing transmission to pistons of torque in the cylinder plane by attaching each piston to the beam using a revolute joint (pin joint). Fourth, stroke-reversal forces may be managed by springs (e.g., nitrogen springs) positioned so that at each stroke endpoint, the beam bounces non-dissipatively, rather than colliding with the frame or some component attached thereto.

Dead-Space Suppression

The systems described herein may also be improved via the elimination (or substantial reduction) of air dead space therein. Herein, the terms "air dead space" or "dead space" refer to any volume within the components of a pneumatic system—including but not restricted to lines, storage vessels, cylinders, and valves—that at some point in the operation of the system is filled with gas at a pressure significantly lower than other gas which is about to be introduced into that volume for the purpose of doing work. At other points in system operation, the same physical volume within a given device may not constitute dead space.

Air dead space tends to reduce the amount of work available from a quantity of high-pressure gas brought into communication therewith. This loss of potential energy may be termed a "coupling loss." For example, if gas is to be introduced into a cylinder through a valve for the purpose of performing work by pushing against a piston within the cylinder, and a chamber or volume exists adjacent the piston that is filled with low-pressure gas at the time the valve is opened, the high-pressure gas entering the chamber is immediately reduced in pressure during free expansion and mixing with the low-pressure gas and, therefore, performs less mechanical work upon the piston. The low-pressure volume in such an example constitutes air dead space. Dead space may also appear within that portion of a valve mechanism that communicates with the cylinder interior, or within a tube or line connecting a valve to the cylinder interior. Energy losses due to pneumatically communicating dead spaces tend to be additive.

Various systems and methods for reducing air dead space are described in U.S. Provisional Patent Application No. 61/322,115 (the '115 application), the disclosure of which is hereby incorporated by reference herein in its entirety. The '115 application discloses actively filling dead volumes (e.g., valve space, cylinder head space, and connecting hoses) with a mostly incompressible liquid, such as water, rather than with gas throughout an expansion and compression cycle of a compressed-air storage and recovery system.

Another approach to minimizing air dead volume is by designing components to minimize unused volume within valves, cylinders, pistons, and the like. One area for reduction of dead volume is in the connection of piping between cylinders. Embodiments of the present invention further reduce dead volume by locating paired air volumes together such that only a single manifold block resides between active air compartments. For example, in a two-stage gas compressor/expander, the high and low pressure cylinders are mounted back to back with a manifold block disposed in between.

All of the mechanisms described above for converting potential energy in compressed gas to electrical energy, including the heat-exchange mechanisms, can, if appropriately designed, be operated in reverse to store electrical energy as potential energy in compressed gas. Since the accuracy of this statement will be apparent to any person reasonably familiar with the principles of electrical machines, pneumatics, and the principles of thermodynamics, the operation of these mechanisms to store energy rather than to recover it from storage will not be described. Such operation is, however, explicitly encompassed within embodiments of this invention.

In one aspect, embodiments of the invention feature a system for energy storage and recover via expansion and compression of a gas, which includes first and second pneumatic cylinder assemblies. Each of the pneumatic cylinder assemblies includes or consists essentially of (i) a first compartment, (ii) a second compartment, (iii) a piston, slidably disposed within the cylinder assembly, separating the compartments, and (iv) a piston rod coupled to the piston and extending outside the first compartment. The piston rods of the pneumatic cylinder assemblies are mechanically coupled, and the pneumatic cylinder assemblies are coupled in series pneumatically, thereby reducing the force range produced during expansion or compression of a gas within the pneumatic cylinder assemblies. The pneumatic cylinder assemblies may be mechanically coupled in parallel such that, during a single stroke, their piston rods move in the same direction.

Embodiments of the invention may include one or more of the following, in any of a variety of combinations. The system may include a first hydraulic cylinder assembly and, fluidly coupled thereto such that a hydraulic fluid flows therebetween, a hydraulic motor/pump. The first hydraulic cylinder assembly may include or consist essentially of (i) a first compartment, (ii) a second compartment, (iii) a piston, slidably disposed within the cylinder assembly, separating the compartments, and (iv) a piston rod coupled to the piston, extending outside the first compartment, and mechanically coupled to the piston rods of the first and second pneumatic cylinder assemblies. The system may include a second hydraulic cylinder assembly fluidly coupled to the hydraulic motor/pump such that the hydraulic fluid flows therebetween. The second hydraulic cylinder assembly may include or consist essentially of (i) a first compartment, (ii) a second compartment, (iii) a piston, slidably disposed within the cylinder assembly, separating the compartments, and (iv) a piston rod coupled to the piston, extending outside the first compartment, and mechanically coupled to the piston rod of the first hydraulic cylinder assembly. The first and second hydraulic cylinder assemblies may be mechanically coupled in parallel such that, during a single stroke, their piston rods move in the same direction. The system may include a mechanism for selectively fluidly coupling the first and second compartments of the first hydraulic cylinder assembly, thereby reducing a pressure range of the hydraulic fluid flowing to the hydraulic motor/pump.

The system may include a second hydraulic cylinder assembly that includes or consists essentially of (i) a first compartment, (ii) a second compartment, and (iii) a piston, slidably disposed within the cylinder assembly, separating the compartments. The first hydraulic cylinder assembly may be telescopically disposed within the second hydraulic cylinder assembly and coupled to the piston of the second hydraulic cylinder assembly.

The system may include an armature coupled to the piston rods of the first and second pneumatic cylinder assemblies, thereby mechanically coupling the piston rods. The armature may include or consist essentially of a crankshaft assembly. A heat-transfer subsystem may be in fluid communication with at least one of the pneumatic cylinder assemblies. The heat-transfer subsystem may include a circulation apparatus for circulating a heat-transfer fluid through at least one compartment of at least one of the pneumatic cylinder assemblies. The heat-transfer subsystem may include a mechanism, e.g., a spray head and/or a spray rod, disposed within at least one compartment of at least one of the pneumatic cylinder assemblies for introducing the heat-transfer fluid. The heat-transfer subsystem may include a circulation apparatus and a heat exchanger, the circulation apparatus configured to circulate gas from at least one compartment of at least one of the pneumatic cylinder assemblies through the heat exchanger and back to the at least one compartment.

The system may include a manifold block on which the first and second pneumatic cylinder assemblies are mounted, and a connection between the first and second pneumatic cylinder assemblies may extend through the manifold block and have a length minimizing potential dead space between the first and second pneumatic cylinder assemblies. The first and second cylinder assemblies may be mounted on a first side of the manifold block. The first cylinder assembly may be mounted on a first side of the manifold block, and the second cylinder assembly may be mounted on a second side of the manifold block opposite the first side. During expansion or compression of gas, the piston of the first pneumatic cylinder assembly may move toward the manifold block and the piston of the second pneumatic cylinder assembly may move away from the manifold block.

The system may include (i) a frame assembly on which the first and second pneumatic cylinder assemblies are mounted, and (ii) a beam assembly, slidably coupled to the frame assembly, that mechanically couples the piston rods of the first and second pneumatic cylinder assemblies. The system may include a roller assembly disposed on the beam assembly for slidably coupling the beam assembly to the frame assembly, the roller assembly counteracting forces and torques transmitted between the first and second pneumatic cylinder assemblies and the beam assembly. The frame assembly may include a horizontal top support configured for mounting each pneumatic cylinder assembly thereto, and at least two vertical supports coupled to the horizontal top support, each of the vertical supports defining a channel for receiving a portion of the beam assembly. At least one additional cylinder assembly (e.g., a pneumatic cylinder assembly or a hydraulic cylinder assembly) may be mounted on the frame assembly. The first and second pneumatic cylinder assemblies and the at least one additional cylinder assembly may be aligned in a single row. Cylinder assemblies that each have substantially identical operating characteristics may be equally spaced about and disposed equidistant from a common central axis of the frame assembly.

In another aspect, embodiments of the invention feature a system for energy storage and recover via expansion and compression of a gas that includes a manifold block and first and second pneumatic cylinder assemblies mounted on the manifold block. Each of the pneumatic cylinder assemblies includes or consists essentially of (i) a first compartment, (ii) a second compartment, (iii) a piston, slidably disposed within the cylinder assembly, separating the compartments, and (iv) a piston rod coupled to the piston and extending outside the first compartment. A first platen is coupled to the piston rod of the first pneumatic cylinder assembly, and a second platen is coupled to the piston rod of the second pneumatic cylinder assembly. The second compartments of the pneumatic cylinder assemblies are selectively fluidly coupled via a connection disposed in the manifold block. During expansion or compression of a gas within the pneumatic cylinder assemblies, the first and second platens move reciprocally.

Embodiments of the invention may include one or more of the following, in any of a variety of combinations. The connection may have a length minimizing potential dead space between the first and second pneumatic cylinder assemblies. The first and second pneumatic cylinder assemblies may be mounted to a second manifold block, and the piston rods of the first and second pneumatic cylinder assemblies may extend through the second manifold block. The first compartments of the pneumatic cylinder assemblies may be selectively fluidly coupled via a second connection disposed in the second manifold block. The second connection may have a length minimizing potential dead space between the first and second pneumatic cylinder assemblies.

In a further aspect, embodiments of the invention feature a method for energy storage and recovery. Gas is expanded and/or compressed within a plurality of pneumatic cylinder assemblies that are coupled in series pneumatically, thereby reducing the range of force produced by or acting on the pneumatic cylinder assemblies during expansion or compression of the gas. The force may be transmitted between the pneumatic cylinder assemblies and at least one hydraulic cylinder assembly (e.g., a plurality of hydraulic cylinder assemblies) fluidly connected to a hydraulic motor/pump. One of the hydraulic cylinder assemblies may be disabled to decrease the range of hydraulic pressure produced by or acting on the hydraulic cylinder assemblies. The force may be transmitted between the pneumatic cylinder assemblies and a crankshaft coupled to a rotary motor/generator. The gas may be maintained at a substantially constant temperature during the expansion or compression.

These and other objects, along with advantages and features of the invention, will become more apparent through reference to the following description, the accompanying drawings, and the claims. Furthermore, it is to be understood that the features of the various embodiments described herein are not mutually exclusive and can exist in various combinations and permutations. As used herein, the term "substantially" means±10%, and, in some embodiments, ±5%. The term "consists essentially of" means excluding other materials that contribute to function, unless otherwise defined herein. Herein, the terms "liquid" and "water" refer to any substantially incompressible liquid, and the terms "gas" and "air" are used interchangeably.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1:
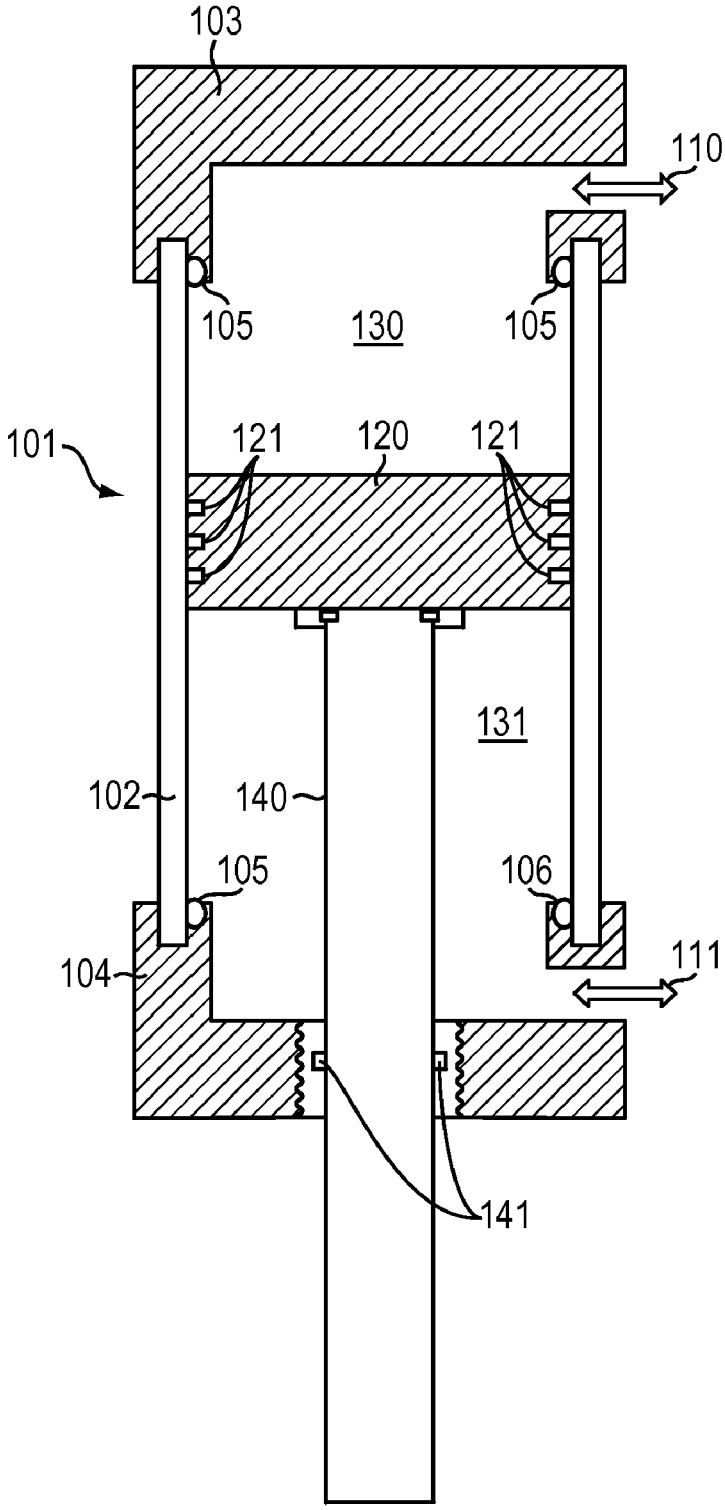
FIG. 1 PRIOR ART
FIG. 1 is a schematic diagram of the major components of a standard pneumatic or hydraulic cylinder.

FIG. 1 is a schematic of the major components of a standard pneumatic or hydraulic cylinder. This cylinder may be tie-rod based and may be double-acting. The cylinder 101 as shown in FIG. 1 consists of a honed tube 102 with two end caps 103, 104; the end caps are held against to the cylinder by means such as tie rods, threads, or other mechanical means and are capable of withstanding high internal pressure (e.g., approximately 3000 psi) without leakage via seals 105, 106. The end caps 103, 104 typically have one or more input/output ports as indicated by double arrows 110 and 111. The cylinder 101 is shown with a moveable piston 120 with appropriate seals 121 to separate the two working chambers 130 and 131. Shown attached to the moveable piston 120 is a piston rod 140 that passes through one end cap 104 with an appropriate rod seal 141. This diagram is shown as reference for the inventions shown in FIGS. 3-6.

Figure 2:
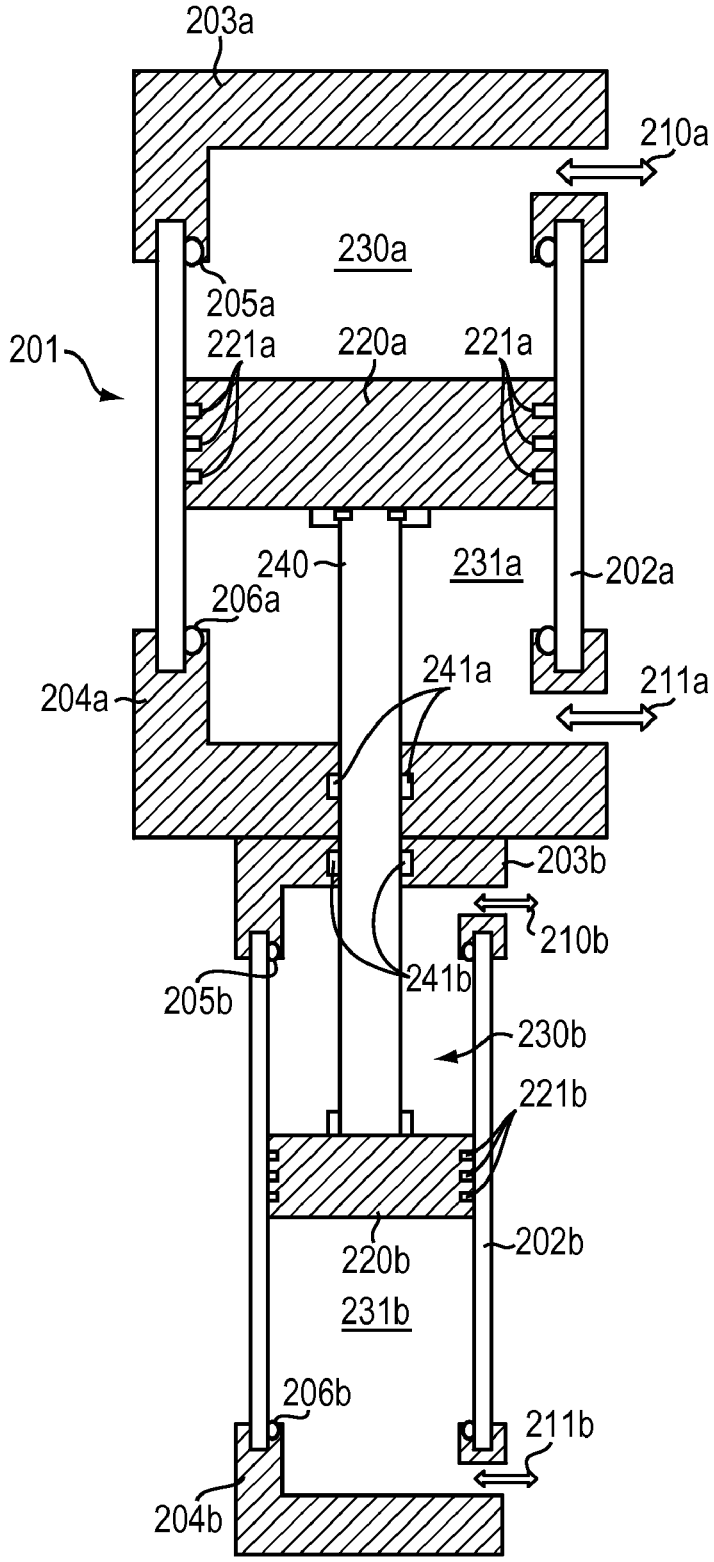
FIG. 2 PRIOR ART
FIG. 2 is a schematic diagram of the major components of a standard pneumatic or hydraulic intensifier/pressure booster.

FIG. 2 is a schematic of the major components of a standard pneumatic or hydraulic intensifier or pressure booster. This intensifier may also be tie-rod based and double-acting. The intensifier 201 as shown in FIG. 2 consists of two honed tubes 202*a* and 202*b* (typically of different diameters to allow for pressure multiplication) with end caps 203*a*, 203*b* and 204*a*, 204*b* coupled to each honed tube 202*a*, 202*b*, as shown. The end caps are held against the cylinder by means such as tie rods, threads, or other mechanical means and are capable of withstanding high internal pressure (e.g., approximately 3000 psi for the smaller bore cylinder and approximately 250 psi for the larger bore cylinder) without leakage via seals 205*a*, 205*b* and 206*a*, 206*b*. In one example, end cap 203*b* may be removed and an additional seal added to end cap 204*a*. The end caps 203*a*, 203*b*, 204*a*, 204*b* typically have one or more input/output ports as indicated by double arrows 210*a*, 210*b* and 211*a*, 211*b*. The intensifier 201 is shown with two moveable pistons 220*a*, 220*b* with appropriate seals 221*a*, 221*b* to separate the four working chambers 230*a*, 230*b* and 231*a*, 231*b*. Shown attached to the moveable pistons 220*a*, 220*b* is a piston rod 240 that passes through end caps 203*b* and 204*a* with appropriate rod seals 141*a*, 141*b*. This diagram is shown as reference for the inventions shown in FIGS. 3-6.

Figure 3:
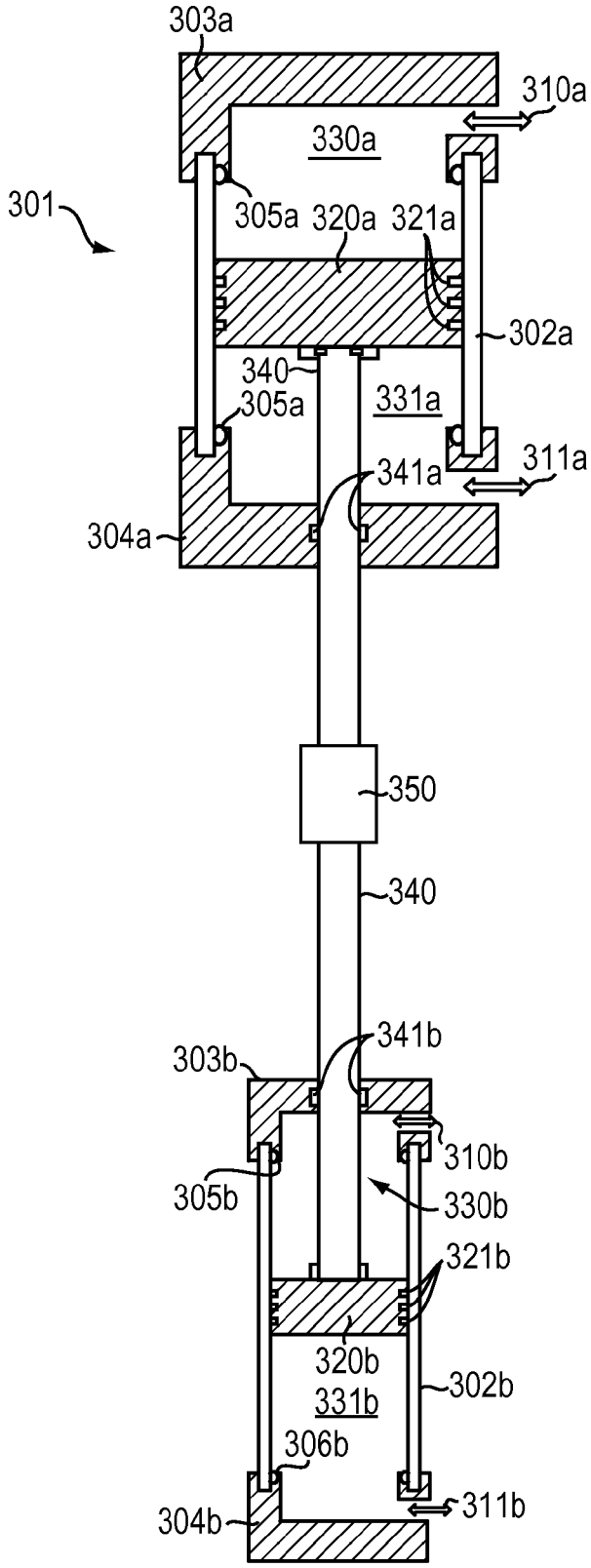
FIGS. 3 and 4 are schematic diagrams of the major components of pneumatic or hydraulic intensifiers that allow easy access to rod seals for maintenance, in accordance with various embodiments of the invention.

FIG. 3 is a schematic diagram of a pneumatic or hydraulic intensifier in accordance with various embodiments of the invention. The depicted embodiment allows easy access to the rod seals 341*a*, 341*b* for maintenance. The intensifier 301 shown in FIG. 3 includes two honed tubes 302*a* and 302*b* (typically of different diameters to allow for pressure multiplication) with end caps 303*a*, 303*b* and 304*a*, 304*b* attached to each honed tube 302*a*, 302*b*, as shown. The end caps are held to the cylinder by known mechanical means, such as tie rods, and are capable of withstanding high internal pressure (e.g., approximately 3000 psi for the smaller bore cylinder and approximately 250 psi for the larger bore cylinder) without leakage via the seals 305*a*, 305*b* and 306*a*, 306*b*. The end caps 303*a*, 303*b*, 304*a*, 304*b* typically have one or more input/output ports as indicated by double arrows 310*a*, 310*b* and 311*a*, 311*b*. The intensifier 301 is shown with two moveable pistons 320*a*, 320*b* with appropriate seals 321*a*, 321*b* to separate the four working chambers 330*a*, 330*b* and 331*a*, 331*b*. Shown attached to the moveable pistons 320*a*, 320*b* is a piston rod 340 that passes through each end cap 304*a*, 303*b* with appropriate rod seals 341*a*, 341*b*. The piston rod 340 is shown as longer in length than a single honed tube and its associated end caps such that the rod seals on the middle end caps 303*b*, 304*a* are easily accessible for maintenance. (Alternatively, the piston rod 340 may be two separate rods attached to a common block 350, such that the piston rods move together.) Additionally, the fluid in compartments 330*a*, 331*a* is completely separate from the fluid in compartments 330*b* and 331*b*, such that they do not mix and have no chance of contamination (e.g., air in compartments 330*a*, 331*a* would never be contaminated with oil in compartments 330*b*, 331*b*, alleviating any worries of explosion from oil contamination that might occur in standard intensifier 201 when driven hydraulic fluid is used to rapidly pressurize air).

Figure 4:
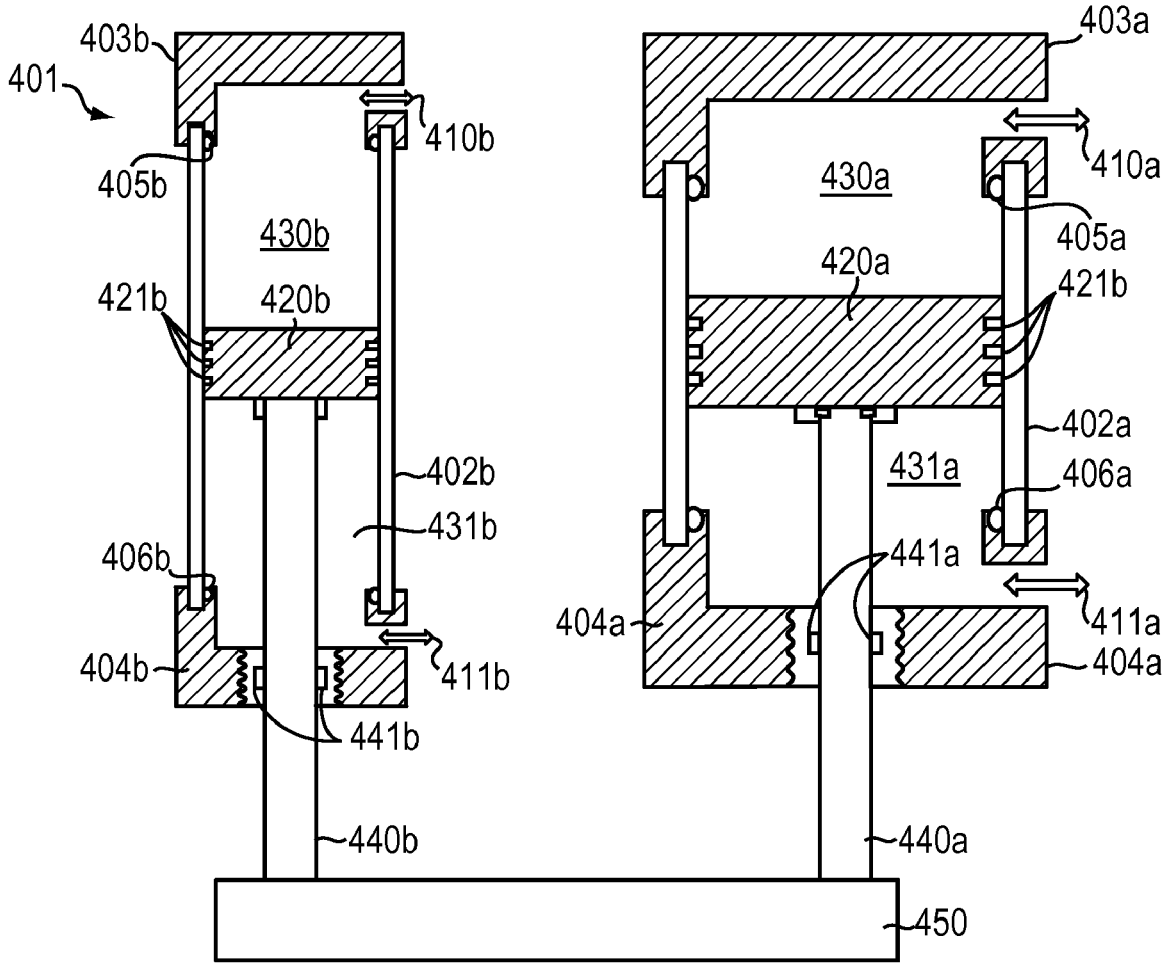

FIG. 4 is a schematic diagram of the major components of another pneumatic or hydraulic intensifier in accordance with various embodiments of the invention, which also allows easy access to the rod seals for maintenance. The intensifier 401 shown in FIG. 4 includes two honed tubes 402*a* and 402*b* (typically of different diameters to allow for pressure multiplication) with end caps 403*a*, 403*b* and 404*a*, 404*b* attached to each honed tube 402*a*, 402*b*, as shown. The end caps are held to the cylinder by mechanical means, such as tie rods, and are capable of withstanding high internal pressure (e.g., approximately 3000 psi for the smaller bore cylinder and approximately 250 psi for the larger bore cylinder) without leakage via the seals 405*a*, 405*b* and 406*a*, 406*b*. The end caps 403*a*, 403*b*, 404*a*, 404*b* typically have one or more input/output ports as indicated by double arrows 410*a*, 410*b* and 411*a*, 411*b*. The intensifier 401 is shown with two moveable pistons 420*a*, 420*b* with appropriate seals 421*a*, 421*b* to separate the four working chambers 430*a*, 430*b* and 431*a*, 431*b*. Shown attached to each of the moveable pistons 420*a*, 420*b* is a piston rod 440*a*, 440*b* that passes through each end cap 403*b*, 404*b* respectively with appropriate rod seals 441*a*, 441*b*. The piston rods 440*a*, 440*b* are attached to a common block 450, such that the piston rods and pistons move together. This arrangement makes the rod seals on the end caps 403*b*, 404*b* easily accessible for maintenance. Additionally, the fluid in compartments 430*a*, 431*a* is completely separate from the fluid in compartments 430*b*, 431*b*, such that they do not mix and have no chance of contamination (e.g., air in compartments 430*a*, 431*a* would never be contaminated with oil in compartments 430*b*, 431*b*, alleviating any worries of explosion from oil contamination that might occur in a standard intensifier 201 when driven hydraulic fluid is used to rapidly pressurize air).

Figure 5:
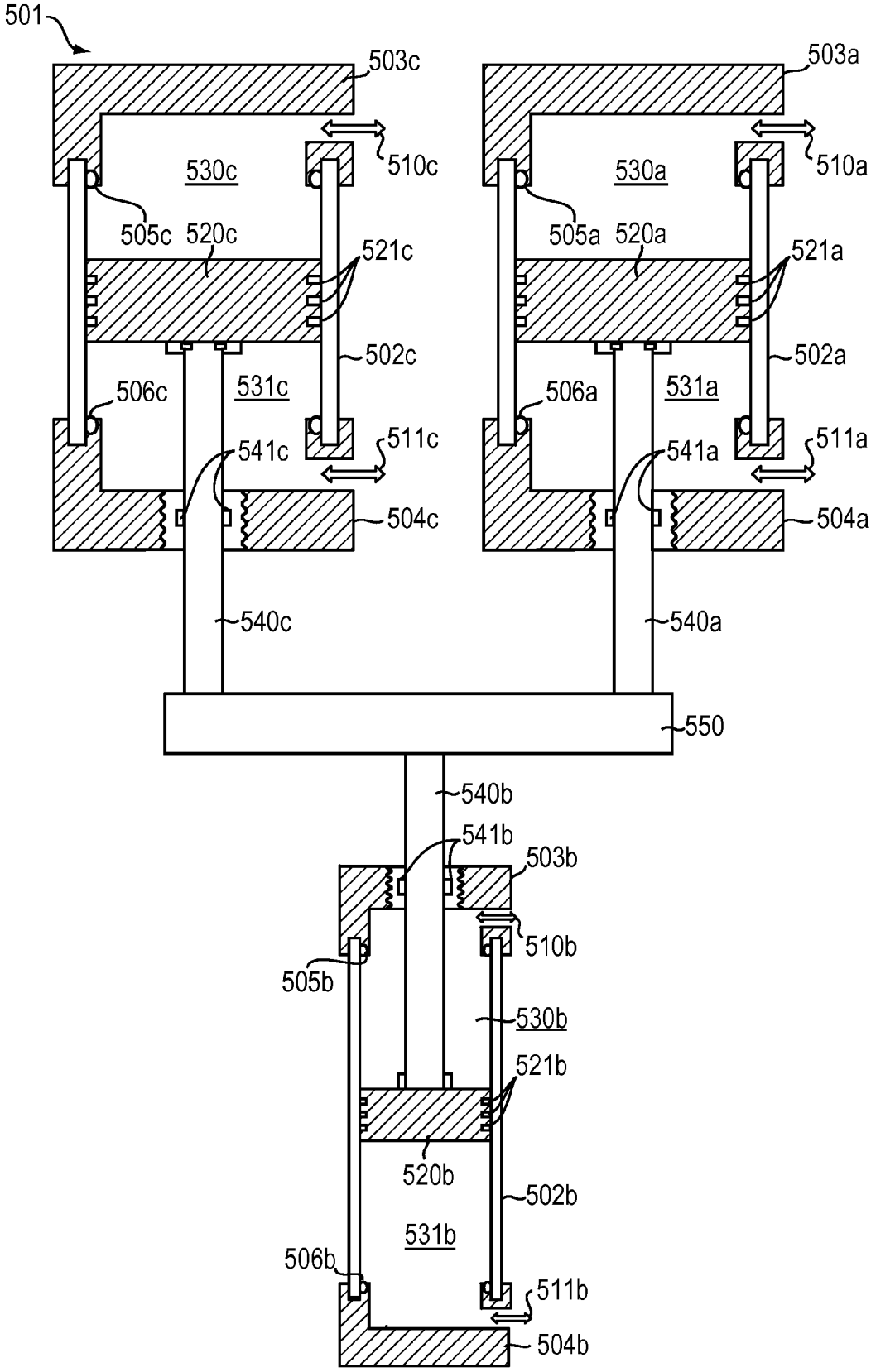
FIGS. 5 and 6 are schematic diagrams of the major components of pneumatic or hydraulic intensifiers in accordance with various other embodiments of the invention, which allow easy access to rod seals for maintenance and allow for the ganging of multiple cylinders to achieve high intensification with multiple narrower cylinders in lieu of a single large diameter cylinder.

FIG. 5 is a schematic diagram of the major components of yet another pneumatic or hydraulic intensifier in accordance with various embodiments of the invention, which allows easy access to rod seals for maintenance and allows for the ganging of multiple cylinders to achieve high intensification with multiple narrower cylinders in lieu of a single large diameter cylinder. The intensifier 501 shown in FIG. 5 includes multiple honed tubes 502*a*, 502*b*, 502*c* with end caps 503*a*, 503*b*, 503*c* and 504*a*, 540*b*, 540*c* attached to each honed tube 502*a*, 502*b*, 502*c*. The end caps are held to the cylinder by mechanical means, such as tie rods, and are capable of withstanding high internal pressure (e.g., approximately 3000 psi for the smaller bore cylinder and approximately 250 psi for the larger bore cylinders) without leakage via the seals 505*a*, 505*b*, 505*c* and 506*a*, 506*b*, 506*c*. In this example, three cylinders are shown; however, any number of cylinders may be utilized in accordance with embodiments of the present invention. The illustrated example depicts two larger bore honed tubes 502*a*, 502*c* paired with a smaller bore honed tube 502*b*, which may be used as an intensifier with twice the pressure multiplication (i.e., intensification) ratio of a single honed tube of the diameter of 502*a* paired with a the single honed tube of the diameter of 502*b*. Likewise, if four such cylinders are paired with a single cylinder, the intensification ratio again doubles. Additionally, different pressures may be present in each of the larger bore cylinders such that, through addition of forces, pressure adding and multiplication are achieved. The end caps 503*a*, 503*b*, 503*c*, 504*a*, 504*b*, 504*c* typically have one or more input/output ports as indicated by double arrows 510*a*-*c* and 511*a*-*c*. The intensifier 501 is shown with multiple moveable pistons 520*a*, 520*b*, 520*c* with appropriate seals 521*a*, 521*b*, 521*c* to separate the six working chambers 530*a*, 530*b*, 530*c* and 531*a*, 531*b*, 531*c*. Shown attached to each of the moveable pistons 520*a*, 520*b*, 520*c* is a piston rod 540*a*, 540*b*, 540*c* that passes through a respective end cap 504*a*, 504*c*, 503*b* with appropriate rod seals 541*a*, 541*b*, 541*c*. The piston rods 540*a*, 540*b*, 540*c* are attached to a common block 550 such that the piston rods and pistons move together. The piston rods 540*a*, 540*b*, 540*c* are shown as longer in length than the single honed tube and its associated end caps such that the rod 540 may extend fully and the rod seals 541 on the middle end caps 504*a*, 504, 503*b* are easily accessible for maintenance. Additionally, the fluid in compartments 530*a*, 531*a* is completely separate from the fluid in compartments 530*b*, 531*b* and also completely separate from the fluid in compartments 530*c* and 531*c*, such that they do not mix and have no chance of contamination (e.g., air in compartments 530*a*, 531*a*, 530*c*, and 531*c* would never be contaminated with oil in compartments 530*b* and 531*b*, alleviating any worries of explosion from oil contamination that might occur in a standard intensifier 201 when driven hydraulic fluid is used to rapidly pressurize air).

Figure 6:
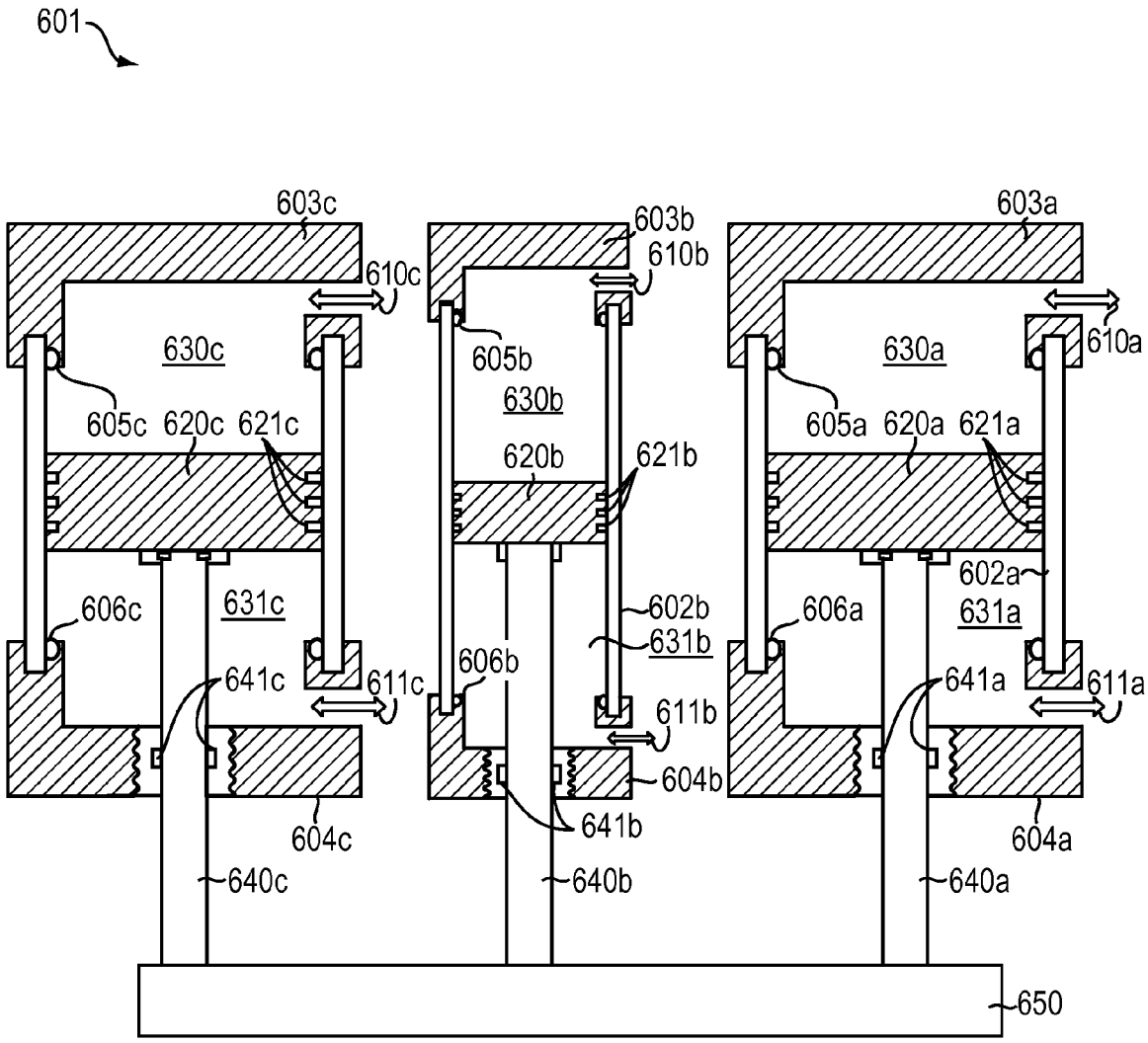

FIG. 6 is a schematic diagram of the major components of another pneumatic or hydraulic intensifier in accordance with various embodiments of the invention, which also allows easy access to rod seals for maintenance and allows for the ganging of multiple cylinders to achieve high intensification with multiple narrower cylinders in lieu of a single large diameter cylinder. The intensifier 601 of FIG. 6 also features shorter full-extension dimensions than the intensifier 501 shown in FIG. 5. The intensifier 601 shown in FIG. 6 includes multiple honed tubes 602*a*, 602*b*, 602*c* with end caps 603*a*, 603*b*, 603*c* and 604*a*, 604*b*, 604*c* attached to each honed tube 602*a*, 602*b*, 602*c*, as shown. The end caps are held to the cylinder by mechanical means, such as tie rods, and are capable of withstanding high internal pressure (e.g., approximately 3000 psi for the smaller bore cylinder and approximately 250 psi for the larger bore cylinders) without leakage via the seals 605*a*, 605*b*, 605*c* and 606*a*, 606*b*, 606*c*. In the illustrated example, three cylinders are shown; however, any number of cylinders may be utilized in accordance with embodiments of the present invention. As shown in this example, two larger bore honed tubes 602*a*, 602*c* are paired with a smaller bore honed tube 602*b*, which may be used as an intensifier with twice the pressure multiplication (i.e., intensification) ratio of a single honed tube of the diameter of 602*a* paired with the honed tube of the diameter 602*b*. Likewise, if four such cylinders are paired with a single cylinder, the intensification ratio again doubles. Additionally, different pressures may be present in each of the larger bore cylinders, such that through addition of forces, pressure adding and multiplication may be achieved. The end caps 603*a*, 603*b*, 603*c*, 604*a*, 604*b*, 604*c* typically have one or more input/output ports as indicated by double arrows 610*a*, 610*b*, 610*c* and 611*a*, 611*b*, 611*c*. The intensifier 601 is shown with multiple moveable pistons 620*a*, 620*b*, 620*c* with appropriate seals 621*a*, 621*b*, 621*c* to separate the six working chambers 630*a*, 630*b*, 630*c* and 631*a*, 631*b*, 631*c*. Shown attached to each of the moveable pistons 620*a*, 620*b*, 620*c* is a piston rod 640*a*, 640*b*, 640*c* that passes through a respective end cap 604*a*, 604*b*, 604*c* with appropriate rod seals 641*a*, 641*b*, 641*c*. The piston rods 640*a*, 640*b* are attached to a common block 650 such that the piston rods and pistons move together. The piston rods 640*a*, 640*b*, 640*c* are shown as longer in length than a single honed tube and associated end caps, such that the rod 640 may extend fully and the rod seals 641 on the end caps 604*a*, 604*b*, 604*c* are easily accessible for maintenance. Additionally, the fluid in compartments 630*a*, 631*a* is completely separate from the fluid in compartments 630*b*, 631*b* and also completely separate from the fluid in compartments 630*c*, 631*c*, such that they do not mix and have no chance of contamination (e.g., air in compartments 630*a*, 631*a*, 630*c*, and 631*c* would never be contaminated with oil in compartments 630*b* and 631*b*, alleviating any worries of explosion from oil contamination that might occur in a standard intensifier 201 when driven hydraulic fluid is used to rapidly pressurize air).

Figure 7:
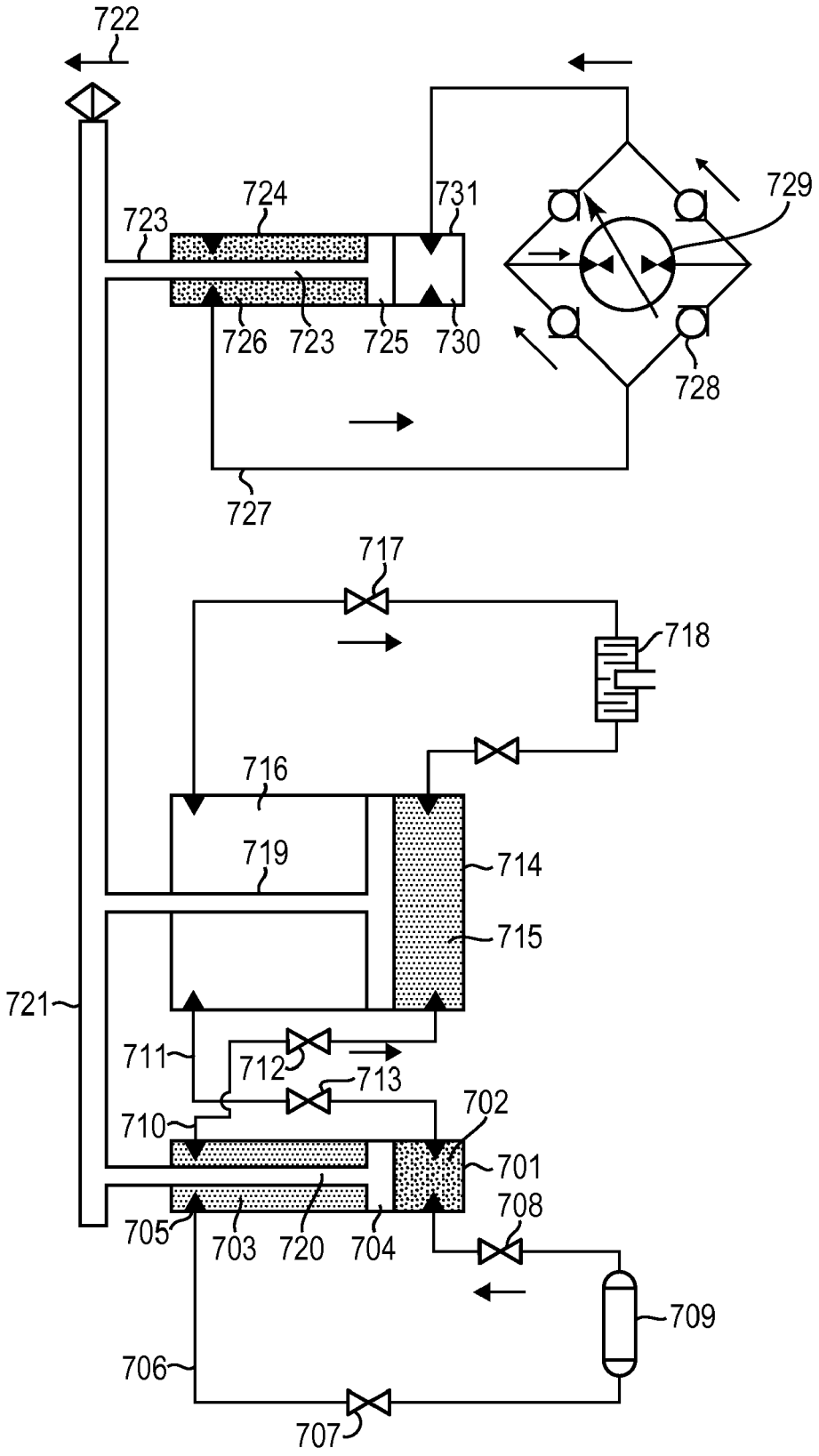
FIG. 7 is a schematic cross-sectional diagram of a system that utilizes pressurized stored gas to operate two series-connected, double-acting pneumatic cylinders coupled to a single double-acting hydraulic cylinder to drive a hydraulic motor/generator to produce electricity, in accordance with various embodiments of the invention.

The above-described cylinder embodiments may be utilized in a variety of energy-storage and recovery systems, as disclosed herein. FIG. 7 is a schematic cross-sectional diagram of a method for using pressurized stored gas to operate double-acting pneumatic cylinders and a double-acting hydraulic cylinder to generate electricity according to various embodiments of the invention. If the motor/generator is operated as a motor rather than as a generator, the identical mechanism can employ electricity to produce pressurized stored gas. FIG. 7 shows the mechanism being operated to produce electricity from stored pressurized gas.

As shown, the system includes a pneumatic cylinder 701 divided into two compartments 702 and 703 by a piston 704. The cylinder 701, which is shown in a horizontal orientation in this illustrative embodiment but may be arbitrarily oriented, has one or more gas circulation ports 705 which are connected via piping 706 and valves 707 and 708 to a compressed-gas reservoir 709. The pneumatic cylinder 701 is connected via piping 710, 711 and valves 712, 713 to a second pneumatic cylinder 714 operating at a lower pressure than the first. Both cylinders 701, 714 are typically double-acting, and, as shown, are attached in series (pneumatically) and in parallel (mechanically). (Series attachment of the two cylinders means that gas from the lower-pressure compartment of the high-pressure cylinder is directed to the higher-pressure compartment of the low-pressure cylinder.)

Pressurized gas from the reservoir 709 drives the piston 704 of the double-acting high-pressure cylinder 701. Intermediate-pressure gas from the lower-pressure side 703 of the high-pressure cylinder 701 is conveyed through valve 712 to the higher-pressure chamber 715 of the lower-pressure cylinder 714. Gas is conveyed from the lower-pressure chamber 716 of the lower-pressure cylinder 714 through a valve 717 to a vent 718.

One primary function of this arrangement is to reduce the range of pressures over which the cylinders jointly operate. Note that as used herein the terms "pipe," "piping" and the like shall refer to one or more conduits that are rated to carry gas or liquid between two points. Thus the singular term should be taken to include a plurality of parallel conduits where appropriate.

The piston shafts 719, 720 of the two cylinders act jointly to move a bar or armature 721 in the direction indicated by the arrow 722. The armature 721 is also connected to the piston shaft 723 of a hydraulic cylinder 724. The piston 725 of the hydraulic cylinder 724, impelled by the armature 721, compresses hydraulic fluid in the chamber 726. This pressurized hydraulic fluid is conveyed through piping 727 to an arrangement of check valves 728 that allow the fluid to flow in one direction (shown by arrows) through a hydraulic motor/pump, either fixed-displacement or variable-displacement, whose shaft drives an electric motor/generator. For convenience, the combination of hydraulic pump/motor and electric motor/generator is here shown as a single hydraulic power unit 729.

Hydraulic fluid at lessened pressure is conducted from the output of the hydraulic motor/pump to the lower-pressure chamber 730 of the hydraulic cylinder through a hydraulic circulation port 731.

Figure 8:
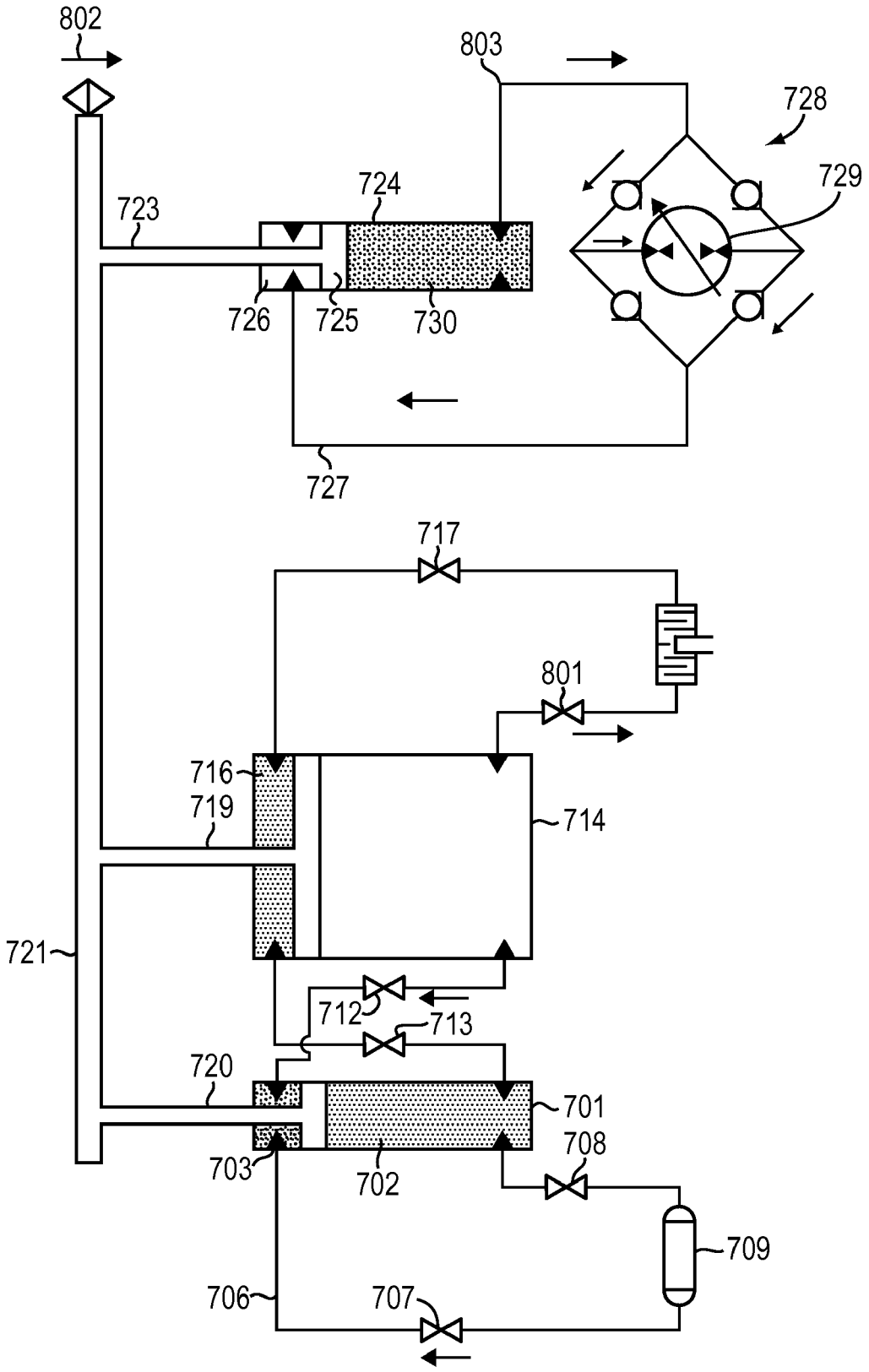
FIG. 8 depicts the mechanism of FIG. 7 in a different phase of operation (i.e., with the high- and low-pressure sides of the pneumatic pistons reversed and the direction of shaft motion reversed)

Reference is now made to FIG. 8, which shows the illustrative embodiment of FIG. 7 in a second operating state, where valves 707, 713, and 801 are open and valves 708, 712, and 717 are closed. In this state, gas flows from the high-pressure reservoir 709 through valve 707 into compartment 703 of the high-pressure pneumatic cylinder 701. Lower-pressure gas is vented from the other compartment 702 via valve 713 to chamber 716 of the lower-pressure pneumatic cylinder 714.

The piston shafts 719, 720 of the two cylinders act jointly to move the armature 721 in the direction indicated by arrow 802. The armature 721 is also connected to the piston shaft 723 of a hydraulic cylinder 724. The piston 725 of the hydraulic cylinder 724, impelled by the armature 721, compresses hydraulic fluid in the chamber 730. This pressurized hydraulic fluid is conveyed through piping 803 to the aforementioned arrangement of check values 728 and hydraulic power unit 729. Hydraulic fluid at lessened pressure is conducted from the output of the hydraulic motor/pump to the lower-pressure chamber 726 of the hydraulic cylinder.

As shown, the stroke volumes of the two chambers of the hydraulic cylinder differ by the volume of the shaft 723. The resulting imbalance in fluid volumes expelled from the cylinder during the two stroke directions shown in FIGS. 7 and 8 may be corrected either by a pump (not shown) or by extending the shaft 723 through the whole length of both chambers of the cylinder 724 so that the two stroke volumes are equal.

Figure 9:
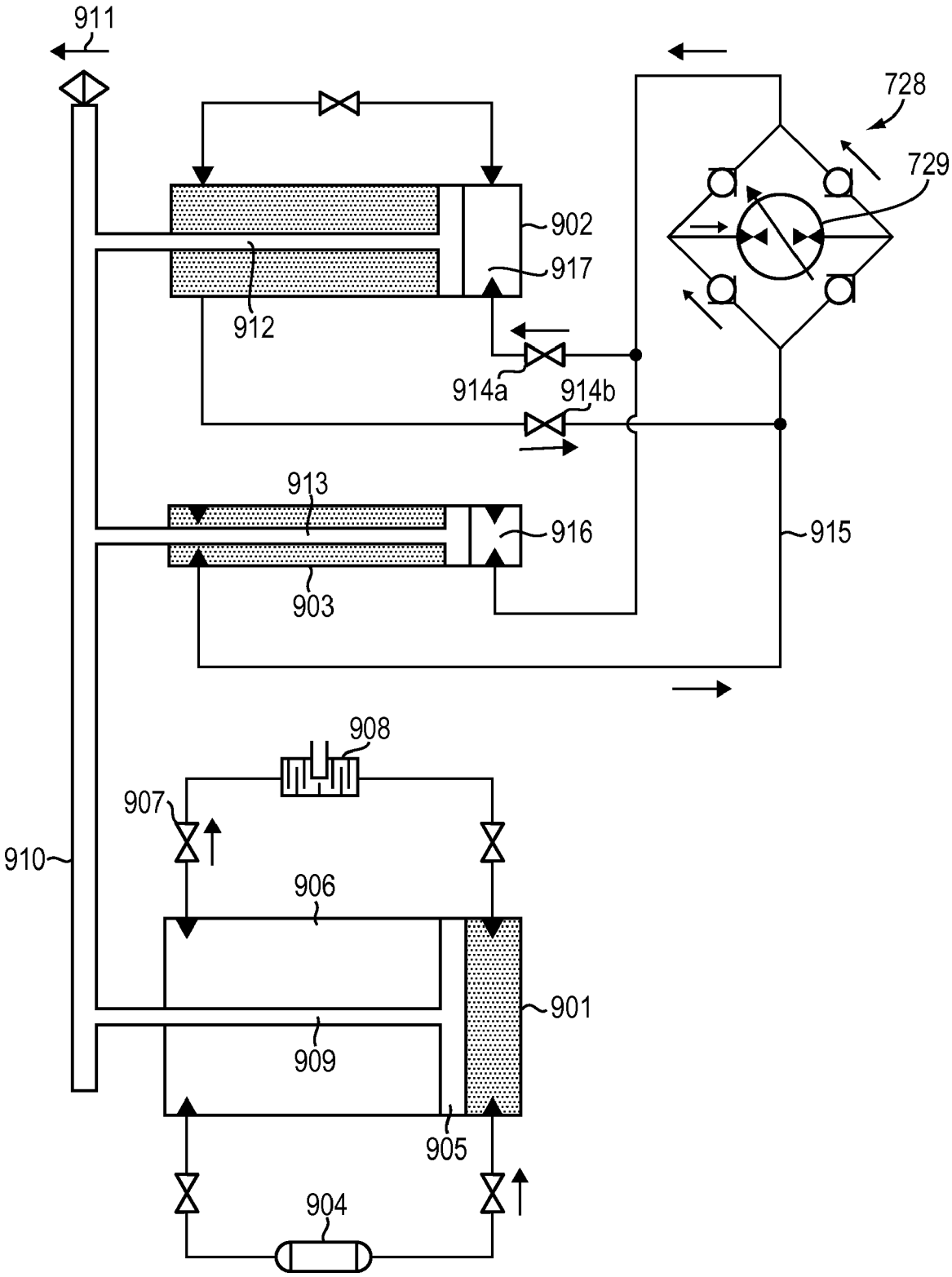
FIG. 9 depicts the mechanism of FIG. 7 modified to have a single pneumatic cylinder and two hydraulic cylinders, and in a phase of operation where both hydraulic pistons are compressing hydraulic fluid (thus decreasing the range of hydraulic pressures delivered to the hydraulic motor as the force produced by the pressurized gas in the pneumatic cylinder decreases with expansion, and as the pressure of the gas stored in the reservoir decreases), in accordance with various embodiments of the invention.

Reference is now made to FIG. 9, which shows an illustrative embodiment of the invention in which a single double-acting pneumatic cylinder 901 and two double-acting hydraulic cylinders 902 and 903, shown here with one of larger bore than the other, are employed. In the state of operation shown, pressurized gas from the reservoir 904 drives the piston 905 of the cylinder 901. Low-pressure gas from the other side 906 of the pneumatic cylinder 901 is conveyed through a valve 907 to a vent 908.

The pneumatic cylinder shaft 909 moves a bar or armature 910 in the direction indicated by the arrow 911. The armature 910 is also connected to the piston shafts 912, 913 of the double-acting hydraulic cylinders 902, 903.

In the state of operation shown in FIG. 9, valves 914*a* and 914*b* permit fluid to flow to hydraulic power unit 729. Pressurized fluid from both of cylinders 902 and 903 is conducted via piping 915 to the aforementioned arrangement of check values 728 and hydraulic pump/motor 729 connected to a motor/generator (not shown), producing electricity. Hydraulic fluid at lessened pressure is conducted from the output of the hydraulic pump/motor 729 to the lower-pressure chambers 916 and 917 of the hydraulic cylinders 902, 903.

The fluid in the high-pressure chambers of the two hydraulic cylinders 902, 903 is at a single pressure, and the fluid in the low-pressure chambers 916, 917 is also at a single pressure. In effect, the two cylinders 902, 903 act as a single cylinder whose piston area is the sum of the piston areas of the two cylinders and whose operating pressure, for a given driving force from the pneumatic piston 901, is proportionately lower than that of either cylinder 902 or cylinder 903 acting alone.

Figure 10:
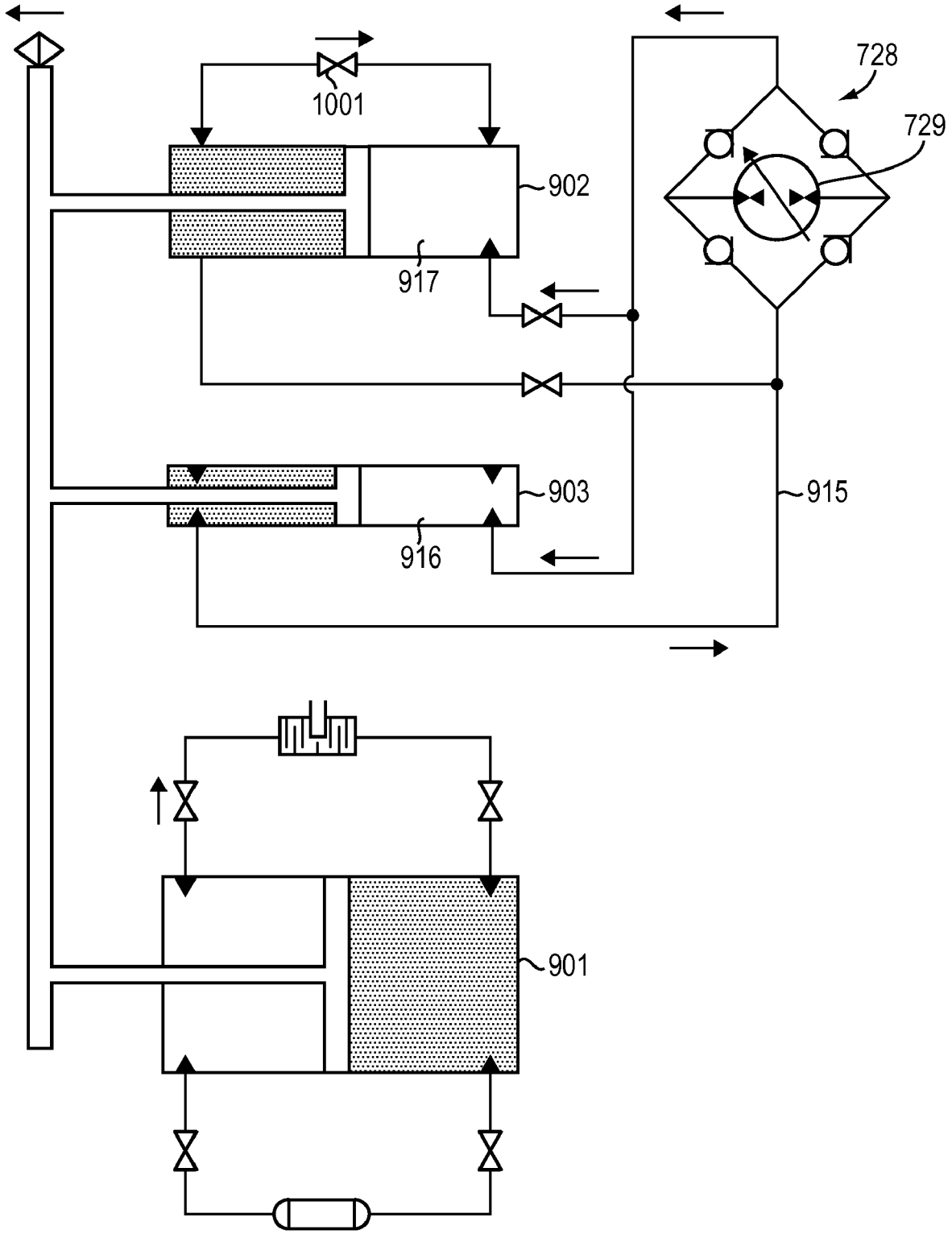
FIG. 10 depicts the illustrative embodiment of FIG. 9 in a different phase of operation (i.e., same direction of motion as in FIG. 9, but with only one of the hydraulic cylinders compressing hydraulic fluid)

Reference is now made to FIG. 10, which shows another state of operation of the illustrative embodiment of the invention shown in FIG. 9. The action of the pneumatic cylinder and the direction of motion of all pistons is the same as in FIG. 9. In the state of operation shown, formerly closed valve 1001 is opened to permit fluid to flow freely between the two chambers of the wider hydraulic cylinder 902. It therefore presents minimal resistance to the motion of its piston. Pressurized fluid from the narrower cylinder 903 is conducted via piping 915 to the aforementioned arrangement of check values 728 and hydraulic power unit 729, producing electricity. Hydraulic fluid at lessened pressure is conducted from the output of the hydraulic pump/motor 729 to the lower-pressure chamber 916 of the narrower hydraulic cylinder 903.

In effect, the acting hydraulic cylinder 902 has a smaller piston area providing a higher hydraulic pressure for a given force, than the state shown in FIG. 9, where both cylinders were acting with a larger effective piston area. Through valve actuations disabling one of the hydraulic cylinders a narrowed hydraulic fluid pressure range is obtained.

Figure 11:
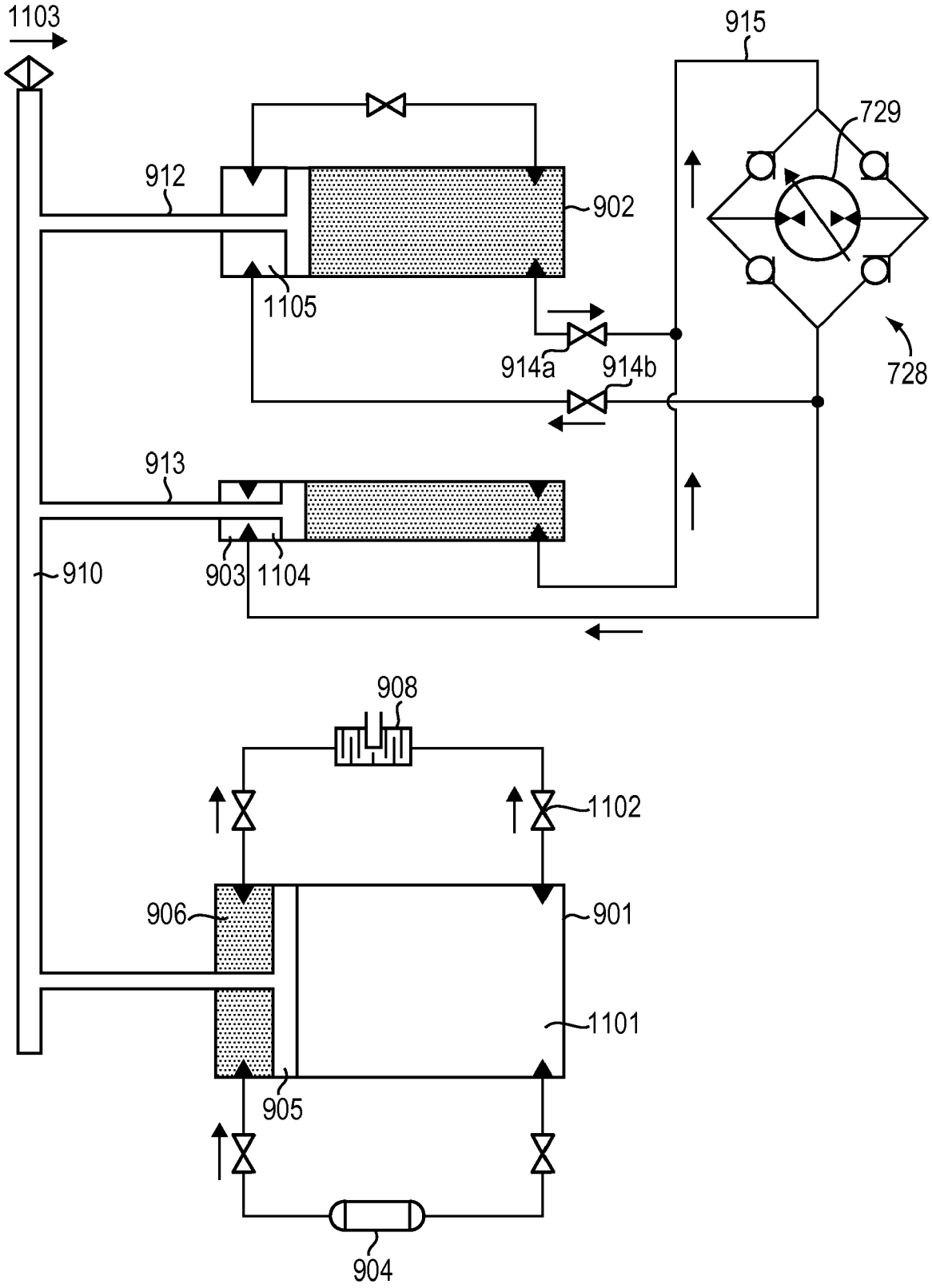
FIG. 11 depicts the illustrative embodiment of FIG. 9 in yet another phase of operation (i.e., with the high- and low-pressure sides of the hydraulic pistons reversed and the direction of shaft motion reversed such that only the narrower hydraulic piston is compressing hydraulic fluid)

Reference is now made to FIG. 11, which shows another state of operation of the illustrative embodiment of the invention shown in FIGS. 9 and 10. In the state of operation shown, pressurized gas from the reservoir 904 enters chamber 906 of the cylinder 901, driving its piston 905. Low-pressure gas from the other side 1101 of the high-pressure cylinder 901 is conveyed through a valve 1102 to vent 908. The action of the armature 910 on the pistons 912 and 913 of the hydraulic cylinders 902, 903 is in the opposite direction as in FIG. 10, as indicated by arrow 1103.

As in FIG. 9, valves 914*a* and 914*b* are open and permit fluid to flow to hydraulic power unit 729. Pressurized fluid from both cylinders 902 and 903 is conducted via piping 915 to the aforementioned arrangement of check values 728 and hydraulic power unit 729, producing electricity. Hydraulic fluid at lessened pressure is conducted from the output of the hydraulic pump/motor 720 to the lower-pressure chambers 1104 and 1105 of the hydraulic cylinders 902, 903.

The fluid in the high-pressure chambers of the two hydraulic cylinders 902, 903 is at a single pressure, and the fluid in the low-pressure chambers 1104, 1105 is also at a single pressure. In effect, the two cylinders 902, 903 act as a single cylinder whose piston area is the sum of the piston areas of the two cylinders and whose operating pressure, for a given driving force from the pneumatic cylinder 901, is proportionately lower than that of either cylinder 902 or cylinder 903 acting alone.

Figure 12:
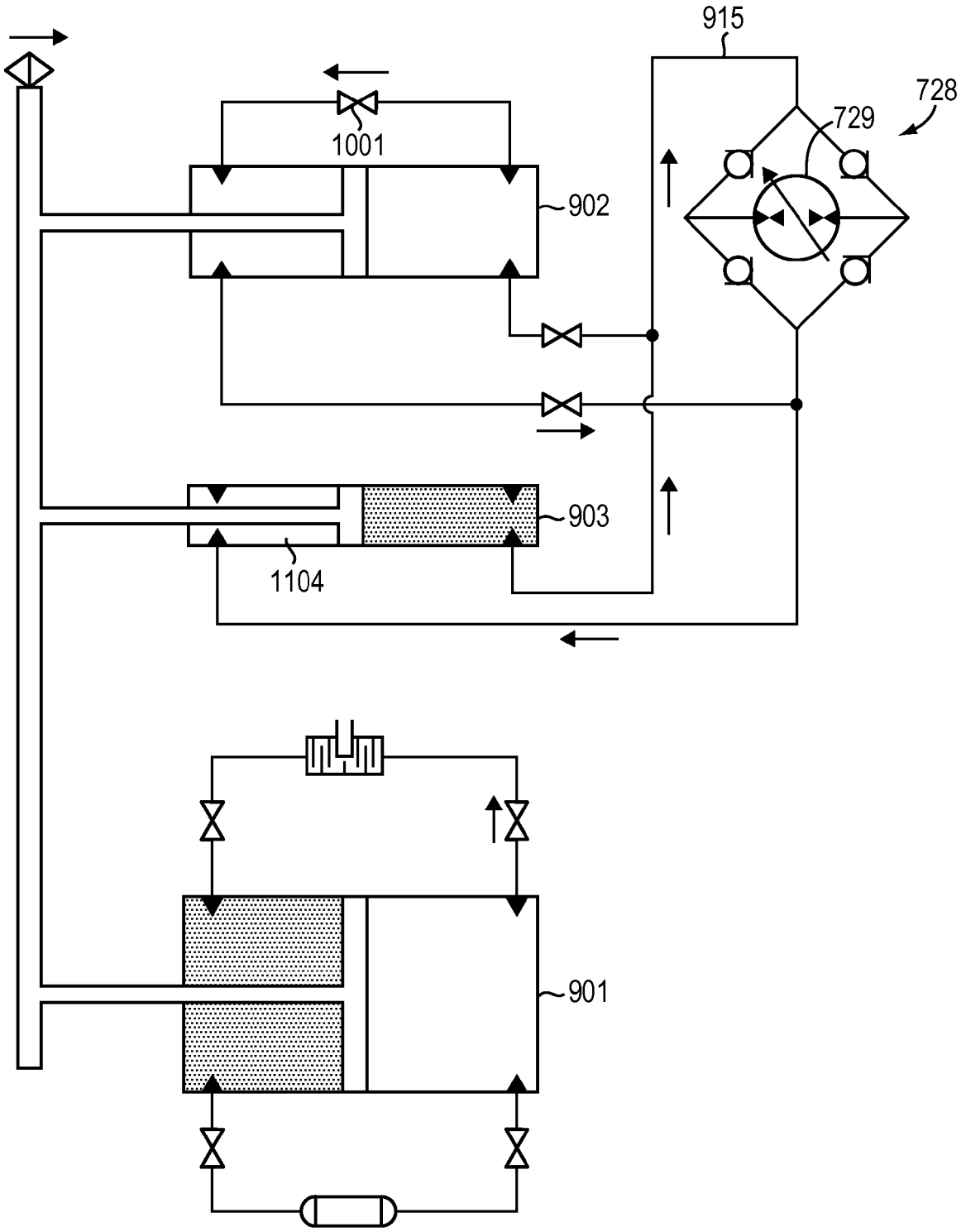
FIG. 12 depicts the illustrative embodiment of FIG. 9 in another phase of operation (i.e., same direction of motion as in FIG. 11, but with both pneumatic cylinders compressing hydraulic fluid)

Reference is now made to FIG. 12, which shows another state of operation of the illustrative embodiment of the invention shown in FIGS. 9-11. The action of the pneumatic cylinder 901 and the direction of motion of all moving parts is the same as in FIG. 11. In the state of operation shown, formerly closed valve 1001 is opened to permit fluid to flow freely between the two chambers of the wider hydraulic cylinder 902, thus presenting minimal resistance to the motion of the piston of cylinder 902. Pressurized fluid from the narrower cylinder 903 is conducted via piping 915 to the aforementioned arrangement of check values 728 and hydraulic power unit 729, producing electricity. Hydraulic fluid at lessened pressure is conducted from the output of the hydraulic pump/motor 729 to the lower-pressure chamber 1104 of the narrower hydraulic cylinder.

In effect, the acting hydraulic cylinder 902 has a smaller piston area providing a higher hydraulic pressure for a given force, than the state shown in FIG. 11, where both cylinders were acting with a larger effective piston area. Through valve actuations disabling one of the hydraulic cylinders a narrowed hydraulic fluid pressure range is obtained.

Additionally, valving may be added to cylinder 902 such that it may be disabled in order to provide another effective hydraulic piston area (considering that cylinders 902 and 903 have different diameters, at least in the depicted embodiment) to somewhat further reduce the hydraulic fluid range for a given pneumatic pressure range Likewise, additional hydraulic cylinders with valve arrangements may be added to substantially further reduce the hydraulic fluid range for a given pneumatic pressure range.

Figure 13:
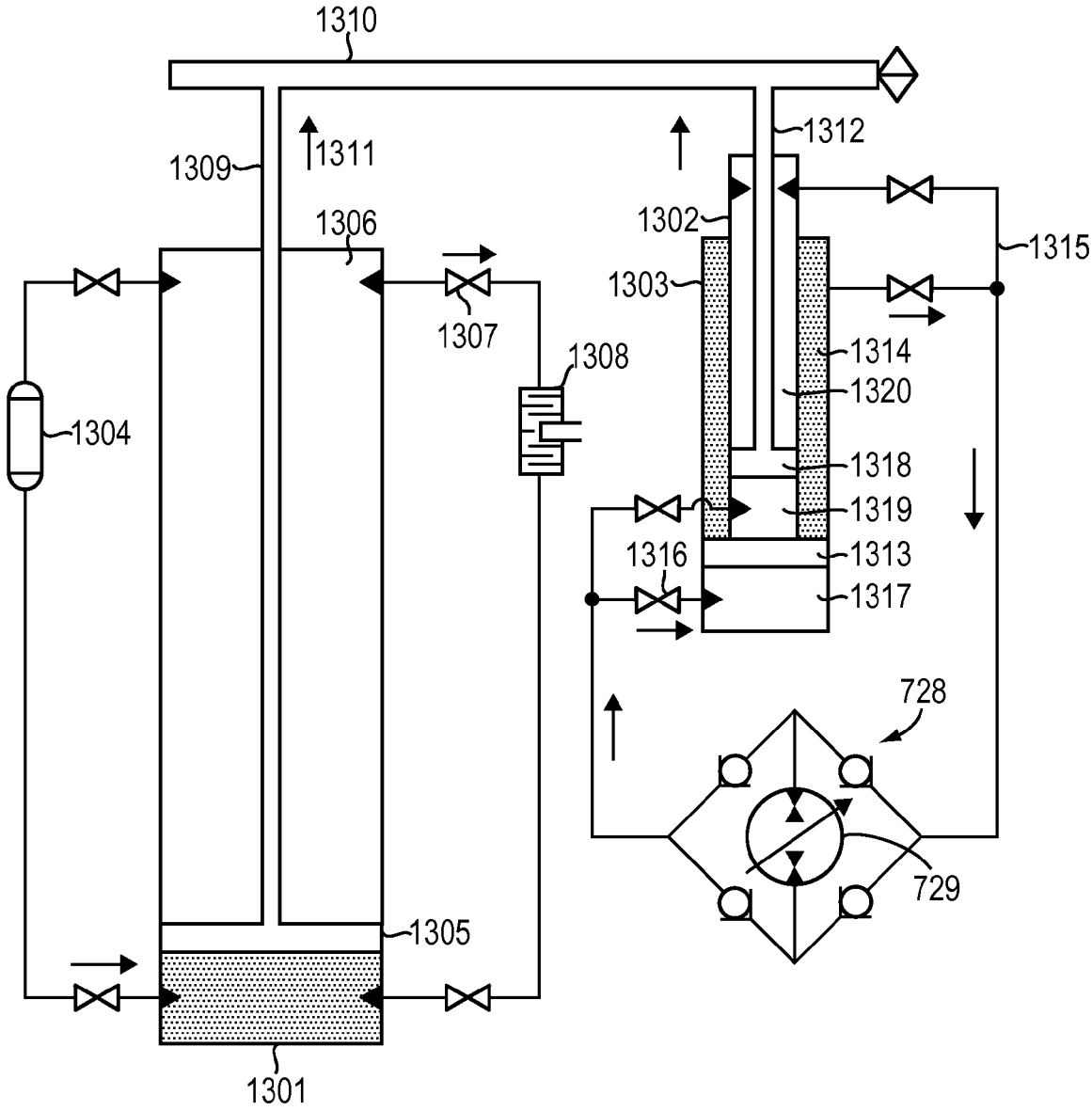
FIG. 13 depicts the mechanism of FIG. 9 with the two side-by-side hydraulic cylinders replaced by two telescoping hydraulic cylinders, and in a phase of operation where only the inner, narrower hydraulic cylinder is compressing hydraulic fluid (thus decreasing the range of hydraulic pressures delivered to the hydraulic motor as the force produced by the pressurized gas in the pneumatic cylinder decreases with expansion, and as the pressure of the gas stored in the reservoir decreases), in accordance with various embodiments of the invention.

Reference is now made to FIG. 13, which shows an illustrative embodiment of the invention in which single double-acting pneumatic cylinder 1301 and two double-acting hydraulic cylinders 1302, 1303, one (1302) telescoped inside the other (1303), are employed. In the state of operation shown, pressurized gas from the reservoir 1304 drives the piston 1305 of the cylinder 1301. Low-pressure gas from the other side 1306 of the pneumatic cylinder 1301 is conveyed through a valve 1307 to a vent 1308.

The hydraulic cylinder shaft 1309 moves a bar or armature 1310 in the direction indicated by the arrow 1311. The armature 1310 is also connected to the piston shaft 1312 of the double-acting hydraulic cylinder 1302.

In the state of operation shown, the entire narrow cylinder 1302 acts as the shaft of the piston 1313 of the wider cylinder 1303. The piston 1313, cylinder 1302, and shaft 1312 of the hydraulic cylinder 1303 are moved in the indicated direction by the armature 1310. Compressed hydraulic fluid from the higher-pressure chamber 1314 of the larger diameter cylinder 1303 passes through a valve 1315 to the aforementioned arrangement of check values 728 and hydraulic power unit 729, producing electricity. Hydraulic fluid at lessened pressure is conducted from the output of the hydraulic pump/motor 729 through valve 1316 to the lower-pressure chamber 1317 of the hydraulic cylinder 1303.

In this state of operation, the piston 1318 of the narrower cylinder 1302 remains stationary with respect to cylinder 1302, and no fluid flows into or out of either of its chambers 1319, 1320.

Figure 14:
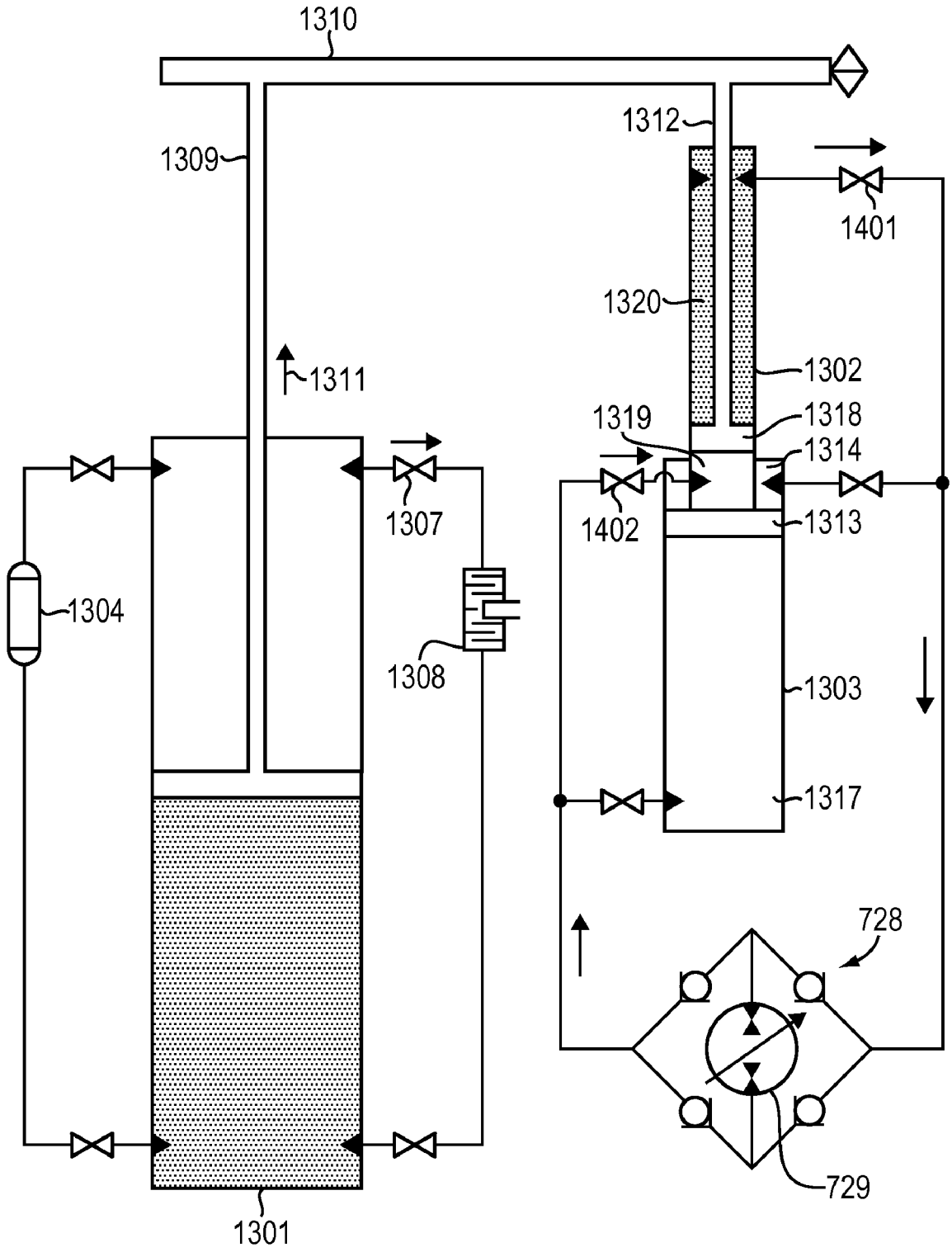
FIG. 14 depicts the illustrative embodiment of FIG. 13 in a different phase of operation (i.e., same direction of motion, with the inner cylinder piston moved to its limit in the direction of motion and no longer compressing hydraulic fluid, and the outer, wider cylinder compressing hydraulic fluid, the fully-extended inner cylinder acting as the wider cylinder's piston shaft)

Reference is now made to FIG. 14, which shows another state of operation of the illustrative embodiment of the invention shown in FIG. 13. The action of the pneumatic cylinder and the direction of motion of all moving parts is the same as in FIG. 13. In FIG. 14, the piston 1313, cylinder 1302, and shaft 1312 of the hydraulic cylinder 1303 have moved to the extreme of their range of motion and have stopped moving relative to cylinder 1303. At this point, valves are opened such that the piston 1318 of the narrow cylinder 1302 acts. Pressurized fluid from the higher-pressure chamber 1320 of the narrow cylinder 1302 is conducted through a valve 1401 to the aforementioned arrangement of check values 728 and hydraulic power unit 729, producing electricity. Hydraulic fluid at lessened pressure is conducted from the output of the hydraulic pump/motor 729 through valve 1402 to the lower-pressure chamber 1319 of the hydraulic cylinder 1303.

In this manner, the effective piston area on the hydraulic side is changed during the pneumatic expansion, narrowing the hydraulic pressure range for a given pneumatic pressure range.

Figure 15:
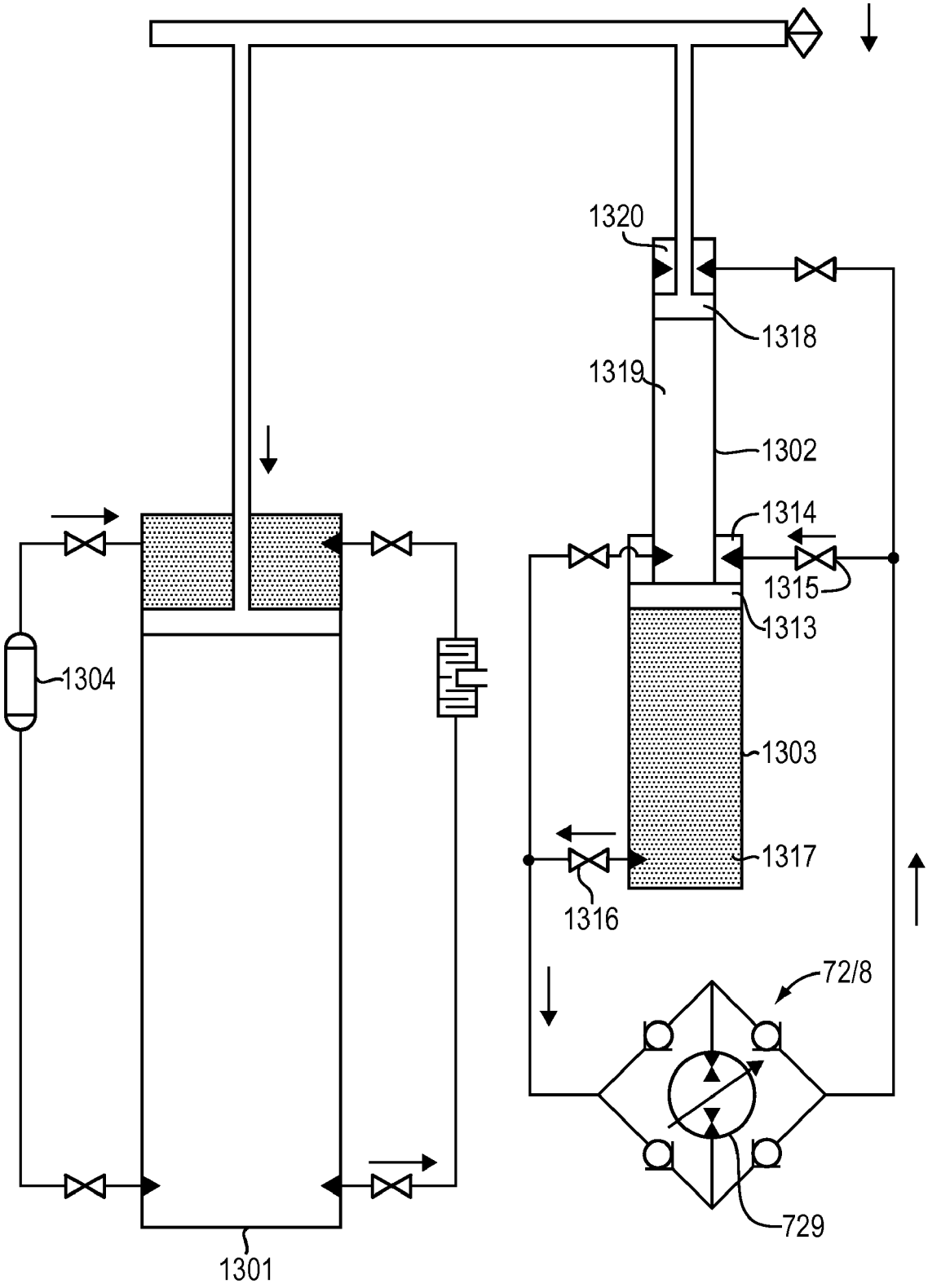
FIG. 15 depicts the illustrative embodiment of FIG. 13 in yet another phase of operation (i.e., reversed direction of motion, only the inner, narrower cylinder compressing hydraulic fluid)

Reference is now made to FIG. 15, which shows another state of operation of the illustrative embodiment of the invention shown in FIGS. 13 and 14. The action of the pneumatic cylinder 1301 and the direction of motion of all moving parts are the reverse of those shown in FIG. 13. As in FIG. 13, only the wider cylinder 1303 is active; the piston 1318 of the narrower cylinder 1302 remains stationary, and no fluid flows into or out of either of its chambers 1319, 1320.

Compressed hydraulic fluid from the higher-pressure chamber 1317 of the wider cylinder 1303 passes through valve 1316 to the aforementioned arrangement of check values 728 and hydraulic power unit 729, producing electricity. Hydraulic fluid at lessened pressure is conducted from the output of the hydraulic pump/motor 729 through valve 1315 to the lower-pressure chamber 1314 of the hydraulic cylinder 1303.

In yet another state of operation of the illustrative embodiment of the invention shown in FIGS. 13-15, not shown, the piston 1313, cylinder 1302, and shaft 1312 of the hydraulic cylinder 1303 have moved as far as they can in the direction indicated in FIG. 15. Then, as in FIG. 14 but in the opposite direction of motion, the narrow cylinder 1302 becomes the active cylinder driving the motor/generator 729.

The spray arrangement for heat exchange and/or the external heat-exchanger arrangement described in the above-incorporated '703 and '235 applications may be adapted to the pneumatic cylinders described herein, enabling approximately isothermal expansion of the gas in the high-pressure reservoir. Moreover, these identical exemplary embodiments may be operated as a compressor (not shown) rather than as a generator (shown). Finally, the principle of adding cylinders operating at progressively lower pressures in series (pneumatic and/or hydraulic) and in parallel or telescoped fashion (mechanically) may be carried out via two or more cylinders on the pneumatic side, the hydraulic side, or both.

Figure 16A:
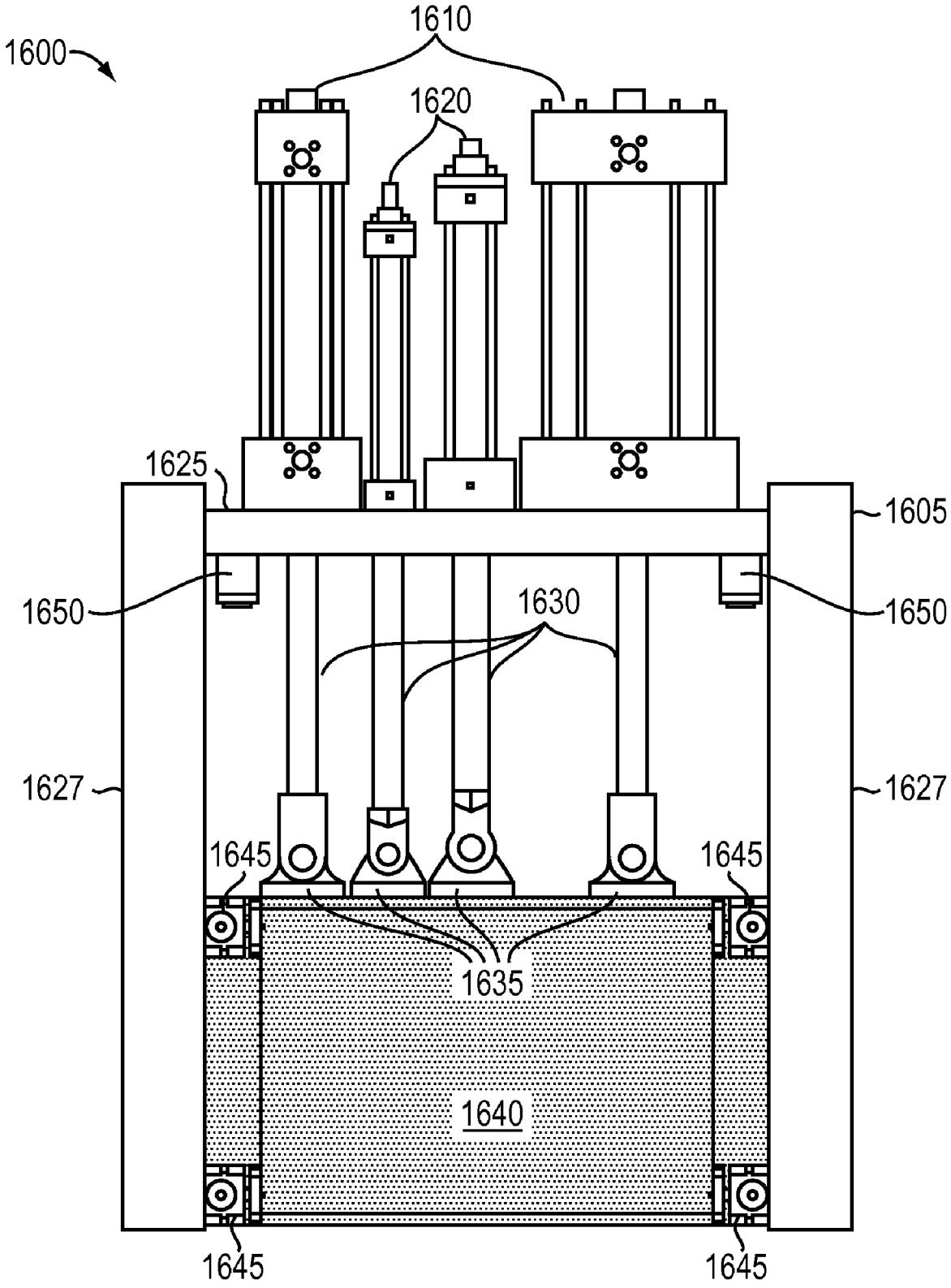
FIG. 16A is a schematic side view of a system in which one or more pneumatic and hydraulic cylinders produces a hydraulic force that may be used to drive to a hydraulic pump/motor and electric motor/generator, in accordance with various embodiments of the invention.

The cylinder assemblies coupled to a rigid armature described above may be utilized in a variety of energy storage and recovery systems. Such systems may be designed so as to minimize deleterious friction and to balance the forces acting thereon to improve efficiency and performance. Further, such systems may be designed so as to minimize dead space therein, as described below. FIG. 16A depicts an embodiment of a system 1600 for using pressurized stored gas to operate one or more pneumatic and hydraulic cylinders to produce hydraulic force that may be used to drive to a hydraulic pump/motor and electric motor/generator. All system components relating to heat exchange, gas storage, motor/pump operation, system control, and other aspects of function are omitted from the figure. Examples of such systems and components are disclosed in the '057 and '703 applications.

As shown in FIG. 16A, the various components are attached directly or indirectly to a rigid structure or frame assembly 1605. In the embodiment shown, the frame 1605 has an approximate shape of an inverted "U;" however, other shapes may be selected to suit a particular application and are expressly contemplated and considered within the scope of the invention. Also, as shown in this particular embodiment, two pneumatic cylinder assemblies 1610 and two hydraulic cylinder assemblies 1620 are mounted vertically on an upper, horizontal support 1625 of the frame 1605. The upper, horizontal support 1625 is mounted to two vertically oriented supports 1627. The specific number, type, and combinations of cylinder assemblies will vary depending on the system. In this example, each cylinder assembly is a double-acting two-chamber type with a shaft-driven piston separating the two chambers. All piston shafts or rods 1630 pass through clearance holes in the horizontal support 1625 and extend into an open space within the frame 1605. In one embodiment, the cylinder assemblies are mounted to the frame 1605 via their respective end caps. As shown, the cylinder assemblies are oriented such that the movement of each cylinder's piston is in the same direction.

Figure 16B:
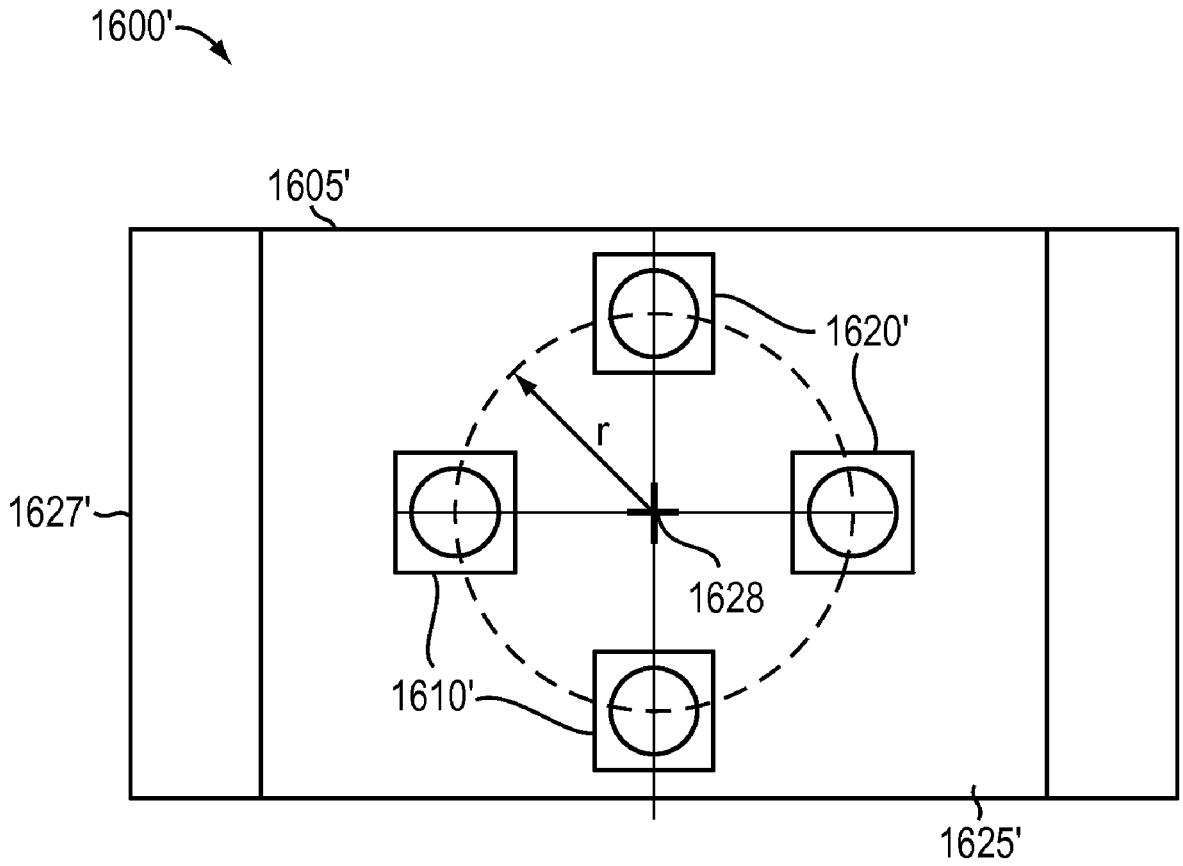
FIG. 16B is a schematic top view of an alternative embodiment of the system of FIG. 16A.

The basic arrangement of the cylinder assemblies may vary to suit a particular application and the various arrangements provide a variety of advantages. For example, as shown in FIG. 16A, the cylinder assemblies are generally closely clustered, thereby minimizing beam deflections. Alternatively (or additionally), as shown in the embodiment of FIG. 16B, substantially identical cylinders 1610', 1620' are disposed about a common central axis 1628 of the frame 1605'. The cylinders are evenly spaced (90° apart in this embodiment) and are disposed equidistant (r) from the central axis 1628. This alternative arrangement substantially eliminates net torques and reduces frictions.

The distal ends of the rods are attached to a beam assembly 140 slidably coupled to the frame 1605. The pistons of the cylinder assemblies act upon the beam assembly, which is free to move vertically within the frame assembly. In one embodiment, the beam assembly 1640 is a rigid I-beam. The distal ends of the rods are attached to the beam assembly 1640 via revolute joints 1635, which reduce transmission to the pistons of moments or torques arising from deformations of the beam assembly 1640. Each revolute joint 1635 consists essentially of a clevis attached to an end of a rod 1630, an eye mounting bracket, and a pin joint, and rotates freely in the cylinder plane.

The system 1600 further includes roller assemblies 1645 that slidably couple the beam assembly 1640 to the frame assembly 1605 to ensure stable beam position. In this illustrative embodiment, sixteen track rollers 1645 are used to prevent the beam assembly 1640 from rotating in the cylinder plane, while allowing it to move vertically with low friction.

Only four track rollers 1645 are shown in FIG. 16A, i.e., those mounted with their axes normal to the cylinder plane on the visible side of the beam. As shown in subsequent figures, four rollers are mounted on each of the other three lateral faces of the beam in the illustrated embodiment. The roller assemblies 1645, in this embodiment track rollers, are mounted in such a manner as to be adjustable in one direction (in this example with a mounted block with four bolts in slotted holes and a second fixed block with set screw adjustment of the first block).

The system 1600 may also include two air springs 1650 mounted on the underside of the frame's horizontal member 1625 with their pistons pointing down. The springs 1650 cushion any impacts arising between the beam assembly 1640 and frame assembly 1605 as the beam assembly 1640 travels vertically within the frame assembly 1605. The beam assembly 1640 rebounds from the springs 1650 at the extreme or turnaround point of an upward piston stroke.

Figure 17:
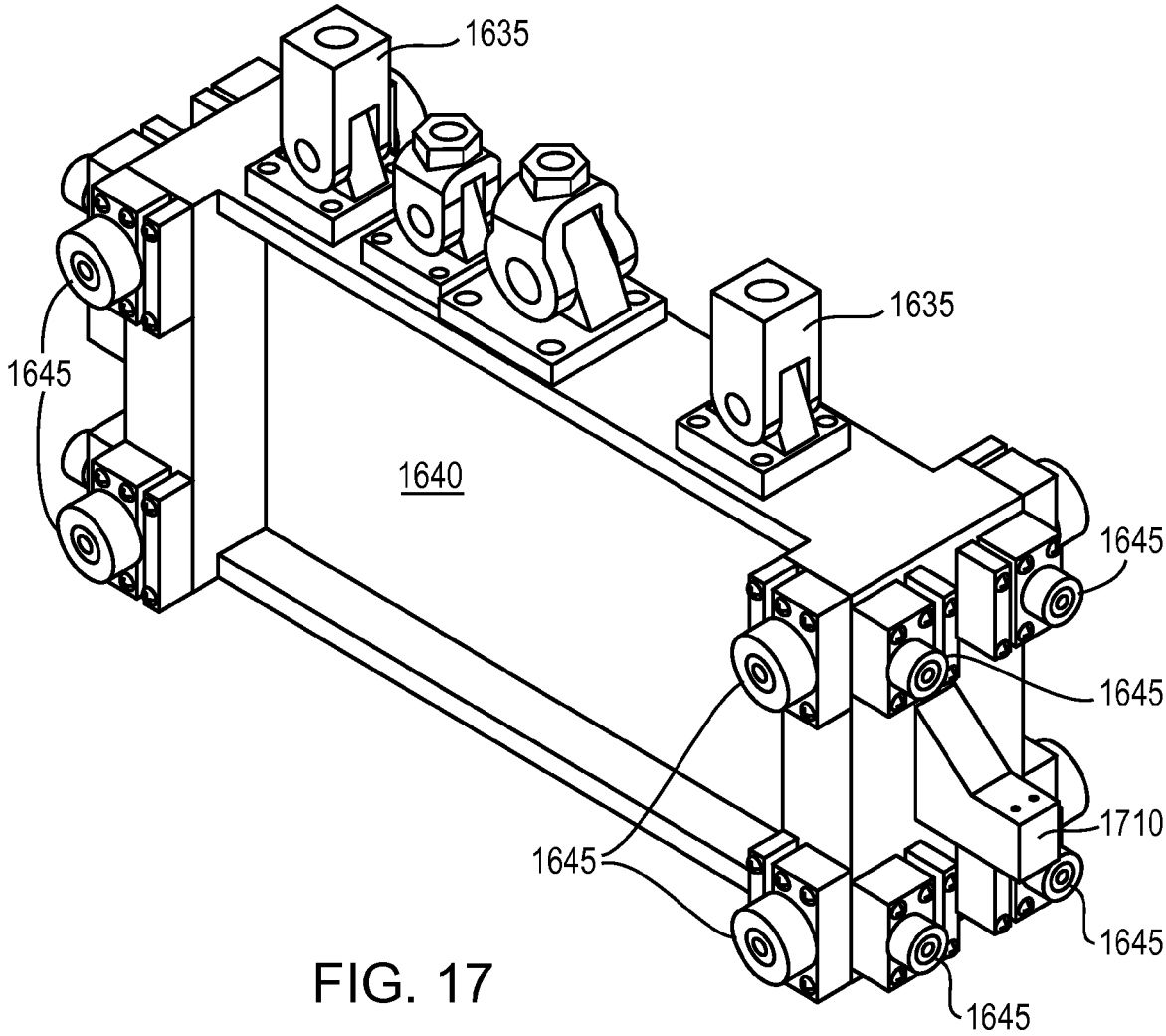
FIG. 17 is a schematic perspective view of a beam assembly for use in the system of FIG. 16A.

The beam assembly 1640 is shown in greater detail in FIG. 17, which depicts the disposition of the roller assemblies 1645. As shown in FIG. 17, the beam assembly 1640 includes a modified I-beam with an arrangement of eight rollers 1645 on two of the beam's lateral faces. An identical arrangement of eight additional rollers 1645 is located on the beam's opposing lateral sides. The beam assembly 1640 includes two projections 1710 extending from opposite ends of the beam (only one projection 1710 is visible in FIG. 17). The function of the projections 1710 is discussed with respect to FIG. 18. Also shown in FIG. 17 are the revolute joints 1635 that couple the cylinder assembly rods to the beam assembly 1640.

Figure 18:
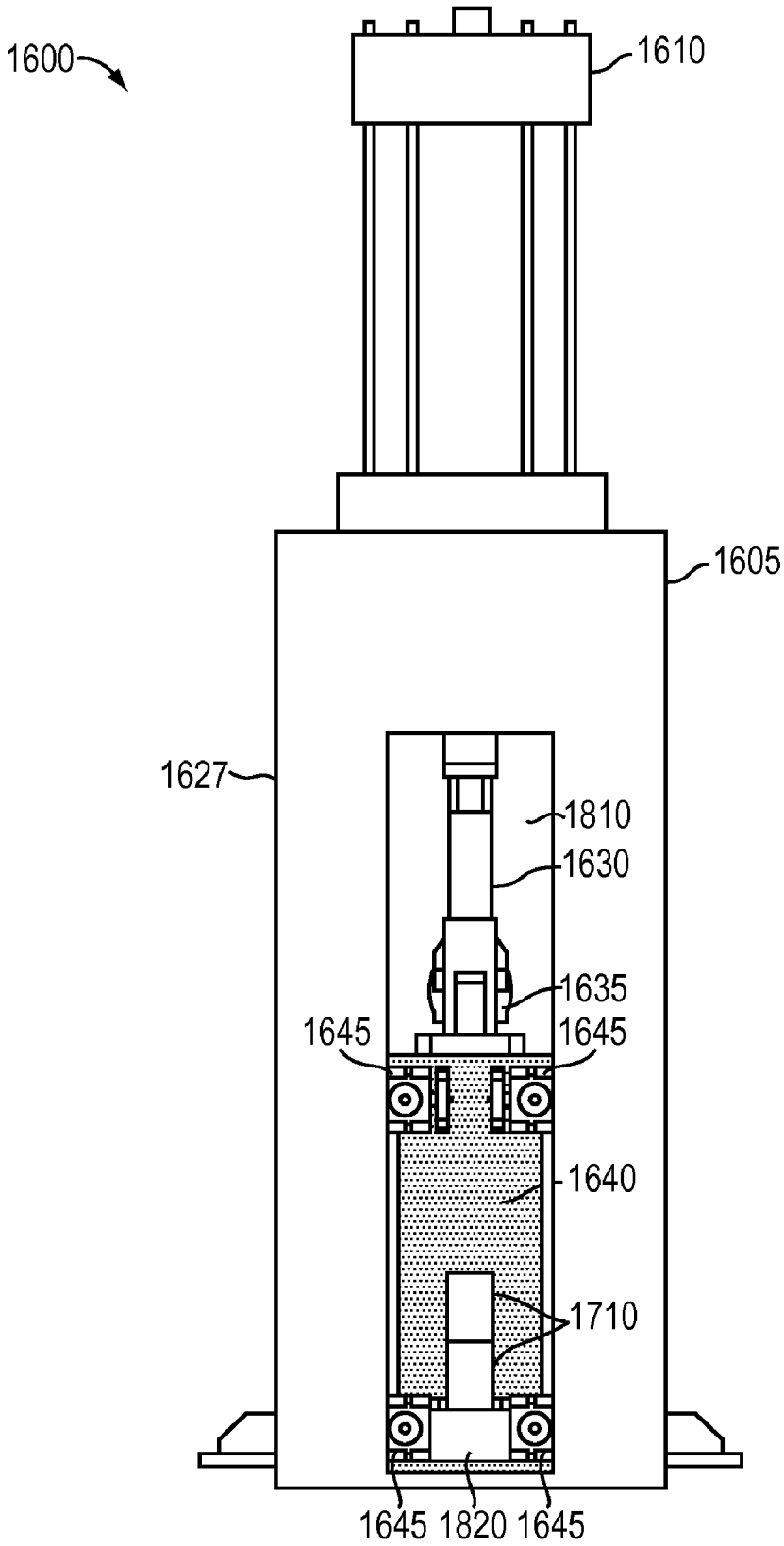
FIG. 18 is a schematic front view of the system of FIG. 16A.

FIG. 18 depicts the system 1600 of FIG. 16A rotated 90° in the horizontal plane, and only a single pneumatic cylinder assembly 1610 is visible, as the other cylinder assemblies are disposed in parallel behind the depicted cylinder assembly 1610. The rod 1630 is fully extended and coupled to the beam assembly 1640 via the revolute joint 1635, as seen through a rectangular opening 1810 formed in the vertical supports 1627. The opening 1810 may be part of a channel formed within each vertical support 1627 for receiving one end of the beam assembly 1640. As shown, four rollers 1645 mounted normal to an end face of the beam interact with the channel/opening 1810. Two rollers 1645 travel along each side of the channel/opening 1810 in the frame assembly 1605.

Also shown in FIG. 18 is another air spring 1820 mounted adjacent the base of the vertical support 1627 with its piston pointing upward. A second air spring 1820 is identically mounted at the opposite end of the frame assembly 1605 in the illustrated embodiment. The protrusion 1710 extending from the end faces of the beam assembly 1640, as shown in FIG. 17, contacts the air spring 1820 at the extreme or turnaround point of the downward cylinder stroke, with the beam assembly 1640 momentarily stationary and the protrusion 1710 from the beam assembly 1640 maximally compressing the air spring 1820. The protrusion 1710 disposed at the far end of the beam assembly 1640 identically depresses the piston of the air spring 1820 at that end of the frame assembly 1605. In the state depicted in FIG. 18, the air spring 1820 contains maximum potential energy from the in-stroke of its piston and is about to begin transferring that energy to the beam assembly 1640 via its out-stroke. The two downward-facing air pistons shown in FIG. 16A perform an identical function at the turnaround point of every upward stroke.

Figure 19:
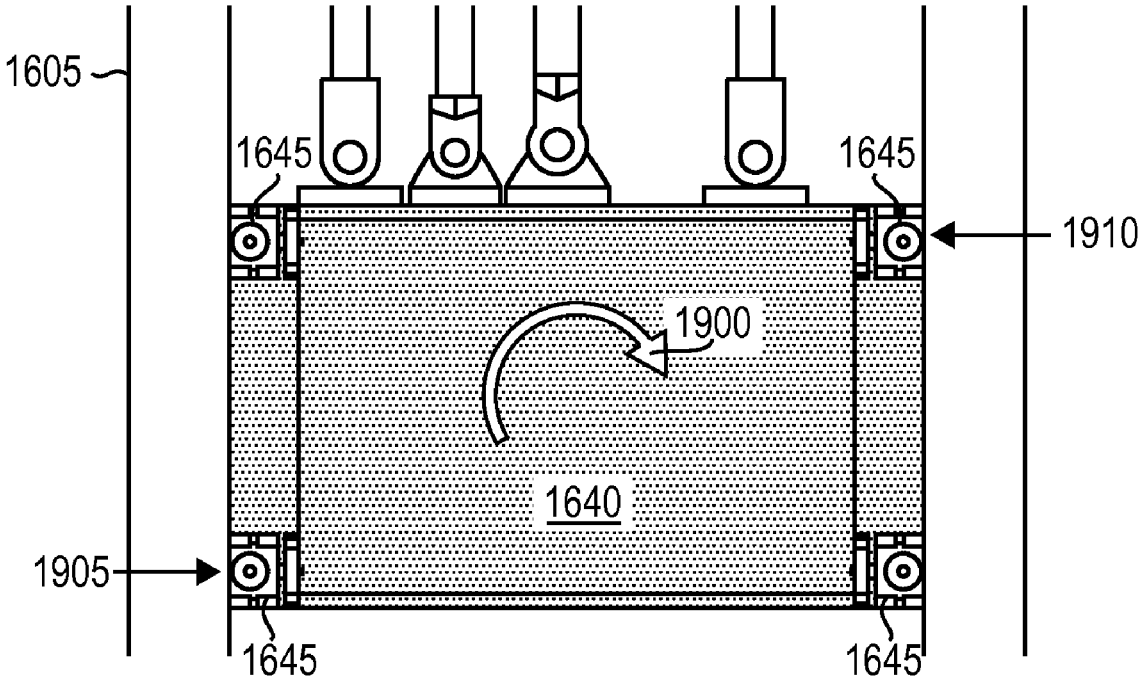
FIG. 19 is an enlarged schematic view of a portion of the system of FIG. 16A.

FIG. 19 depicts the counteraction, by rollers 1645, of rotation of the beam 1640 due to an imbalance of piston forces. In this example, a net clockwise unwanted moment or torque, indicated by the arrow 1900, tends to rotate the beam assembly 1640 (oriented as shown in FIG. 16A). The frame assembly 1605 exerts countervailing normal forces against two of the four rollers 1645 visible in FIG. 19 as indicated by arrows 1905, 1910. Similar forces act on two of the four rollers 1645 located on the opposite side of the beam assembly 1640 The taller the beam assembly, the smaller the normal forces 1905, 1910 will tend to be for a given torque 1900, since they will act on longer moment arms. Smaller normal forces will generally result in greater system reliability and efficiency since they place less stress on the roller components and do not increase friction as much as larger forces. The rollers 1645 thus efficiently counteract torques from imbalanced forces while permitting low-friction vertical motion of the beam assembly 1640 and the pistons coupled thereto. At the same time, a tall beam (i.e., one having a relatively large cross-section of the beam in the cylinder plane, as shown) tends to be more rigid for a given length, thereby reducing deformation of the beam assembly 1640 and thus reducing stress on the piston rods 1630. Net torque acting in the opposite direction would be balanced by similar forces acting against the other rollers 1645 (i.e., those on which forces do not act in FIG. 19). A force diagram schematically identical to FIG. 19 may be readily derived for all four lateral faces of the beam assembly 1640.

Additional embodiments of the invention employ different component and frame proportions, different numbers and placements of hydraulic and pneumatic cylinders, different numbers and types of rollers, and different types of revolute joints. For example, V-notch rollers may be employed, running on complementary V tracks attached to the frame 1605. Such rollers are able to bear axial loads as well as transverse loads, such as those shown in FIG. 19, eliminating the need for half of the rollers 1645. Such variations are expressly contemplated and within the scope of the invention.

Figure 20A:
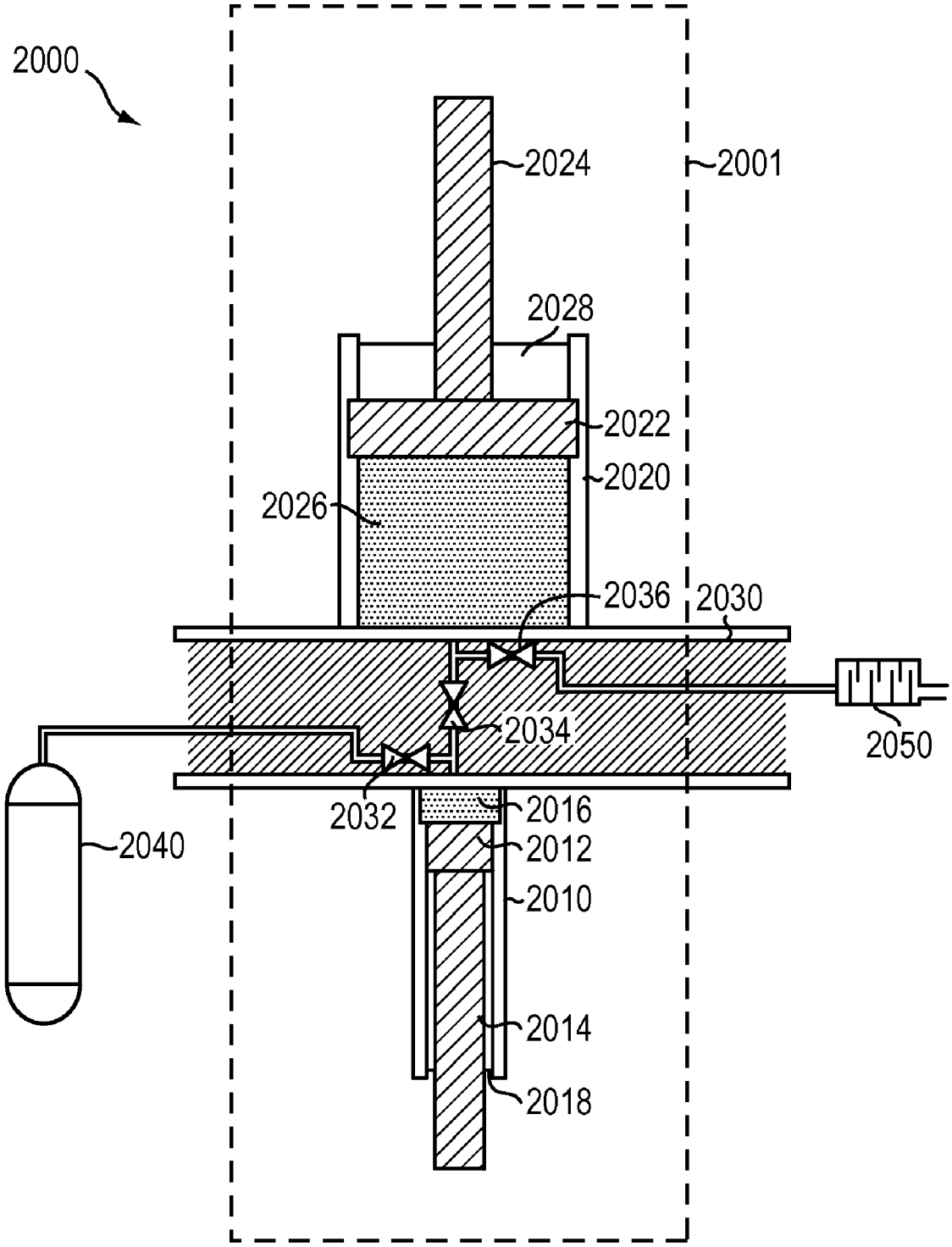
FIGS. 20A, 20B, and 20C are schematic diagrams of systems for compressed gas energy storage and recovery using staged pneumatic cylinder assemblies in accordance with various embodiments of the invention.

FIG. 20A depicts a system 2000 for achieving near-isothermal compression and expansion of a gas for energy storage and recovery using cylinders (shown in partial cross-section) with optional integrated heat exchange. The integrated heat exchange and mechanical means for coupling to the piston/piston rods is not shown for simplicity. The integrated heat exchange is described, e.g., in the '703 and '235 applications. In addition to those described above, exemplary means for mechanical coupling of the piston/piston rods is shown in FIGS. 21-23, 24A, and 24B, as well as described in the '583 application.

As shown in FIG. 20A, the system 2000 includes a pneumatic cylinder assembly 2001 having a high pressure cylinder body 2010 and low pressure cylinder body 2020 mounted on a common manifold block 2030. The manifold block 2030 may include one or more interconnected sub-blocks. The cylinder bodies 2010, 2020 are mounted to the manifold block 2030 in such a manner as to be sealed against leakage of pressurized air between the cylinder body and manifold block (e.g., flange mounted with an O-ring seal or threaded with sealing compound). The manifold block 2030 may be machined as necessary to interface with the cylinder bodies 2010, 2020 and any other components (e.g., valves, sensors, etc.). The cylinder bodies 2010, 2020 each contain a piston 2012, 2022 slidably disposed within their respectively cylinder bodies and piston rods 2014, 2024 attached thereto.

Each cylinder body 2010, 2020 includes a first chamber or compartment 2016, 2026 and a second chamber or compartment 2018, 2028. The first cylinder compartments 2016, 2026 are disposed between their respective pistons 2012, 2022 and the manifold block 2030 and are sealed against leakage of pressurized air between the first and second compartments by a piston seal (not shown), such that gas may be compressed or expanded within the first compartments 2016, 2026 by moving their respective pistons 2012, 2022. The second cylinder compartments 2018, 2028, which are disposed farthest from the manifold block 2030, are typically unpressurized.

One advantage of this arrangement is that the high and low pressure cylinder compartments 2016, 2026 are in close proximity to one another and separated only by the manifold block 2030. In this way, during a multiple-stage compression or expansion, non-cylinder space (dead space) between the cylinder bodies 2010, 2020 is minimized. Additionally, any necessary valves may be mounted within the manifold block 2030, thereby reducing complexity related to a separate set of cylinder heads, valve manifold blocks, and piping.

The system 2000 shown in FIG. 20A is a two-stage gas compression and expansion system. In expansion mode, air is admitted into high pressure cylinder 2010 from a high pressure (e.g., approximately 3000 psi) gas storage pressure vessel 2040 through valve 2032 mounted within the manifold 2030. After expansion in the high pressure cylinder 2010, mid pressure air (e.g., approximately 300 psi) is admitted into the cylinder 2020 through interconnecting piping (machined passageways in the manifold block 2030 in the illustrated embodiment) and valve 2034. The connection distance (i.e., potential dead space) between cylinder bodies 2010, 2020 is minimized through the illustrated arrangement. When air has further expanded to near atmospheric pressure in the low pressure cylinder 2020, the air may be vented through valve 2036 to vent 2050.

As previously discussed, the cylinders 2010, 2020 may also include heat transfer subsystems for expediting heat transfer to the expanding or compressing gas. The heat transfer subsystems may include a spray head mounted on the bottom of piston 2022 for introducing a liquid spray into first compartment 2026 of the low pressure cylinder 2020 and at the bottom of the manifold block 2030 for introducing a liquid spray into the first compartment 2016 of the high pressure cylinder 2010. Such implementations are described in the '703 application. The rods 2014, 2024 may be hollow so as to pass water piping and/or electrical wiring to/from the pistons 2012, 2022. Spray rods may be used in lieu of spray heads, also as described in the '703 application. In addition, pressurized gas may be drawn from first compartments 2016, 2026 through heat exchangers as described in the '235 application.

Figure 20B:
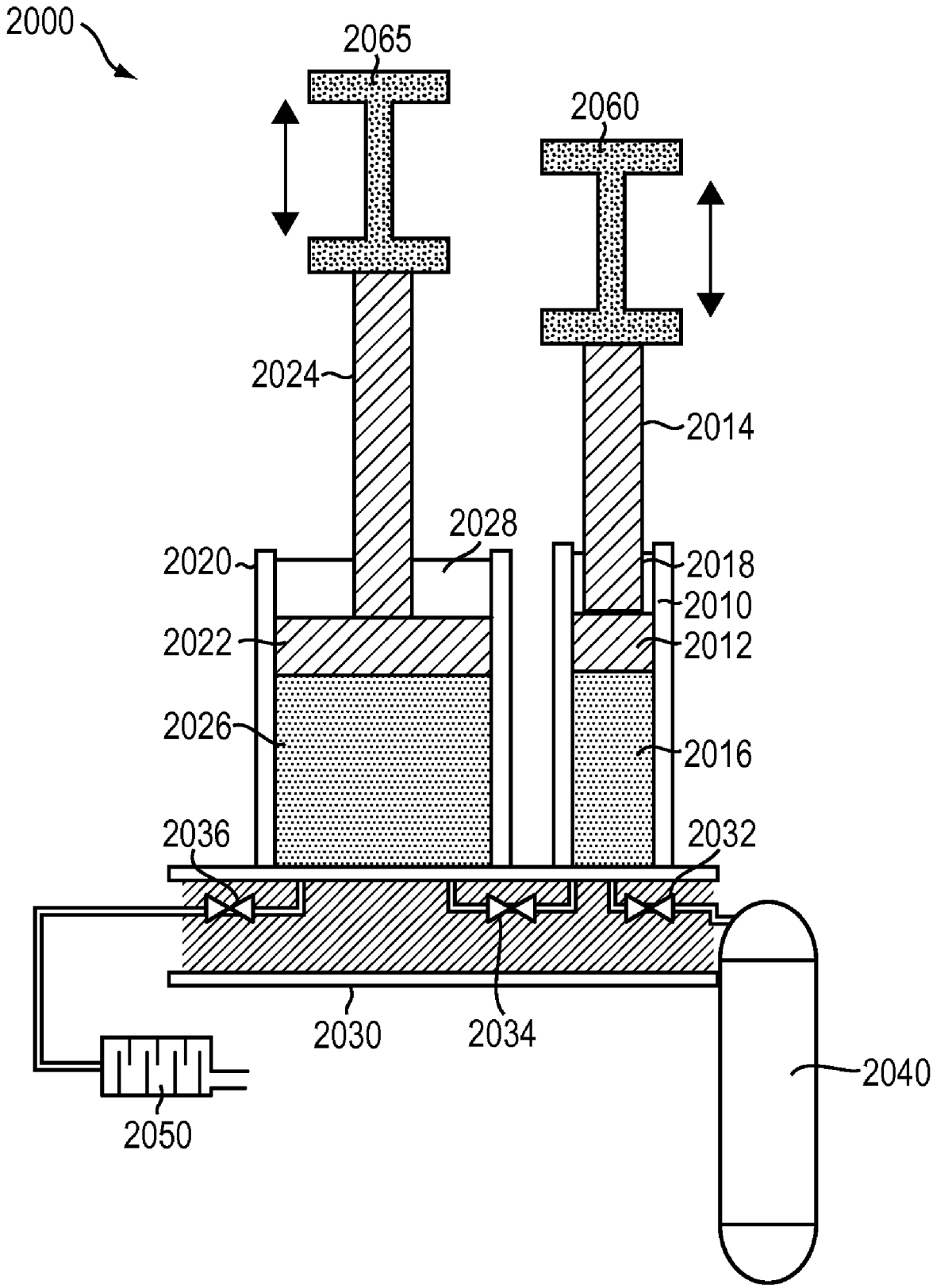

Dead space within system 2000 may also be minimized in configurations in which cylinder bodies 2010, 2010 are mounted on the same side of manifold block 2030, as shown in FIG. 20B. Just as described above with respect to FIG. 20A, in FIG. 20B, cylinder bodies 2010, 2020 are mounted to the manifold block 2030 in such a manner as to be sealed against leakage of pressurized air between the cylinder body and manifold block (e.g., flange mounted with an O-ring seal or threaded with sealing compound). Further, just as in FIG. 20A, cylinder bodies 2010, 2020 are single-acting (i.e., gas is pressurized and/or recovered in compartments 2016, 2026 and compartments 2018, 2028 are unpressurized). As shown, cylinder bodies 2010, 2020 are respectively attached to platens 2060, 2065 (e.g., rigid frames or armatures such as armatures 721, 910 or beam assembly 1640 described above) that move in reciprocating fashion.

Figure 20C:
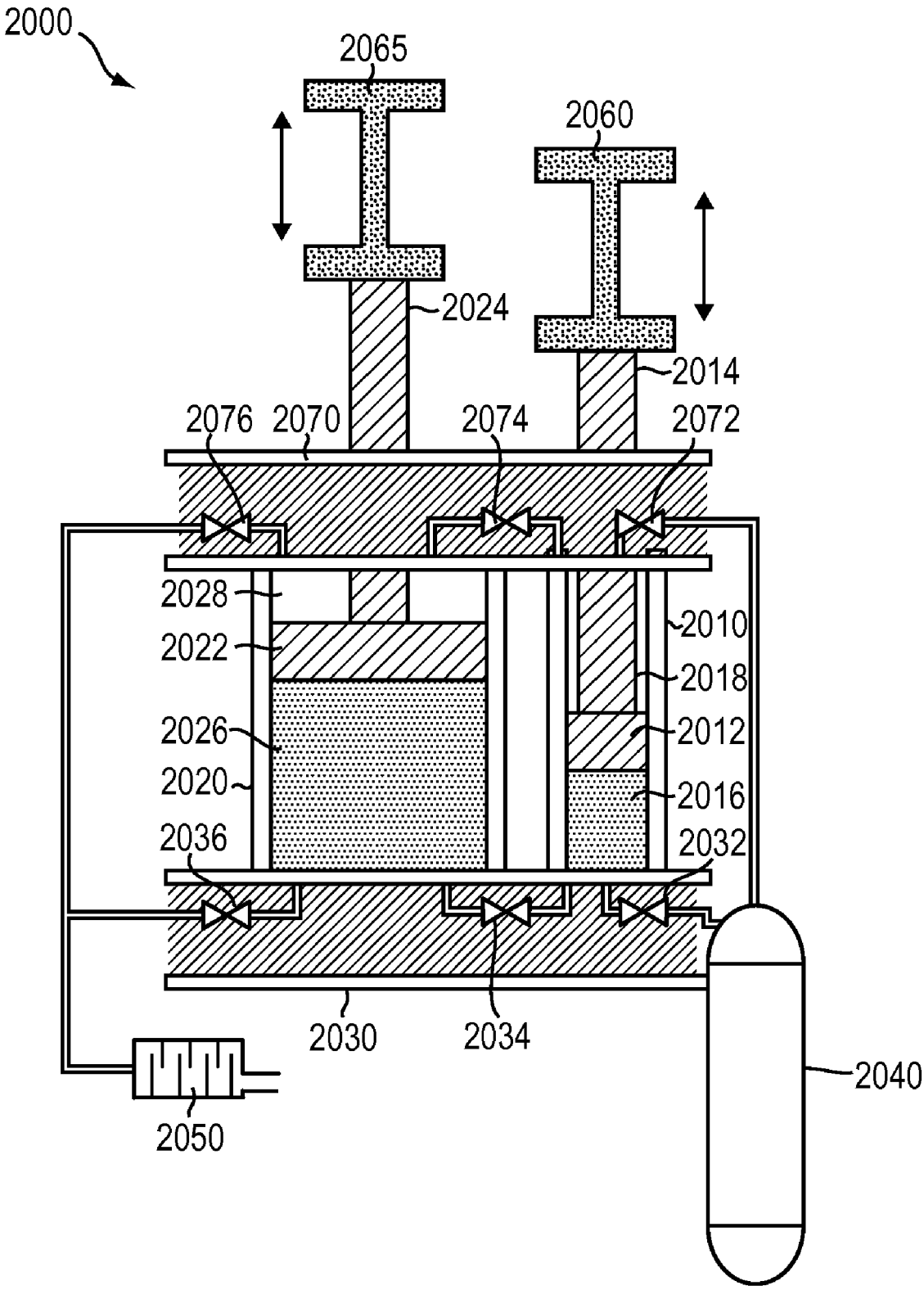

In various embodiments, system 2000 may incorporate double-acting cylinders and thus pressurize and/or recover gas during both upward and downward motion of their respective pistons. As shown in FIG. 20C, cylinder bodies 2010, 2020 may be double-acting and thus pressurize and/or recover gas within compartments 2018, 2028 as well as 2016, 2026. In order to enable their double-acting functionality, cylinder bodies 2010, 2020 are attached to a second manifold block 2070 that is substantially similar to manifold block 2030. Similarly, valves 2072, 2074, and 2076 have the same functionality as valves 2032, 2034, and 2036, respectively. As shown, piston rods 2014, 2024 extend through openings in second manifold block 2070, and platens 2060, 2065 are disposed sufficiently distant from second manifold block 2070 such that they do not contact second manifold block 2070 at the end of each stroke of pistons 2012, 2022. Platens 2060, 2065 move in a reciprocating fashion, as described above in relation to FIG. 20B. Just as in the embodiments depicted in FIGS. 20A and 20B, the connection distance (i.e., potential dead space) between cylinder bodies 2010, 2020 is minimized within both manifold block 2030 and second manifold block 2070.

Figure 21:
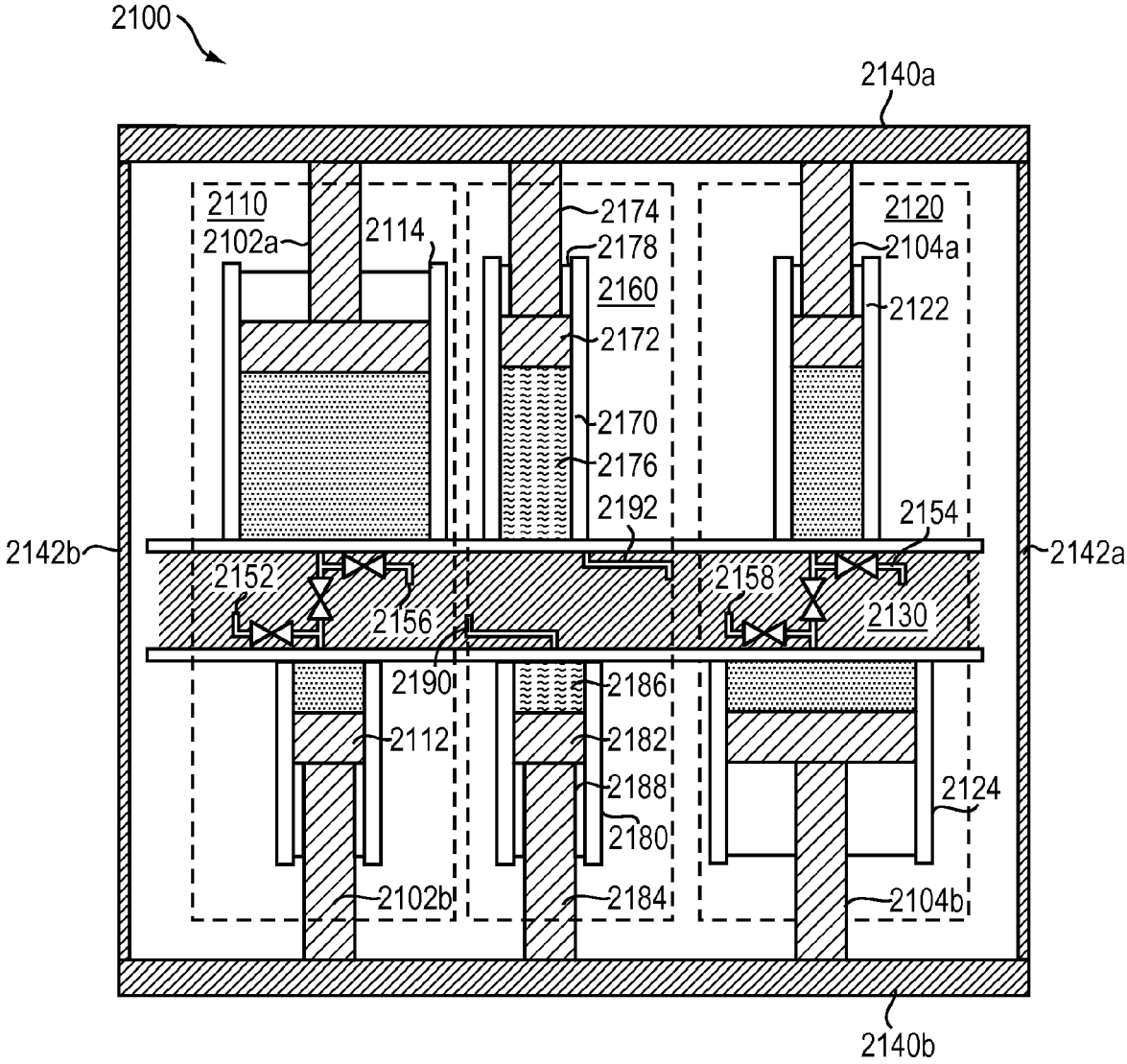
FIG. 21 is a schematic diagram of an alternative system using a plurality of staged pneumatic cylinder assemblies connected to a hydraulic cylinder assembly in accordance with various embodiments of the invention.

Reference is now made to FIG. 21, which shows a schematic diagram of another system 2100 for achieving near-isothermal compression and expansion of a gas for energy storage and recovery using cylinders (shown in partial cross-section) with optional integrated heat exchange. The system 2100 includes two staged pneumatic cylinder assemblies 2110, 2120 connected to a hydraulic cylinder assembly 2160; however, any number and combination of pneumatic and hydraulic cylinder assemblies are contemplated and considered within the scope of the invention.

The two pneumatic cylinder assemblies 2110, 2120 are identical in function to cylinder assembly 2001 of system 2000 described with respect to FIG. 20A and are mounted to a common manifold block 2130. Work done by the expanding gas in the pneumatic cylinder assemblies 2110, 2120 may be harnessed hydraulically by the hydraulic cylinder assembly 2160 attached to a common beam or platen 2140*a*, 2140*b*. Likewise, in compression mode, the hydraulic cylinder assembly 2160 may be used to hydraulically compress gas in the pneumatic cylinder assemblies 2110, 2120.

As shown, the hydraulic cylinder assembly 2160 includes a first hydraulic cylinder body 2170 and a second hydraulic cylinder body 2180 that are mounted on the common manifold block 2130. The hydraulic cylinder bodies 2170, 2180 are mounted to the manifold block 2130 in such a manner as to be sealed against leakage of pressurized fluid between the cylinder bodies and the manifold block 2130 (e.g., flange mounted with an O-ring seal or threaded with sealing compound). The cylinder bodies 2170, 2180 each contain a piston 2172, 2182 and piston rod 2174, 2184 extending therefrom. The cylinder compartments 2176, 2186 between the pistons 2172, 2182 and the manifold block 2130 are sealed against leakage of pressurized fluid by piston seals (not shown), such that fluid may be pressurized by piston force or by pressurized flow from a hydraulic pump (not shown). The cylinder compartments 2178, 2188 farthest from the manifold block 2130 are typically unpressurized. The hydraulic cylinder assembly 2160 acts as a double-acting cylinder with fluid inlet and outlet ports 2190, 2192 formed in the manifold block 2130. The ports 2190, 2192 may be connected through a valve assembly to a hydraulic pump/motor (not shown) that allows for hydraulically harnessing work from expansion in the pneumatic cylinder assemblies 2110, 2120 and using hydraulic work by the hydraulic motor/pump to compress gas in the pneumatic cylinder assemblies 2110, 2120.

The second pneumatic cylinder assembly 2120 is mounted in an inverted fashion with respect to the first pneumatic cylinder assembly 2110. The piston rods 2102*a*, 2102*b*, 2104*a*, 2104*b* for the cylinder assemblies 2110, 2120 are attached to the common beam or platen 2140*a*, 2140*b* and operated out of phase with one another such that when high-pressure gas is expanding in the narrower high-pressure cylinder 2112 in the first pneumatic cylinder assembly 2110, lower-pressure gas is also expanding in the wider low-pressure cylinder 2124 in the second pneumatic cylinder assembly 2120. In this manner, the forces from the high pressure expansion in the first pneumatic cylinder assembly 2110 and the low pressure expansion in second pneumatic cylinder assembly 2120 are collectively applied to beam 2140*b*. Beam 2140*b* is attached rigidly to beam 2140*a* through tie rods 2142*a*, 2142*b* or other means, such that as expansion occurs in cylinder 2112, air in cylinder 2122 expands into cylinder 2124 and low pressure cylinder 2114 of the first pneumatic cylinder assembly 2110 is reset. Additionally, force from the expansion in cylinders 2112, 2124 is transmitted to hydraulic cylinder 2170, pressurizing fluid in hydraulic cylinder compartment 2176, and allowing the work from the expansions to be harnessed hydraulically. Similar to FIG. 20A, ports 2152, 2154 may be attached to a high-pressure gas vessel and ports 2156, 2158 may be attached to a low-pressure vent. The pneumatic cylinders 2112, 2114, 2122, 2124 may also contain subsystems for expediting heat transfer to the expanding or compressing gas, as previously described.

Figure 22:
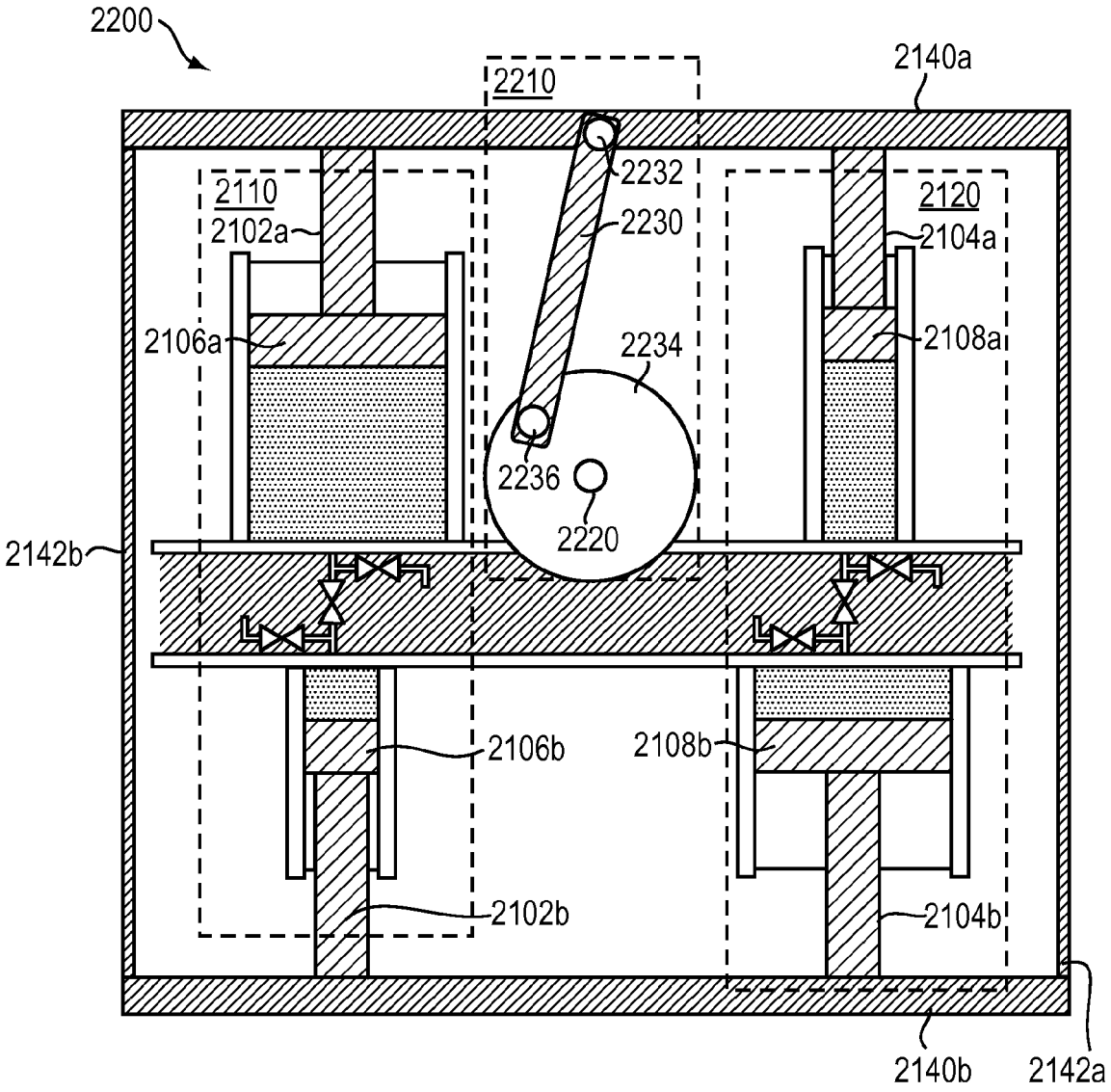
FIG. 22 is a schematic diagram of an alternative system using a plurality of staged pneumatic cylinder assemblies connected to a mechanical crankshaft assembly in accordance with various embodiments of the invention.

FIG. 22 depicts yet another system 2200 for achieving near-isothermal compression and expansion of a gas for energy storage and recovery using two staged pneumatic cylinder assemblies connected to a mechanical linkage. The system 2200 shown in FIG. 22 includes two pneumatic cylinder assemblies 2110, 2120, which are identical in function to those described with respect to FIG. 21. The cylinder rods 2102*a*, 2102*b*, 2104*a*, 2104*b* for the pneumatic cylinder assemblies 2110, 2120 are attached to a common beam or platen structure (e.g., a structural metal frame) 2140*a*, 2140*b*, 2142*a*, 2142*b*, such that the cylinder pistons 2106*a*, 2106*b*, 2108*a*, 2108*b* and rods 2102*a*, 2102*b*, 2104*a*, 2104*b* move together. Work done by the expanding gas in the pneumatic cylinder assemblies 2110, 2120 is harnessed mechanically by a mechanical crankshaft assembly 2210 attached to the common beam 2140*a*, 2140*b* with connecting rods 2142*a*, 2142*b*, as described with respect to FIG. 21. Likewise, in compression mode, the mechanical crankshaft assembly 2210 may be operated to compress gas in the pneumatic cylinder assemblies 2110, 2120. As previously discussed, the pneumatic cylinder assemblies 2110, 2120 may include heat transfer subsystems.

The mechanical crankshaft assembly 2210 consists essentially of a rotary shaft 2220 attached to a rotary machine such as an electric motor/generator (not shown). During expansion of air in the pneumatic cylinder assemblies 2110, 2120, up/down motion of the platen structure 2140*a*, 2140*b*, 2142*a*, 2142*b* pushes and pulls the connecting rod 2230. The connecting rod 2230 is attached to the platen 2140*a* by a pin joint 2232, or other revolute coupling, such that force is transmitted to a crank 2234 through the connecting rod 2230, but the connecting rod 2230 is free to rotate around the axis of the pin joint 2232. As the connecting rod 2230 is pushed and pulled by up/down motion of the platen structure 2140*a*, 2140*b*, 2142*a*, 2142*b*, the crank 2234 is rotated around the axis of the rotary shaft 2220. The connecting rod 2230 is connected to the crank 2234 by another pin joint 2236.

The mechanical crankshaft assembly 2210 is an illustration of one exemplary mechanism to convert the up/down motion of the platen into rotary motion of a shaft 2220. Other such mechanisms for converting reciprocal motion to rotary motion are contemplated and considered within the scope of the invention.

Figure 23:
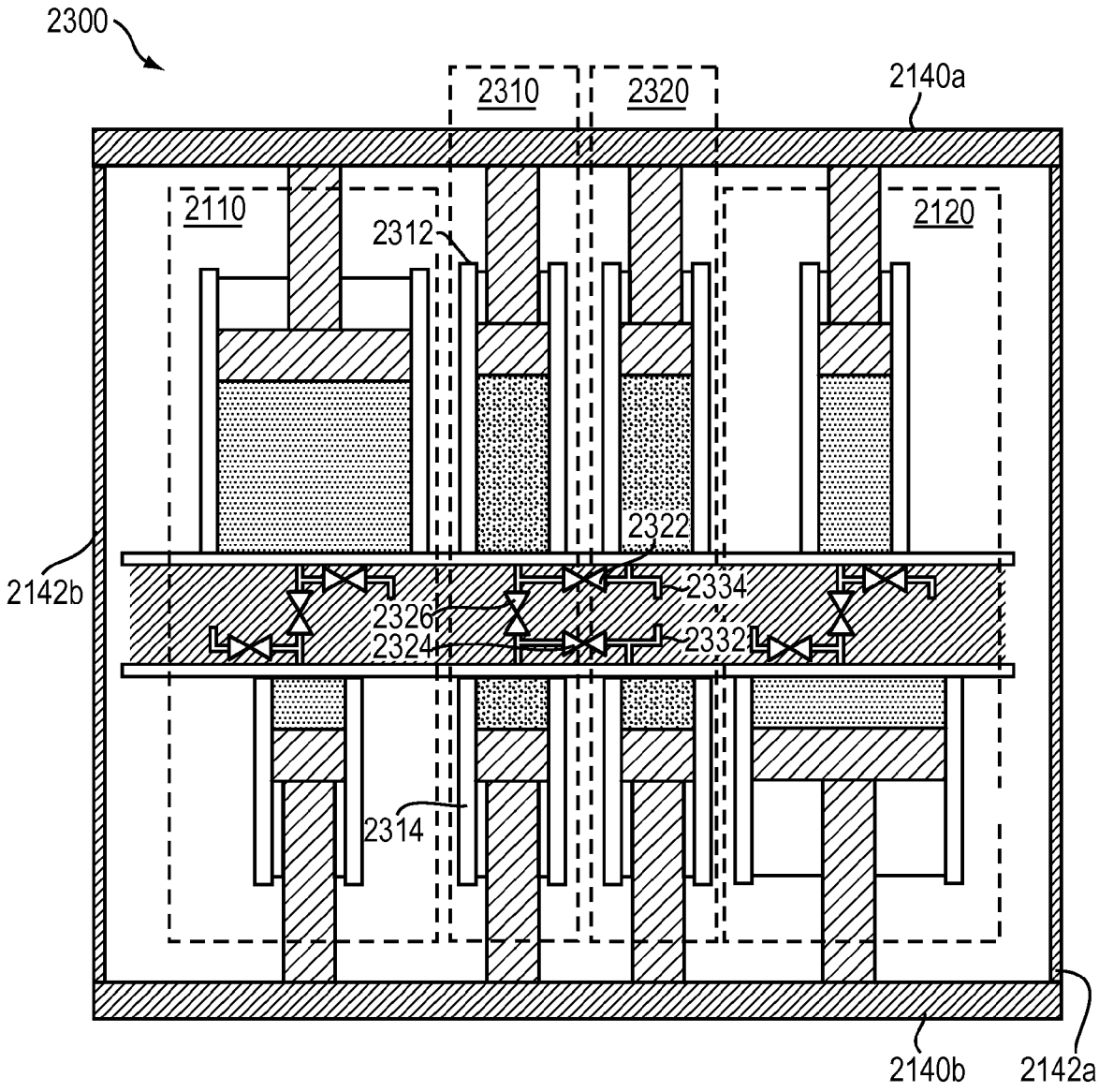
FIG. 23 is a schematic diagram of an alternative system using a plurality of staged pneumatic cylinder assemblies connected to a plurality of hydraulic cylinder assemblies in accordance with various embodiments of the invention.

FIG. 23 depicts yet another system 2300 for achieving near-isothermal compression and expansion of a gas for energy storage and recovery using cylinders. As shown in FIG. 23, the system 2300 includes a set of staged pneumatic cylinder assemblies connected to a set of hydraulic cylinder assemblies via a common manifold block 2330 and a common beam or platen structure 2140*a*, 2140*b*, 2142*a*, 2142*b*. Specifically, the system 2300 includes two pneumatic cylinder assemblies 2110, 2120 that are identical in function to those described with respect to FIG. 21. The cylinder rods 2102*a*, 2102*b*, 2104*a*, 2104*b* for the pneumatic cylinder assemblies 2110, 2120 are attached to the common beam or platen structure 2140*a*, 2140*b*, 2142*a*, 2142*b*, such that the cylinder pistons 2106*a*, 2106*b*, 2108*a*, 2108*b* and rods 2102*a*, 2102*b*, 2104*a*, 2104*b* move together. Work done by the expanding gas in the pneumatic cylinder assemblies 2110, 2120 is harnessed hydraulically by hydraulic cylinder assemblies 2310, 2320 attached to the common beam 2140*a*, 2140*b*. Likewise, in compression mode, the hydraulic cylinder assemblies 2310, 2320 may be used to hydraulically compress gas in the pneumatic cylinder assemblies 2110, 2120.

The hydraulic cylinder assemblies 2310, 2320 are identical in construction to the hydraulic cylinder assembly 2160 described with respect to FIG. 21, except for the connections in the manifold block 2330. The valve arrangement shown for the hydraulic cylinder assemblies 2310, 2320 allows for hydraulically driving the platen assembly 2140*a*, 2140*b*, 2142*a*, 2142*b* with both hydraulic cylinder assemblies 2310, 2320 in parallel (acting as a single larger hydraulic cylinder) or with the second hydraulic cylinder assembly 2320, while the first hydraulic cylinder assembly 2310 is unloaded. In this manner, the effective area of the hydraulic cylinder assembly may be changed mid-stroke. By positioning cylinder bodies 2312, 2314 in close proximity to one another, separated only by the manifold block 2330 with integral valve 2326, hydraulic cylinder body 2312 may be readily connected to hydraulic cylinder body 2314 with little piping distance therebetween, minimizing any pressure losses in the unloading process. Valves 2322 and 2324 may be used to isolate the unloaded hydraulic cylinder assembly 2310 from the pressurized hydraulic cylinder assembly 2320 and the hydraulic ports 2334, 2332. The ports 2334, 2332 may be connected through additional valve assemblies to a hydraulic pump/motor (not shown) that allows for hydraulically harnessing work from expansion in the pneumatic cylinder assemblies 2110, 2120 and using hydraulic work by the hydraulic motor/pump to compress gas in the pneumatic cylinder assemblies 2110, 2120.

In FIG. 23, two sets of hydraulic cylinders of identical size are shown; however, multiple cylinder assemblies of identical or varying diameters may be used to suit a particular application. By adding more hydraulic cylinder assemblies and unloading valve assemblies, the effective piston area of the hydraulic circuit may be modified numerous times during a single stroke.

In the exemplary systems and methods described with respect to FIGS. 21-23, the forces on the platen assembly 2140*a*, 2140*b*, 2142*a*, 2142*b* are not necessarily balanced (i.e., net torques may be present), and thus, a structure to balance these forces and provide up/down motion of the platen assembly (as opposed to a twisting motion) may preferably be utilized. Such assemblies for managing non-balanced forces from multiple cylinders of varying diameters and pressures are described above with respect to FIGS. 16A, 16B, and 17-19. Additionally, the forces may be balanced to offset most or all net torque on the platen assembly 2140*a*, 2140*b*, 2142*a*, 2142*b* by using multiple identical cylinders offset around a common axis, as described with respect to FIGS. 24A and 24B, where a plurality of force-balanced staged pneumatic cylinder assemblies is connected to a plurality of force-balanced hydraulic cylinder assemblies.

Figure 24A:
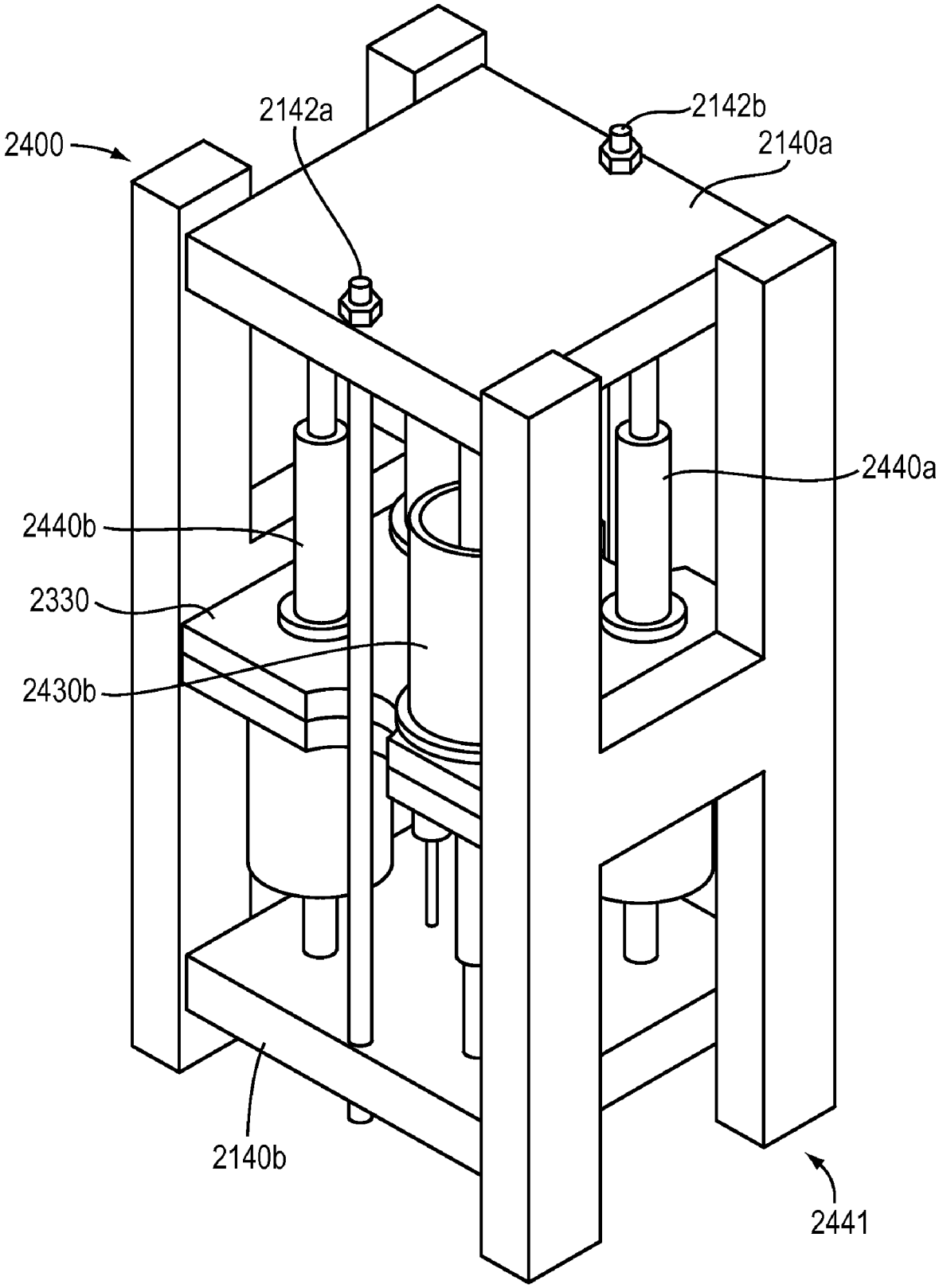
FIG. 24A is a schematic perspective view of an embodiment of the system of FIG. 23.
Figure 24B:
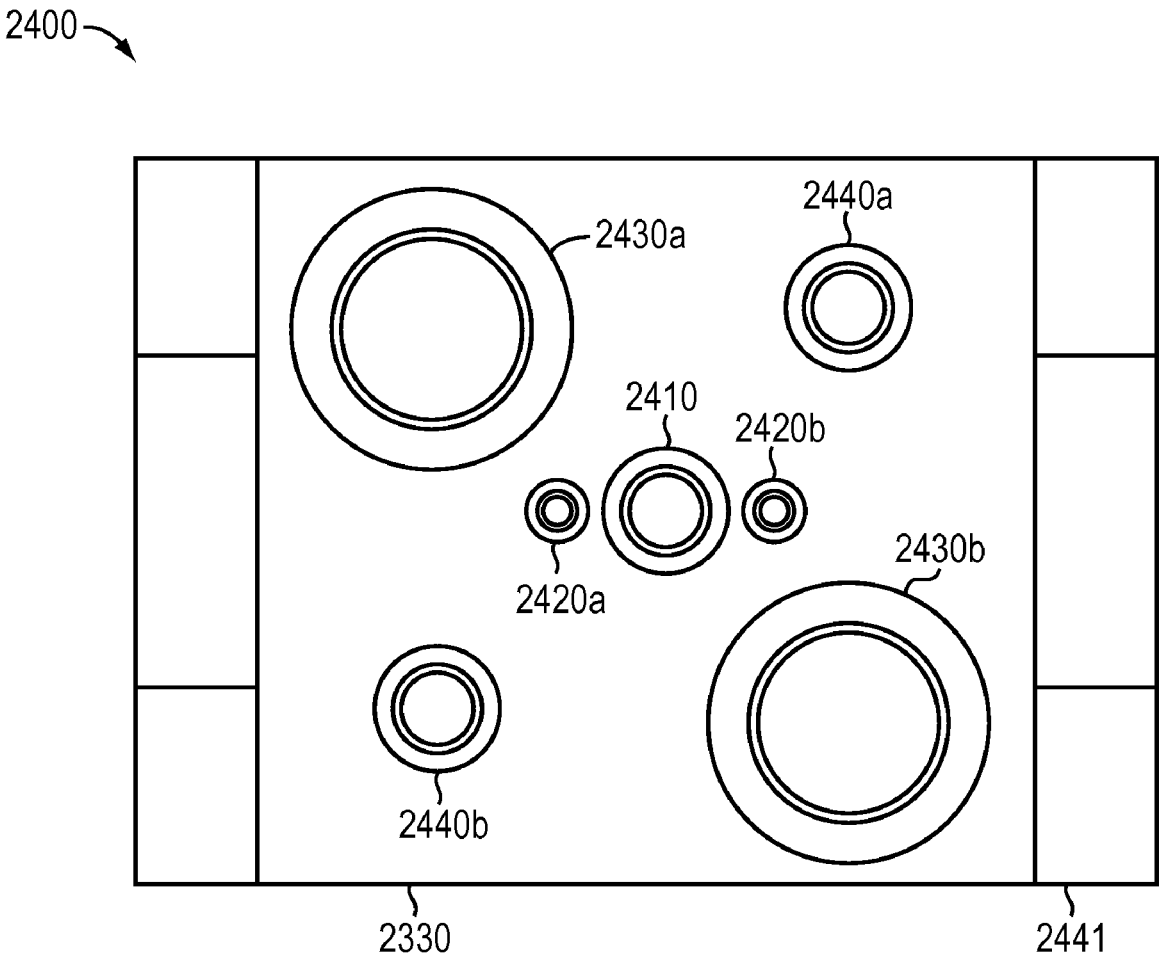
FIG. 24B is a schematic top view of the system of FIG. 23.

FIGS. 24A and 24B depict schematic perspective and top views of a system 2400 of force-balanced staged pneumatic cylinder assemblies coupled to a set of force-balanced hydraulic cylinder assemblies via a common frame 2441 and manifold block 2330. The common manifold block 2330, whose function is described above with respect to FIG. 23, is supported by the common frame 2441 (illustrated here as a machined steel H frame) that includes top and bottom platen assemblies 2140*a*, 2140*b* and tie rods 2142*a*, 2142*b*. The top and bottom platen assemblies 2140*a*, 2140*b* are essentially as described with respect to FIGS. 21 and 23.

FIG. 24B depicts the system 2400 with the top platen assembly 2140*a* removed for clarity. As shown in FIG. 24B, the system 2400 includes a hydraulic cylinder assembly 2410 that is centrally located within the system 2400. The hydraulic cylinder assembly 2410 is operated in the same manner as the hydraulic cylinder assembly 2310 described with respect to FIG. 23. Because the hydraulic cylinder assembly 2410 is centered within the system, there is no net torque introduced to the common frame 2441 or manifold block 2330. The additional two hydraulic cylinder assemblies 2420*a*, 2420*b* are operated in parallel and connected together in such a way as to act as a single hydraulic cylinder assembly. The two identical hydraulic cylinder assemblies 2420*a*, 2420*b* are operated in the same manner as hydraulic cylinder assembly 2320 described with respect to FIG. 23. As the two identical hydraulic cylinder assemblies 2420*a*, 2420*b* are operated in parallel, no net torque is introduced to the frame 2441 or manifold 2330.

The system also includes a first set of two identical pneumatic cylinder assemblies 2430*a*, 2430*b* that are also operated in parallel and connected together in such a way as to act as a single pneumatic cylinder assembly. The first set of pneumatic cylinder assemblies 2430*a*, 2430*b* are operated in the same manner as pneumatic cylinder assembly 2110 described with respect to FIGS. 21-23. As the first set of pneumatic cylinder assemblies 2430*a*, 2430*b* are operated in parallel, no net torque is introduced to the frame 2441 or manifold 2330.

The system 2400 further includes a second set of two identical pneumatic cylinder assemblies 2440*a*, 2440*b* that are operated in parallel and connected together in such a way as to act as a single pneumatic cylinder assembly. The second set of pneumatic cylinder assemblies 2440*a*, 2440*b* are operated in the same manner as pneumatic cylinder assembly 2120 described with respect to FIGS. 21-23. Because the second set of pneumatic cylinder assemblies 2440*a*, 2440*b* are operated in parallel, no net torque is introduced to the frame 2441 or manifold 2330.

Generally, the systems described herein may be operated in both an expansion mode and in the reverse compression mode as part of a full-cycle energy storage system with high efficiency. For example, the systems may be operated as both compressor and expander, storing electricity in the form of the potential energy of compressed gas and producing electricity from the potential energy of compressed gas. Alternatively, the systems may be operated independently as compressors or expanders.

In addition, the mechanisms shown in FIGS. 20-23, 24A, and 24B, and/or other embodiments employing liquid-spray heat exchange or external gas heat exchange (as described above), may draw or deliver thermal energy via their heat-exchange mechanisms to external systems (not shown) for purposes of cogeneration, as described in U.S. patent application Ser. No. 12/690,513, the disclosure of which is hereby incorporated by reference herein in its entirety.

Figure 25:
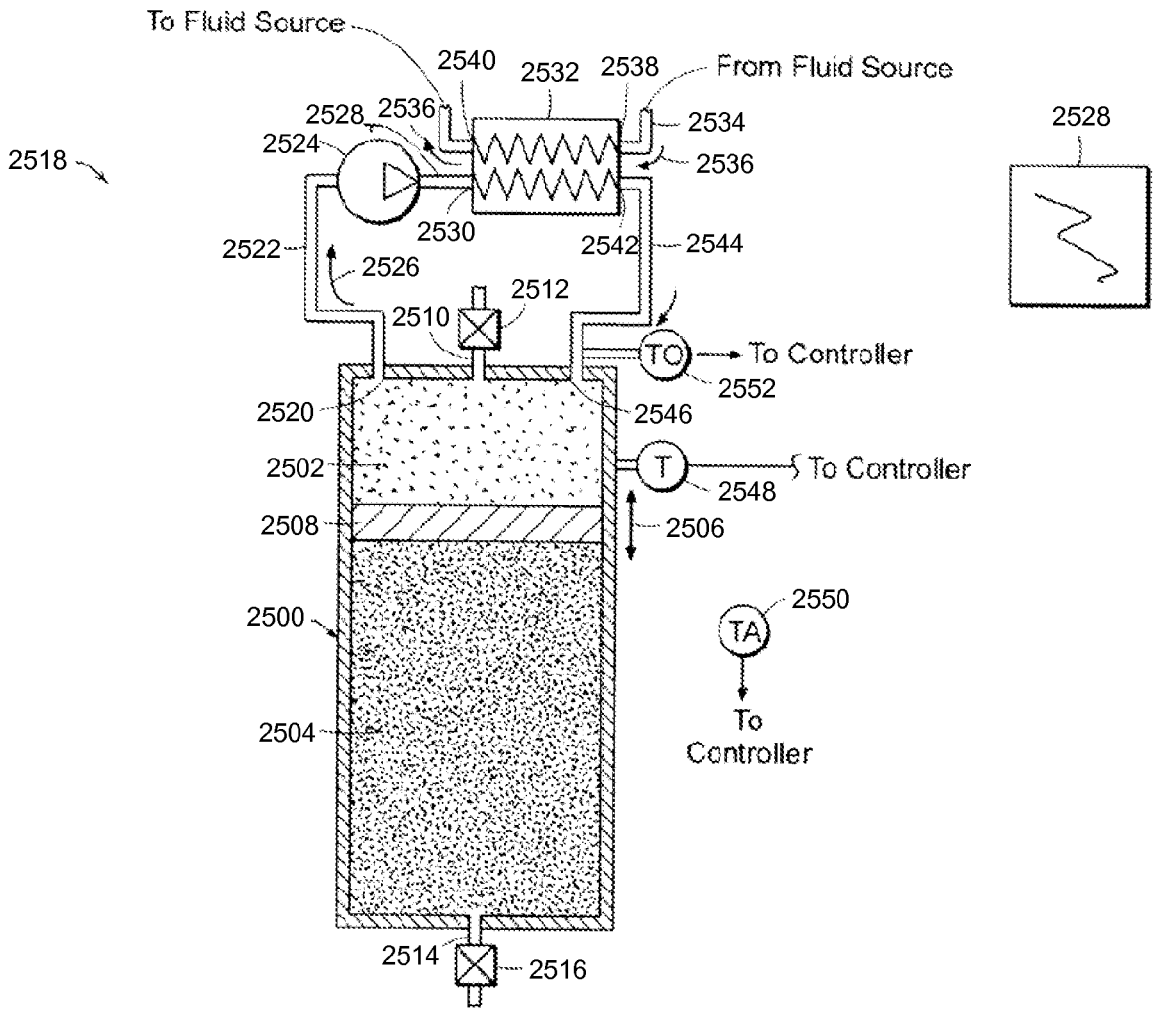
FIG. 25 is a schematic partial cross-section of a cylinder assembly including a heat-transfer subsystem that facilitates isothermal expansion and compression in accordance with various embodiments of the invention.

As described above, various embodiments of the invention feature heat exchange with gas being compressed and/or expanded to improve efficiency thereof and facilitate, e.g., substantially isothermal compression and/or expansion. FIG. 25 depicts a system in accordance with various embodiments of the invention. The system includes a cylinder 2500 containing a first chamber 2502 (which is typically pneumatic) and a second chamber 2504 (which may be pneumatic or hydraulic) separated by, e.g., a movable (double arrow 2506) piston 2508 or other force/pressure-transmitting barrier. The cylinder 2500 may include a primary gas port 2510, which can be closed via valve 2512 and that connects with a pneumatic circuit, or any other pneumatic source/storage system. The cylinder 2500 may further include a primary fluid port 2514 that can be closed by valve 2516. This fluid port may connect with a source of fluid in a hydraulic circuit or with any other fluid (e.g., gas) reservoir.

With reference now to the heat transfer subsystem 2518, as shown, the cylinder 2500 has one or more gas circulation output ports 2520 that are connected via piping 2522 to a gas circulator 2524. The gas circulator 2524 may be a conventional or customized low-head pneumatic pump, fan, or any other device for circulating gas. The gas circulator 2524 is preferably sealed and rated for operation at the pressures contemplated within the gas chamber 2502. Thus, the gas circulator 2524 creates a flow (arrow 2526) of gas up the piping 2522 and therethrough. The gas circulator 2524 may be powered by electricity from a power source or by another drive mechanism, such as a fluid motor. The mass-flow speed and on/off functions of the circulator 2524 may be controlled by a controller 2528 acting on the power source for the circulator 2524. The controller 2528 may be a software and/or hardware-based system that carries out the heat-exchange procedures described herein. The output of the gas circulator 2524 is connected via a pipe 2528 to a gas input 2530 of a heat exchanger 2532.

The heat exchanger 2532 of the illustrative embodiment may be any acceptable design that allows energy to be efficiently transferred to and from a high-pressure gas flow contained within a pressure conduit to another mass flow (e.g., fluid). The rate of heat exchange is based at least in part on the relative flow rates of the gas and fluid, the exchange surface area between the gas and fluid, and the thermal conductivity of the interface therebetween. For example, the gas flow is heated in the heat exchanger 2532 by the fluid counter-flow 2534 (arrows 2536), which enters the fluid input 2538 of heat exchanger 2532 at ambient temperature and exits the heat exchanger 2532 at the fluid exit 2540 equal or approximately equal in temperature to the gas in piping 2528. The gas flow at gas exit 2542 of heat exchanger 2532 is at ambient or approximately ambient temperature, and returns via piping 2544 through one or more gas circulation input ports 2546 to gas chamber 2502. By "ambient" it is meant the temperature of the surrounding environment, or another desired temperature at which efficient performance of the system may be achieved. The ambient-temperature gas reentering the cylinder's gas chamber 2502 at the circulation input ports 2546 mixes with the gas in the gas chamber 2502, thereby bringing the temperature of the fluid in the gas chamber 2502 closer to ambient temperature.

The controller 2528 manages the rate of heat exchange based, for example, on the prevailing temperature (T) of the gas contained within the gas chamber 2502 using a temperature sensor 2548 of conventional design that thermally communicates with the gas within the chamber 2502. The sensor 2548 may be placed at any location along the cylinder including a location that is at, or adjacent to, the heat exchanger gas input port 2520. The controller 2528 reads the value T from the cylinder sensor and may compare it to an ambient temperature value (TA) derived from a sensor 2550 located somewhere within the system environment. When T is greater than TA, the heat transfer subsystem 2518 is directed to move gas (by powering the circulator 2524) therethrough at a rate that may be partly dependent upon the temperature differential (e.g., so that the exchange does not overshoot or undershoot the desired setting). Additional sensors may be located at various locations within the heat exchange subsystem to provide additional telemetry that may be used by a more complex control algorithm. For example, the output gas temperature (TO) from the heat exchanger may measured by a sensor 2552 that is placed upstream of the outlet port 2546.

The heat exchanger's fluid circuit may be filled with water, a coolant mixture, and/or any acceptable heat-transfer medium. In alternative embodiments, a gas, such as air or refrigerant, is used as the heat-transfer medium. In general, the fluid is routed by conduits to a large reservoir of such fluid in a closed or open loop. One example of an open loop is a well or body of water from which ambient water is drawn and the exhaust water is delivered to a different location, for example, downstream in a river. In a closed loop embodiment, a cooling tower may cycle the water through the air for return to the heat exchanger. Likewise, water may pass through a submerged or buried coil of continuous piping where a counter heat-exchange occurs to return the fluid flow to ambient before it returns to the heat exchanger for another cycle.

Figure 26B:
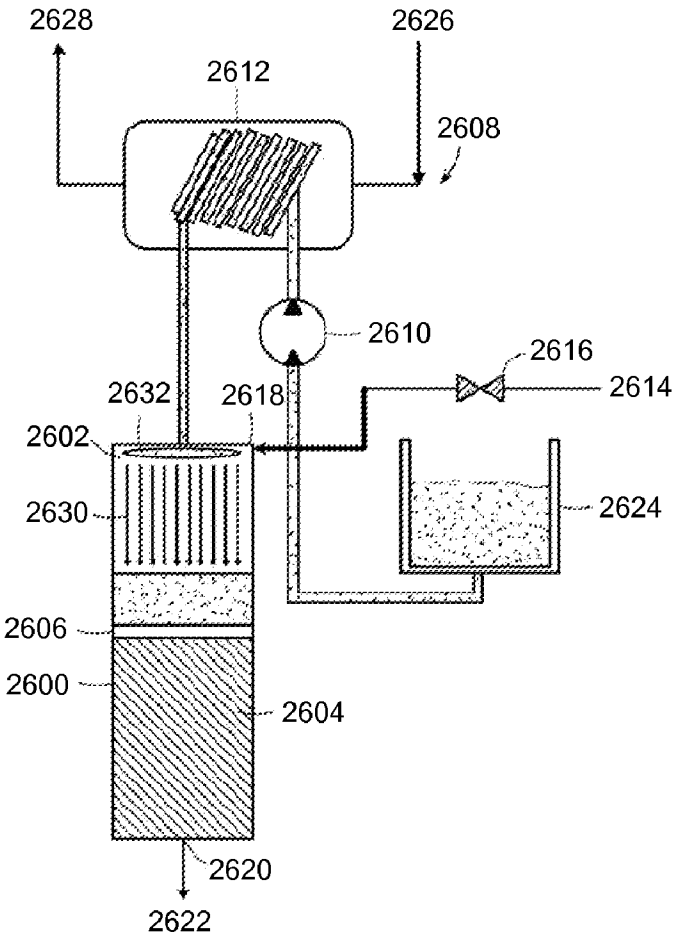
FIGS. 26A and 26B are schematic diagrams of a system featuring heat exchange during gas compression and expansion in accordance with various embodiments of the invention.
Figure 26A:
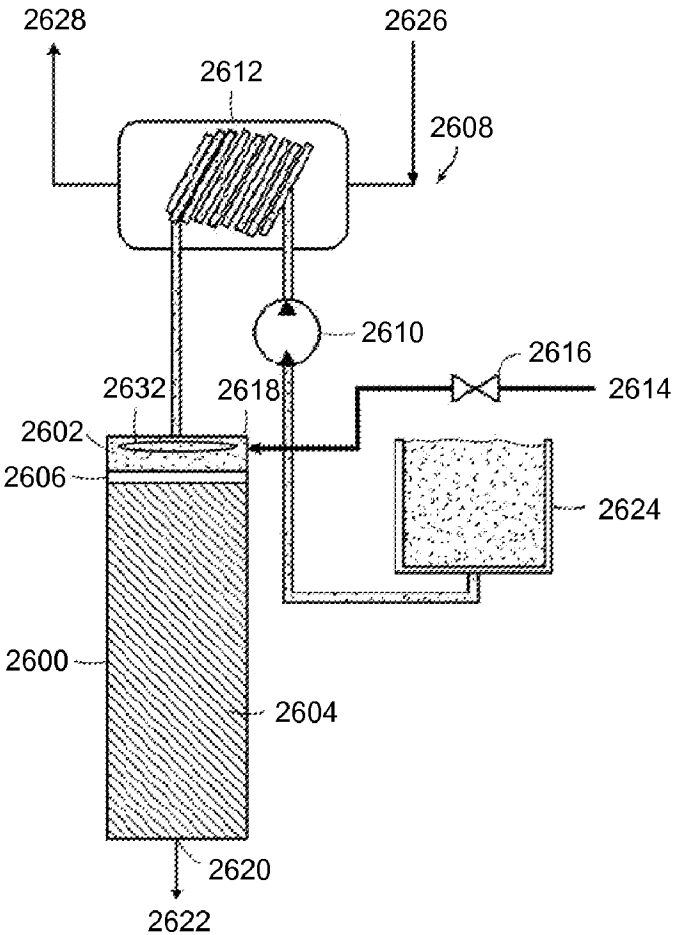

FIGS. 26A and 26B depict another system in accordance with embodiments of the present invention. As shown, water (or other heat-transfer fluid) is sprayed downward into a vertically oriented cylinder 2600, with a first chamber 2602 (which is typically pneumatic) separated from a second chamber 2604 by a moveable piston 2606 (or other separation mechanism). FIG. 26A depicts the cylinder 2600 in fluid communication with a heat transfer subsystem 2608 in a state prior to a cycle of compressed air expansion. The first chamber 2602 of the cylinder 2600 may be completely filled with liquid, leaving no air space (a circulator 2610 and a heat exchanger 2612 may be filled with liquid as well) when the piston 2606 is fully to the top as shown in FIG. 26A.

Stored compressed gas in pressure vessels, not shown but indicated by 2614, is admitted via valve 2616 into the cylinder 2600 through air port 2618. As the compressed gas expands into the cylinder 2600, fluid (e.g., gas or hydraulic fluid) is forced out through fluid port 2620 as indicated by 2622. During expansion (or compression), heat exchange liquid (e.g., water) may be drawn from a reservoir 2624 by a circulator, such as a pump 2610, through a liquid-to-liquid heat exchanger 2612, which may be a shell-and-tube type with an input 2626 and an output 2628 from the shell running to an environmental heat exchanger or to a source of process heat, cold water, or other external heat exchange medium.

As shown in FIG. 26B, the liquid (e.g., water) that is circulated by pump 2610 (at a pressure similar to that of the expanding gas) is introduced, e.g., sprayed (as shown by spray lines 2630), via a spray head 2632 into the first chamber 2602 of the cylinder 2600. Overall, this method allows for an efficient means of heat exchange between the sprayed liquid (e.g., water) and the air being expanded (or compressed) while using pumps and liquid-to-liquid heat exchangers. It should be noted that in this particular arrangement, the cylinder 2600 is preferably oriented vertically, so that the heat exchange liquid falls with gravity. At the end of the cycle, the cylinder 2600 is reset, and in the process, the heat exchange liquid added to the first chamber 2602 is removed via the pump 2610, thereby recharging reservoir 2624 and preparing the cylinder 2600 for a successive cycling.

Figure 26C:
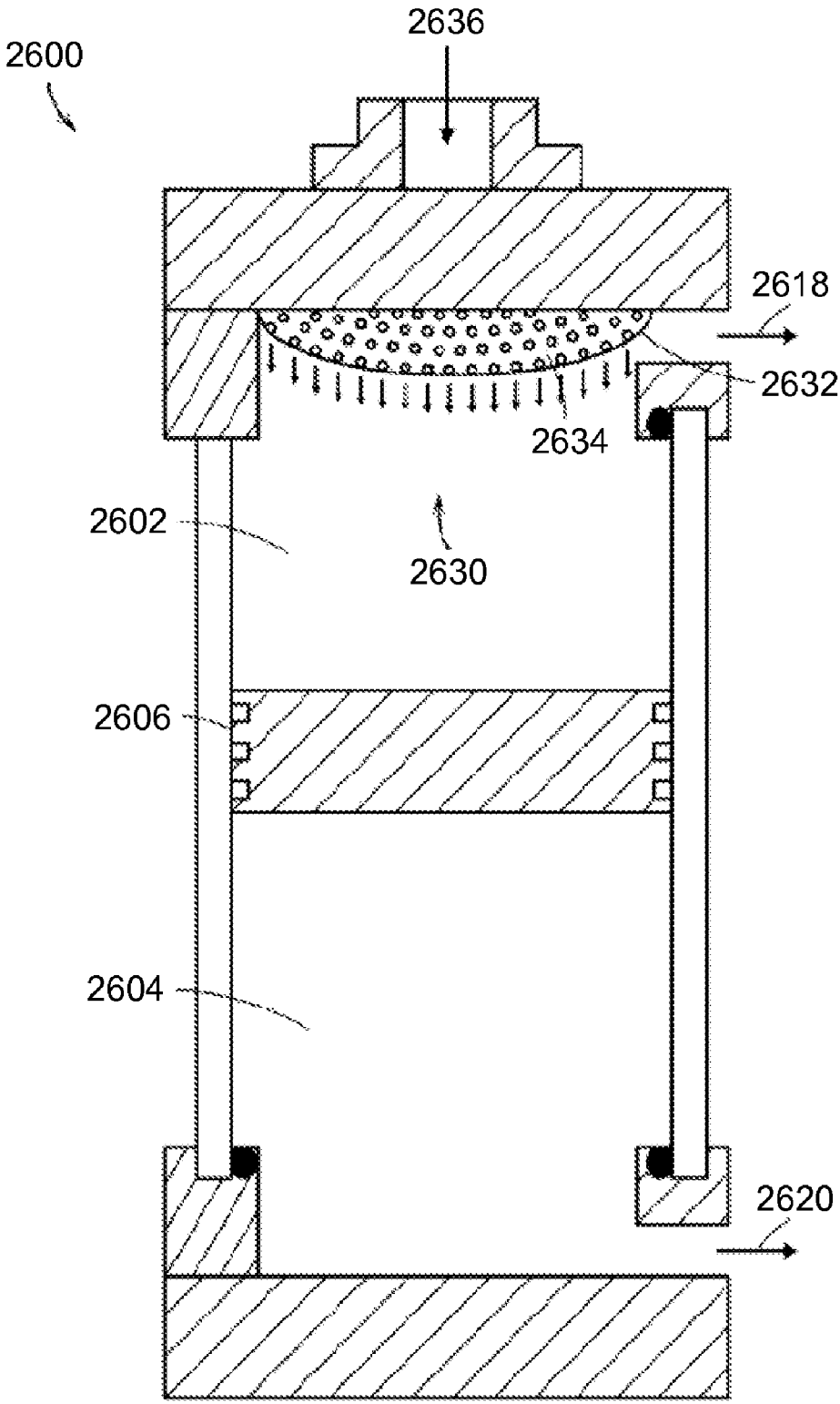
FIG. 26C is a schematic cross-sectional view of a cylinder assembly for use in the system of FIGS. 26A and 26B.

FIG. 26C depicts the cylinder 2600 in greater detail with respect to the spray head 2632. In this design, the spray head 2632 is used much like a shower head in the vertically oriented cylinder. In the embodiment shown, nozzles 2634 are approximately evenly distributed over the face of the spray head 2632; however, the specific arrangement and size of the nozzles may vary to suit a particular application. With the nozzles 2634 of the spray head 2632 evenly distributed across the end-cap area, substantially the entire gas volume is exposed to the spray 2630. As previously described, the heat transfer subsystem circulates/injects the water into the first chamber 2602 via port 2636 at a pressure slightly higher than the air pressure and then removes the water at the end of the return stroke at ambient pressure.

Figure 27A:
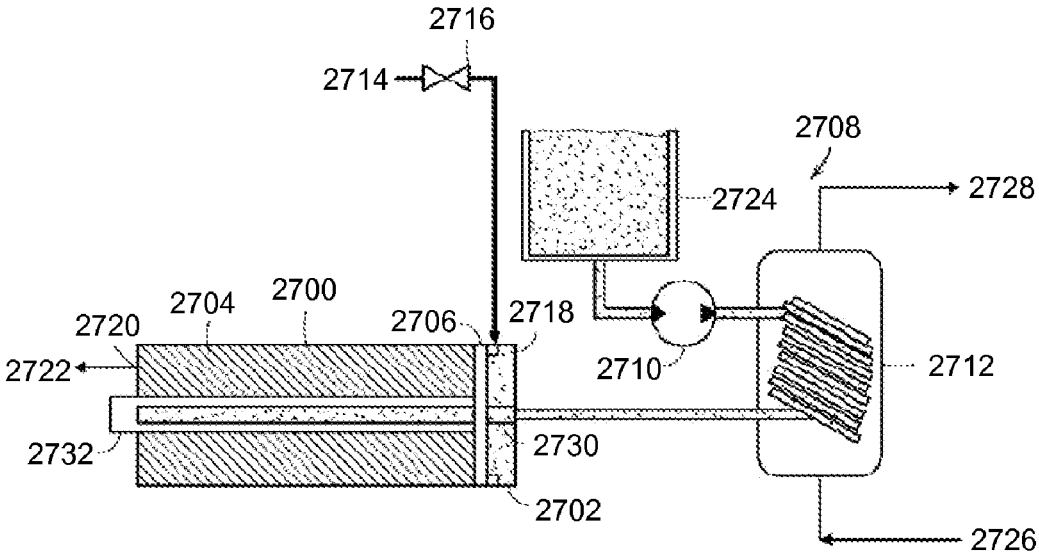
FIGS. 27A and 27B are schematic diagrams of a system featuring heat exchange during gas compression and expansion in accordance with various embodiments of the invention.
Figure 27B:
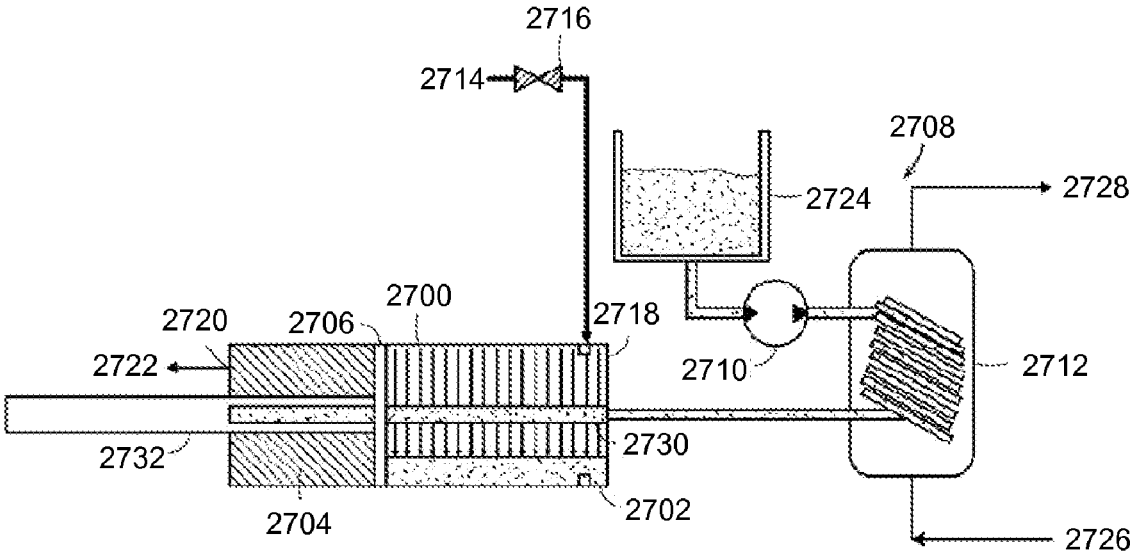

FIGS. 27A and 27B depict another system in accordance with embodiments of the present invention. As shown, water (or other heat-transfer fluid) is sprayed radially into an arbitrarily oriented cylinder 2700. The orientation of the cylinder 2700 is not essential to the liquid spraying and is shown as horizontal in FIGS. 27A and 27B. The cylinder 2700 has a first chamber 2702 (which is typically pneumatic) separated from a second chamber 2704 (which may be pneumatic or hydraulic) by, e.g., a moveable piston 2706. FIG. 27A depicts the cylinder 2700 in fluid communication with a heat transfer subsystem 2708 in a state prior to a cycle of compressed air expansion. The first chamber 2702 of the cylinder 2700 may be filled with liquid (a circulator 2710 and a heat exchanger 2712 may also be filled with liquid) when the piston 2706 is fully retracted as shown in FIG. 27A.

Stored compressed gas in pressure vessels, not shown but indicated by 2714, is admitted via valve 2716 into the cylinder 2700 through air port 2718. As the compressed gas expands into the cylinder 2700, fluid (e.g., gas or hydraulic fluid) is forced out through fluid port 2720 as indicated by 2722. During expansion (or compression), heat exchange liquid (e.g., water) may be drawn from a reservoir 2724 by a circulator, such as a pump 2710, through a liquid-to-liquid heat exchanger 2712, which may be a tube-in-shell setup with an input 2726 and an output 2728 from the shell running to an environmental heat exchanger or to a source of process heat, cold water, or other external heat exchange medium. As indicated in FIG. 27B, the liquid (e.g., water) that is circulated by pump 2710 (at a pressure similar to that of the expanding gas) is introduced, e.g., sprayed, via a spray rod 2730 into the first chamber 2702 of the cylinder 2700. The spray rod 2730 is shown in this example as fixed in the center of the cylinder 2700 with a hollow piston rod 2732 separating the heat exchange liquid (e.g., water) from the second chamber 2704. As the moveable piston 2706 is moved (for example, leftward in FIG. 27B) forcing fluid out of cylinder 2700, the hollow piston rod 2732 extends out of the cylinder 2700 exposing more of the spray rod 2730, such that the entire first chamber 2702 is exposed to the heat exchange spray. Overall, this method enables efficient heat exchange between the sprayed liquid (e.g., water) and the air being expanded (or compressed) while using pumps and liquid-to-liquid heat exchangers. It should be noted that in this particular arrangement, the cylinder 2700 may be oriented in any manner and does not rely on the heat exchange liquid falling with gravity. At the end of the cycle, the cylinder 2700 may be reset, and in the process, the heat exchange liquid added to the first chamber 2702 may be removed via the pump 2710, thereby recharging reservoir 2724 and preparing the cylinder 2700 for a successive cycling.

Figure 27C:
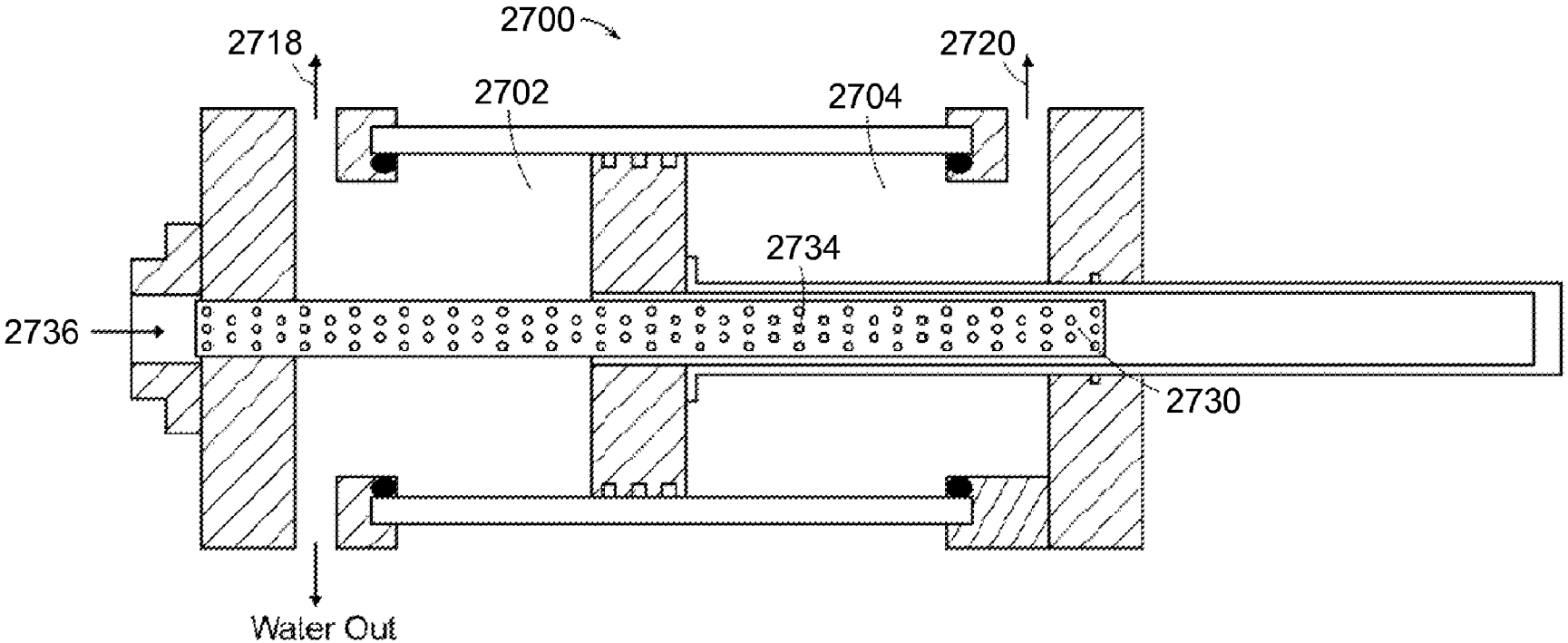
FIG. 27C is a schematic cross-sectional view of a cylinder assembly for use in the system of FIGS. 27A and 27B.

FIG. 27C depicts the cylinder 2700 in greater detail with respect to the spray rod 2730. In this design, the spray rod 2730 (e.g., a hollow stainless steel tube with many holes) is used to direct the water spray radially outward throughout the gas volume of the cylinder 2700. In the embodiment shown, nozzles 2734 are approximately evenly distributed along the length of the spray rod 2730; however, the specific arrangement and size of the nozzles may vary to suit a particular application. The water may be continuously removed from the bottom of the first chamber 2702 at pressure, or may be removed at the end of a return stroke at ambient pressure. As previously described, the heat transfer subsystem 2708 circulates/injects the water into the first chamber 2702 via port 2736 at a pressure slightly higher than the air pressure and then removes the water at the end of the return stroke at ambient pressure.

The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A system for energy storage and recovery via expansion and compression of a gas, and that is suitable for the efficient use and conservation of energy resources, the system comprising:

a first pneumatic cylinder assembly comprising (i) a first compartment, (ii) a second compartment, (iii) a piston, slidably disposed within the cylinder assembly, separating the compartments, and (iv) a piston rod coupled to the piston and extending outside the first compartment;

a second pneumatic cylinder assembly comprising (i) a first compartment, (ii) a second compartment, (iii) a piston, slidably disposed within the cylinder assembly, separating the compartments, and (iv) a piston rod coupled to the piston and extending outside the first compartment; and a heat-transfer subsystem in fluid communication with at least one of the pneumatic cylinder assemblies, wherein (i) the piston rods of the first and second pneumatic cylinder assemblies are mechanically coupled, (ii) the first and second pneumatic cylinder assemblies are coupled in series pneumatically, thereby reducing a force range produced during expansion or compression of a gas within the first and second pneumatic cylinder assemblies, and (iii) the heat-transfer subsystem comprises a circulation apparatus for circulating a heat-transfer fluid through at least one compartment of at least one of the pneumatic cylinder assemblies.

2. The system of claim 1, wherein the first and second pneumatic cylinder assemblies are mechanically coupled in parallel such that, during a single stroke, their piston rods move in the same direction.

3. The system of claim 1, further comprising:

a first hydraulic cylinder assembly comprising (i) a first compartment, (ii) a second compartment, (iii) a piston, slidably disposed within the cylinder assembly, separating the compartments, and (iv) a piston rod coupled to the piston, extending outside the first compartment, and mechanically coupled to the piston rods of the first and second pneumatic cylinder assemblies; and a hydraulic motor/pump fluidly coupled to the first hydraulic cylinder assembly such that a hydraulic fluid flows therebetween.

4. The system of claim 3, further comprising:

a second hydraulic cylinder assembly, fluidly coupled to the hydraulic motor/pump such that the hydraulic fluid flows therebetween, the second hydraulic cylinder assembly comprising (i) a first compartment, (ii) a second compartment, (iii) a piston, slidably disposed within the cylinder assembly, separating the compartments, and (iv) a piston rod coupled to the piston, extending outside the first compartment, and mechanically coupled to the piston rod of the first hydraulic cylinder assembly.

5. The system of claim 4, wherein the first and second hydraulic cylinder assemblies are mechanically coupled in parallel such that, during a single stroke, their piston rods move in the same direction.

6. The system of claim 5, further comprising a mechanism for selectively fluidly coupling the first and second compartments of the first hydraulic cylinder assembly, thereby reducing a pressure range of the hydraulic fluid flowing to the hydraulic motor/pump.

7. The system of claim 3, further comprising:

a second hydraulic cylinder assembly, fluidly coupled to the hydraulic motor/pump such that the hydraulic fluid flows therebetween, the second hydraulic cylinder assembly comprising (i) a first compartment, (ii) a second compartment, and (iii) a piston, slidably disposed within the cylinder assembly, separating the compartments, wherein the first hydraulic cylinder assembly is telescopically disposed within the second hydraulic cylinder assembly and coupled to the piston of the second hydraulic cylinder assembly.

8. The system of claim 1, wherein the heat-transfer subsystem comprises a mechanism disposed within at least one compartment of at least one of the pneumatic cylinder assemblies for introducing the heat-transfer fluid.

9. The system of claim 8, wherein the mechanism comprises at least one of a spray head or a spray rod.

10. A system for energy storage and recovery via expansion and compression of a gas, and that is suitable for the efficient use and conservation of energy resources, the system comprising:

a first pneumatic cylinder assembly comprising (i) a first compartment, (ii) a second compartment, (iii) a piston, slidably disposed within the cylinder assembly, separating the compartments, and (iv) a piston rod coupled to the piston and extending outside the first compartment;

a second pneumatic cylinder assembly comprising (i) a first compartment, (ii) a second compartment, (iii) a piston, slidably disposed within the cylinder assembly, separating the compartments, and (iv) a piston rod coupled to the piston and extending outside the first compartment; and an armature coupled to the piston rods of the first and second pneumatic cylinder assemblies, thereby mechanically coupling the piston rods, wherein the first and second pneumatic cylinder assemblies are coupled in series pneumatically, thereby reducing a force range produced during expansion or compression of a gas within the first and second pneumatic cylinder assemblies.

11. The system of claim 10, wherein the armature comprises a crankshaft assembly.

12. The system of claim 10, further comprising a heat-transfer subsystem in fluid communication with at least one of the pneumatic cylinder assemblies, wherein the heat-transfer subsystem comprises a circulation apparatus and a heat exchanger, the circulation apparatus configured to circulate gas from at least one compartment of at least one of the pneumatic cylinder assemblies through the heat exchanger and back to the at least one compartment.

13. The system of claim 10, further comprising a heat-transfer subsystem in fluid communication with at least one of the pneumatic cylinder assemblies, the heat-transfer subsystem comprising (i) a circulation apparatus for circulating a heat-transfer fluid through at least one compartment of at least one of the pneumatic cylinder assemblies and (ii) a mechanism for introducing the heat-transfer fluid within the at least one compartment of the at least one of the pneumatic cylinder assemblies.

14. A system for energy storage and recovery via expansion and compression of a gas, and that is suitable for the efficient use and conservation of energy resources, the system comprising:

a first pneumatic cylinder assembly comprising (i) a first compartment, (ii) a second compartment, (iii) a piston, slidably disposed within the cylinder assembly, separating the compartments, and (iv) a piston rod coupled to the piston and extending outside the first compartment;

a second pneumatic cylinder assembly comprising (i) a first compartment, (ii) a second compartment, (iii) a piston, slidably disposed within the cylinder assembly, separating the compartments, and (iv) a piston rod coupled to the piston and extending outside the first compartment; and a manifold block on which the first and second pneumatic cylinder assemblies are mounted, wherein (i) the piston rods of the first and second pneumatic cylinder assemblies are mechanically coupled, (ii) the first and second pneumatic cylinder assemblies are coupled in series pneumatically, thereby reducing a force range produced during expansion or compression of a gas within the first and second pneumatic cylinder assemblies, and (iii) a connection between the first and second pneumatic cylinder assemblies extends through the manifold block and has a length minimizing potential dead space between the first and second pneumatic cylinder assemblies.

15. The system of claim 14, wherein the first and second cylinder assemblies are mounted on a first side of the manifold block.

16. The system of claim 14, wherein the first cylinder assembly is mounted on a first side of the manifold block and the second cylinder assembly is mounted on a second side of the manifold block opposite the first side.

17. The system of claim 16, wherein, during expansion or compression of gas, the piston of the first pneumatic cylinder assembly moves toward the manifold block and the piston of the second pneumatic cylinder assembly moves away from the manifold block.

18. The system of claim 14, further comprising (i) a frame assembly on which the first and second pneumatic cylinder assemblies are mounted, and (ii) a beam assembly, slidably coupled to the frame assembly, that mechanically couples the piston rods of the first and second pneumatic cylinder assemblies.

19. The system of claim 18, further comprising a roller assembly disposed on the beam assembly for slidably coupling the beam assembly to the frame assembly, the roller assembly counteracting forces and torques transmitted between the first and second pneumatic cylinder assemblies and the beam assembly.

20. The system of claim 14, further comprising a heat-transfer subsystem in fluid communication with at least one of the pneumatic cylinder assemblies, the heat-transfer subsystem comprising (i) a circulation apparatus for circulating a heat-transfer fluid through at least one compartment of at least one of the pneumatic cylinder assemblies and (ii) a mechanism for introducing the heat-transfer fluid within the at least one compartment of the at least one of the pneumatic cylinder assemblies.

* * * * *